US011432655B2

(12) United States Patent
Garner

(10) Patent No.: US 11,432,655 B2
(45) Date of Patent: Sep. 6, 2022

(54) COOLING APPARATUS, KITS, METHODS AND USES THEREFOR

(71) Applicant: Steven Lee Garner, O'Fallon, MO (US)

(72) Inventor: Steven Lee Garner, O'Fallon, MO (US)

(73) Assignee: Ganer Zackson, LLC, O'Fallon, MO (US)

( * ) Notice: Subject to any disclaimer, the term of this patent is extended or adjusted under 35 U.S.C. 154(b) by 0 days.

(21) Appl. No.: 16/946,898

(22) Filed: Jul. 10, 2020

(65) Prior Publication Data

US 2021/0007499 A1 Jan. 14, 2021

Related U.S. Application Data

(60) Provisional application No. 62/892,216, filed on Aug. 27, 2019, provisional application No. 62/873,810, filed on Jul. 12, 2019.

(51) Int. Cl.

| | |
|---|---|
| ***A47C 7/70*** | (2006.01) |
| ***A47C 7/74*** | (2006.01) |
| *A47C 4/28* | (2006.01) |

(52) U.S. Cl.

CPC ..... *A47C 7/744* (2013.01); *A47C 4/28* (2013.01)

(58) Field of Classification Search

CPC ..... A47C 7/74; A47C 7/742; A47C 7/744; A47C 7/746

See application file for complete search history.

(56) References Cited

U.S. PATENT DOCUMENTS

| | | | | |
|---|---|---|---|---|
| 3,801,091 | A | 4/1974 | McPherson | |
| 4,946,220 | A | 8/1990 | Wyon | |
| 6,644,735 | B2 | 11/2003 | Bargheer | |
| 7,866,743 | B1 | 1/2011 | Russell | |
| 7,878,585 | B2 | 2/2011 | Salisbury | |
| 8,801,091 | B2 * | 8/2014 | Squires | A47C 7/746 297/180.14 |
| 9,155,398 | B2 | 10/2015 | Arens | |
| 9,173,500 | B2 * | 11/2015 | Squires | A47C 7/744 |
| 2004/0075311 | A1 | 4/2004 | Linder | |
| 2013/0328359 | A1 * | 12/2013 | Antonov | A47C 7/742 297/180.14 |
| 2018/0301918 | A1 * | 10/2018 | Lupo | H02J 7/00 |

OTHER PUBLICATIONS https://geardiary.com/2015/07/18/traveling-breeze-fan-cooled-camping-chair-is-the-future-in-outdoor-relaxation/, Perry Brauner, Jul. 18, 2015.* https://www.walmart.com/ip/Air-Fan-Cooling-Mesh-Camp-Chair-Blue/55846119 Walmart Catalog # 564462126.

https://www.engineeringtoolbox.com/convective-heat-transfer-d_430.html The Engineering ToolBox Convective Heat Transfer.

* cited by examiner

*Primary Examiner* — Syed A Islam

(74) *Attorney, Agent, or Firm* — Saul L. Zackson

(57) ABSTRACT

A fan-equipped apparatus comprising an elongated fan plenum for a cooling chair is disclosed. In some embodiments, an elongated fan plenum can be configured to direct airflow through a chair back and concentrate on a user's back. In some embodiments, a chair with a fan-equipped cooling apparatus and a porous chair back is provided. In some embodiments, a fan-equipped apparatus can be attached to a chair selected by the user. Thermal imaging demonstrates cooling of a user by operation of the apparatus.

14 Claims, 50 Drawing Sheets

Prior art

Prior Art

BEFORE

AFTER 2 MINUTES IN CHAIR

ΔT = -23F

BEFORE

AFTER 2 MINUTES IN CHAIR

ΔT = -17.7F

BEFORE AFTER 2 MINUTES IN CHAIR

ΔT = -31.0F

BEFORE AFTER 2 MINUTES IN CHAIR

ΔT = -20.9F

BEFORE

AFTER 2 MINUTES IN CHAIR

ΔT = -20.9F

BEFORE

AFTER 2 MINUTES IN CHAIR

ΔT = -7.0F

BEFORE

AFTER 2 MINUTES IN CHAIR

ΔT = +4.6F

COOLING APPARATUS, KITS, METHODS AND USES THEREFOR

PRIORITY

This application claims priority to U.S. Provisional patent application 62/873,810 filed Jul. 12, 2019, and U.S. Provisional patent application 62/892,216 filed Aug. 27, 2019. Each of these applications is incorporated by reference, each in its entirety.

INTRODUCTION

Hot weather and activities such as athletic activities can become increasingly uncomfortable, particularly amongst those accustomed to air conditioning. Hand held fans are available, but can be cumbersome to use. Devices and methods for keeping cool in warm or hot conditions are desirable.

US Patent Application Publication 20040075311 by Linder discloses a support affixed to a chair backrest that is suitable for receiving ice cubes. This application docs not disclose fans affixed to the support.

U.S. Pat. No. 4,946,220 to Wyon et al., describes a scat cushion for a car that uses a suction turbine to generate suction pressure to suck heat away from the body. This patent docs not disclose airflow from the scat back to the body of the chair user.

U.S. Pat. Nos. 8,801,091 and 9,173,500, to Squires et al. describe a folding chair that includes a fan assembly. The fan assembly is located in the seat of the chair and uses an airflow guide to direct air generally parallel to the back of the chair (FIG. 1). This assembly does not direct air flow perpendicular to the chair back, and docs not direct air to a person seated in the folding chair.

U.S. Pat. No. 9,155,398 to the University of California discloses a scat having a plenum as pan of a backrest that includes at least one fan that circulates air within the plenum. This patent does not disclose a fan attached to or embedded in the backrest that blows air directly against the user.

U.S. Pat. No. 6,644,735 to Bargheer et al. describes an automobile scat which has an air conditioning vent in the lop of the automobile seal, but this vent is attached to the car's air conditioning system: it docs not provide an independent cooling system.

U.S. Pat. No. 7,866,743 to Russell et al., discloses a thermoelectric cooler in the backrest of a chair, however, this cooler creates temperature gradients based on electricity flow in metal. This patent docs not disclose the use of fans in the backrest of a chair.

U.S. Pat. No. 7,878,585 to Salisbury discloses a foldable chair that includes a forced air cooling system. The foldable chair of Salisbury includes four crossed legs that are pivotally and slidably coupled to a pair of back legs and a pair of front legs, and a circular chair frame. The foldable chair of Salisbury further includes a fan bag that is attached to a meshed backrest. A fan is located at the bottom of the fan bag. This patent describes the direction of air flow from the fan as drawing ambient air into the fan bag and through the meshed backrest. The chair is configured for air to flow through the entire width of the meshed backrest.

An "Air Fan Cooling Chair" listed in a Walmart on-line catalog (Walmart #564462126) is described as containing "a large head, body, and seat with a mesh backing providing big airflow from two AA battery operated fans." The apparently identical chair is listed on an Amazon UK web catalog. This chair (the "Walmart chair") is depicted in FIG. 2 and FIG. 3.

SUMMARY

The present inventor has developed coding apparatuses that allow for air to blow directly on the back of the user including the user's neck and shoulders, thereby cooling the user. A user can experience increased comfort in hot weather, during or after athletic activity, or other situations where personal cooling is desirable. In various embodiments, a cooling apparatus of the present teachings can be a chair comprising one or more fans. In various configurations, the one or more fans can be positioned to blow air directly on a user sitting in a chair. In various configurations, a chair of the present teachings can cool a user more effectively compared to other chairs known in the art.

In various embodiments, an apparatus of the present teachings can comprise an elongated fan support, or "plenum" having a long axis, at least two fan assemblies mounted within the plenum, and an electric power source. In some configurations, the at least two fan assemblies can each comprise a fan configured to blow air perpendicular to the long axis of the plenum. In various configurations, an elongated fan plenum can be configured to direct airflow to concentrate on the center of the user's back, which can include the user's neck and shoulders. In various configurations, the use of an elongated fan plenum of the present teachings can result in an increased velocity of air propelled by the fans in comparison to chairs described in prior art chairs. Furthermore, in various configurations, an elongated fan plenum can be configured to direct airflow to exit through an upper region of the elongated fan plenum, and can be used to cool a user's upper body, including the neck and shoulders. In some configurations, an apparatus of the present teachings, such as a chair of the present teachings, can include an elongated fan plenum that can extend to a headrest. In various aspects, this can allow airflow to be directed to the user's shoulders, neck and head, and thus can help enhance cooling.

In various configurations, the electric power source can be a DC power source such as a battery. In various configurations, the power source can be a solar power source such as a solar cell. In various configurations, the at leas, two fan assemblies can be at least three fan assemblies. In various configurations, the at least two fan assemblies can be two fan assemblies, three fan assemblies, four fan assemblies or more fan assemblies. In various configurations, electric circuitry can include an On-Off switch, which can be integral with a battery or can be a separate electric component.

In various configurations, each fan of the at least two fans can be, independently, from about 40 mm in length and width up to about 220 mm in width and length. In various configurations, each fan of the at least two fans can be independently 40 mm in width and length, 50 mm in width and length, 60 mm in width and length, 70 mm in width and length, 80 mm in width and length, 92 mm in width and length, 120 mm in width and length, 140 mm in width and length, 200 mm in width and length, or 220 mm in width and length. In various configurations, each fan of the at least two fans can be 92 mm in width and length. In various configurations, each fan of the at least two fans can be 120 mm in width and length.

In various configurations, each fan of the at least two fans can be, independently, from about 10 mm in thickness up to about 32 mm in thickness, or thicker. In various configurations, each fan of the at least two fans can be independently, without limitation, 10 mm in thickness, 15 mm in thickness, 25 mm in thickness, 30 mm in thickness or 32 mm in thickness. In various configurations, each fan of the at least two fans can be 25 mm in thickness.

In various configurations, each fan of the at least two fans can be an axial fan, and can comprise from 3 blades up to 10 blades. In various configurations, each fan assembly can comprise a fan guard exterior to the plenum, a Ian interior to the plenum, and a frame extending from the fan guard, wherein the frame attaches to the fan.

In various configurations, each fan assembly can comprise a fan guard exterior to the plenum, a fan interior to the plenum, and a franc extending from the fan guard. In some configurations, the frame can comprise one or more clips, and a retainer can be configured to slide under the clip, and can secure the fan to the fan guard. In various configurations, a clip can be oriented towards the interior of the frame, oriented towards the outside of the frame, or the clips can be a combination of clips oriented towards the inside of the frame and clips oriented towards the outside of the frame. In some configurations, the clips oriented towards the inside of the frame can secure the fan. In some configurations, the clips oriented towards the outside of the frame can secure the retainer.

In various configurations, each fan can have a volumetric flow rating of 30 to 200 cubic feet per minute. In some configurations, each fan can have a volumetric flow rating of 70-80 cubic feet per minute.

In various configurations, the fans can be wired in parallel to the power source. In various configurations, the electric circuitry can include an On-Off switch.

In various configurations, the power source can be a direct current (DC) power source such as, for example and without limitation, one or more batteries. In some configurations, a battery can have a voltage of from 1 volt DC (VDC) to 20 VDC. In some configurations, a battery can have a voltage of from 1.5 volts DC (VDC) to 12 VDC. In various configurations, a battery can be a lead acid battery, a lithium ion battery, a nickel cadmium battery, a zinc carbon battery, or an alkaline battery. In various configurations, a battery can a rechargeable battery such as a lithium ion battery. In various configurations, a single battery, or a combination of batteries connected in series can have an output direct current voltage of at least 6 volts, such as, without limitation, 12 VDC, 20 VDC, 18 VDC, or 24 VDC.

In various configurations, the electric power source can be an alternating current (AC) source, such as, without limitation, a wall outlet (e.g., 120V or 220V) or a generator. In various configurations, the DC power supply can be a solar power supply.

In various configurations, a DC power source can be, for example, a 6 VDC power supply, or a 12 VDC power supply.

In various configurations, a plenum of the present teachings can comprise a non-porous material. In some configurations, the non-porous material can be, without limitation, a non-porous fabric such as canvas; a metal; a plastic or a polymer such as polyester, nylon or rayon, or a combination thereof. In various configurations, the non-porous material can be, without limitation, a plastic such as polypropylene, polyethylene terephthalate (PET, HDPE, LDPE), acrylonitrile butadiene styrene, polyvinyl chloride; polycarbonate, nylon or a combination thereof.

In various configurations, an apparatus of the present teachings can further comprise a chair comprising a porous or meshed back, whereby a fan assembly can be positioned to direct airflow through the porous or meshed back when a fan is in operation. In some configurations, the porous or meshed back can comprise a porous material such as, for example, TEXTILINE® Wicker Weave (PATIO PRODUCTS, INC®, Boca Raton, Fla.). In various configurations, the plenum can be attached to the porous or meshed back by an attachment or attachment means such as, without limitation, stitching, hook and loop fastener (VELCRO®), one or more snaps, one or more slide fasteners (zippers), one or more hooks configured to hold the plenum against the porous or meshed back by gravity, or a combination thereof. In some configurations, a plenum of the present teachings can be reversibly attached to the porous back by a reversible attachment or a reversible attachment means such as, for example and without limitation, one or more hook and loop fasteners, one or more snaps, one or more slide fasteners (zippers), one or more hooks, or a combination thereof.

In various configurations, an apparatus of the present teachings can further comprise an electric power source such as at least one battery. In some configurations, a battery can be a lithium ion batter). In various configurations, a battery can be a rechargeable battery. In various configurations, a battery can be a 12 V battery. In various configurations, a battery can be, for example, a 6 VDC battery, a 12 VDC battery an 18 VDC battery, or a 24 VDC battery. In various configurations, a battery can have an energy capacity of, for example and without limitation. 100-10,000 milliamp hours (mAh). In various configurations, a battery can have an energy storage capacity of, for example and without limitation, 3,000 mAh, 4,000 mAh, 5,000 mAh, 6000 mAh, 7,000 mAh, 8,000 mAh, 9,000 mAh or 10,000 mAh.

In some embodiments, the present teachings include a chair comprising a chair back comprising a porous material that allows air flow or a mesh that allows air flow; and a non-porous fan plenum attached to the chair back. In various configurations, a fan plenum supports at least one fan assembly, at least two fan assemblies, or at least three fan assemblies. In various configurations, each fan assembly 30 (FIG. 4) can comprise a fan guard 2 (FIG. 4, FIG. 5) which comprises a frame 50 (FIG. 5) having protrusions 23 (FIG. 5), 25 (FIG. 5) ending in clips 231 (FIG. 5), 251 (FIG. 5), and a fan 21 (FIG. 6). In some configurations, one set of clips can be oriented towards the outside of the frame, and a second set of clips can be oriented towards the inside of the frame. In some configurations, some clips can be configured to receive a fan 21 (FIG. 6); these clips can be used to reversibly attach a fan to a fan guard.

In some configurations, each fan assembly can comprise a fan mounted within a fan plenum 10 (FIG. 7), 31 (FIG. 8), 101 (FIG. 9), 102 (FIG. 10), 103 (FIG. 11). In various configurations, each fan can be positioned to d reel airflow (i.e., blow air) through the back of the chair when in operation. In various configurations, each fan assembly can comprise a fan mounted within the elongated fan plenum. In some configurations, each fan assembly can comprise a fan from 40 mm in length and width to 220 mm in length and width. In some configurations, a fan assembly can comprise a fan 92 mm in width and length (a "92 mm fan"). In various configurations, each fan assembly can comprise a fan 120 mm in width and length (a "120 mm fan").

In various configurations, a fan assembly can comprise a fan having, in operation, a volumetric air flow of 30 to 100 cubic feet per minute. In some configurations, a fan assembly can comprise a fan having a volumetric air flow of 75 cubic feet per minute.

In various configurations, the fan assemblies can comprise fans which are wired in parallel. In various configurations, the wiring can include an On-Off switch.

In various configurations, the plenum can comprise canvas.

In various configurations, the plenum can be attached to the back of a chair by an attachment means selected from the group consisting of sewing, hook and loop fasteners, a slide fastener (zipper), and a combination thereof. In some configurations, the plenum can be suspended from and held against the back of a chair by one or more hooks, by one or more clamps, or by a combination thereof.

In various configurations, a plenum can be reversibly attached to a chair by an attachment or an attachment means such as, without limitation, a slide fastener (zipper) a hook and loop fastener (VELCRO®), one or more buttons buttonholes or a combination thereof. In various configurations, a plenum can be reversibly attached to a chair in a configuration that allows access to the fans, e.g., for repair, cleaning or maintenance.

In various configurations, a chair of the present teachings can further comprise a power source. The power source can be any power source that can provide direct current electricity, such as, without limitation, a power supply that can convert 120V or 220V alternating current ("wall current") to direct current; a solar cell; or a battery. In various configurations, a source of DC power can be, for example and without limitation, one or more rechargeable batteries such as one or more lithium ion batteries. In various configurations, a source of DC power can be one or more single use ("disposable") batteries. In various configurations, a battery can be, for example and without limitation, a standard size C or D battery. In various configurations, a battery can be, without limitation, an alkaline battery, a carbon-zinc battery, a lithium ion battery, a NiMH battery, or a NiCd battery In various configurations, a battery can have a voltage output of, for example and without limitation, 1.2 VDC, 1.5 VDC, 6 VDC, 9 VDC, 12 VDC or 20 VDC. In various configurations, a battery can have a capacity of 1,000-10,000 milliamp-hours. In various configurations, a battery can be a 6000 milliamp-hour battery or a 3000 milliamp-hour battery.

In various configurations, a chair in accordance with the present teachings can further comprise a battery support, for example, a pouch or pocket that can attach to, or be a part of, a chair.

In various configurations, a chair of the present teaching can be an outdoor chair, i.e., a chair configured for use out-of-doors. In various configurations, the chair can be, for example, a lawn chair, a camp chair, a folding chair, a wicker chair, a patio chair, a porch chair, a deck chair, a beach chair, an acapulco chair, an adirondack chair, a butterfly chair, a director's chair, a glider, a lifeguard chair, a sedan chair, a stroller, a power chair, a rocking chair, a stacking chair, a sweetheart chair, a wheelchair, a lounge chair, a reclining chair, or a quad-chair.

In various configurations, the present teachings disclose, without limitation, the following aspects:

In some aspects, the present teachings include a chair comprising a chair back, wherein the chair back comprises a porous material; an electric power source; and an elongated fan plenum comprising a long axis disposed substantially vertically upon the chair back, wherein the elongated fan plenum comprises a non-porous material and two or more fan assemblies, each fan assembly comprising a fan, wherein each fan is configured to direct air flow through the chair back, and wherein the chair back is taller than that of the chair shown in Walmart catalog #564462126.

In some aspects, the present teachings include an elongated fan plenum comprising a long axis; two or more fan assemblies, each fan assembly comprising a fan; an electric power source, and means for reversibly attaching the elongated fan plenum to a chair back comprising a mesh that allows air flow, wherein each fan is configured to blow air perpendicular to the long axis of the plenum, whereby each fan is configured to direct air flow through a chair back when the plenum is attached to the chair back, and wherein the plenum comprises a non-porous material.

In various aspects, the porous material can be selected from the group consisting of wicker, a nylon mesh, a polyester mesh, a vinyl-coated polyester mesh (PVC mesh), a metal mesh, and a combination thereof. In some aspects, the porous material can be a PVC mesh. In various aspects, the non-porous material can be selected from the group consisting of canvas, woven cotton, metal, plastic, and a combination thereof. In some aspects, the non-porous material can be canvas. In various aspects, an elongated fan plenum can have a cross-sectional area of no more than 0.08 $ft^2$. In various aspects, the electric power source can be a direct current source, such as, for example, at least one battery or at least one solar cell. In some aspects, the at least one battery can be a rechargeable battery. In some aspects, the at least one battery can be a 12 VDC battery. In some aspects, the at least one battery can be a lithium ion battery. In some aspects, the at least one battery can be a NiCd battery. In some aspects, the at least one battery can be an alkaline battery. In some aspects, the electric power source can be an alternating current source. In various aspects, each fan can have a volumetric flow rate of from 30 to 200 cubic feet per minute. In some aspects, each fan can have a volumetric flow rate of from 50 to 150 cubic feet per minute. In some aspects, each fan can have a volumetric flow rate of from 70 to 120 cubic feet per minute. In some aspects, each fan can have a volumetric flow rate of 75 to 100 cubic feet per minute. In some aspects, each fan can have a volumetric flow rate of 75 cubic feet per minute. In various aspects, each fan assembly can further comprise a fan guard.

In various aspects, an elongated fan plenum of the present teachings can include means for reversibly attaching the plenum to a chair back, and such means can include, without limitation, one or more hook and loop fasteners, one or more snaps, one or more slide fasteners, one or more hooks, or a combination thereof. In various aspects, the means for reversibly attaching the plenum to a chair back can comprise one or more hooks.

In various aspects, the present teachings include a kits. A kit of the present teachings can include, without limitation, any or all of the following components: an elongated fan plenum, one or more fan guards, one or more fans, a battery pouch, a battery (including a battery pack).

DETAILED DESCRIPTION

Figure 1:
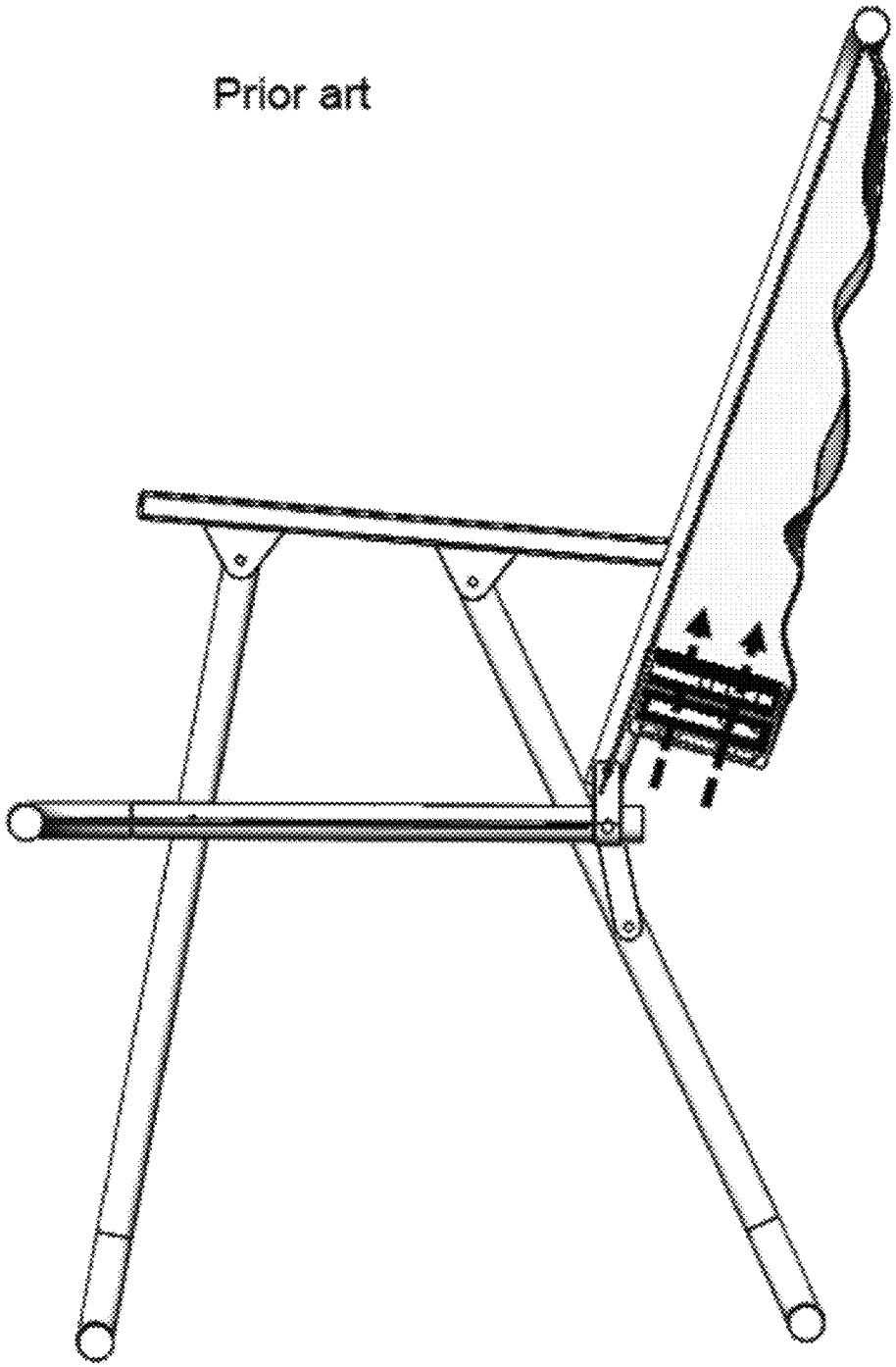
FIG. 1 depicts the fan-equipped chair disclosed in U.S. Pat. No. 8,801,091, in which arrows indicate direction of air flow.

In some embodiments, an apparatus of the present teachings comprises at least two fan assemblies mounted in an elongated fan plenum, each fan assembly comprising a fan. The fan assemblies can be configured for the fans to blow air perpendicular to the long axis of the fan plenum. An apparatus can comprise two, three or more fans. In various configurations, each fan can have, in operation, a volumetric flow rating of 30-200 cubic feet per minute. In various configurations, the fans can be wired in parallel to a power source. In some configurations, a fan assembly can comprise a fan, a fan guard, and a retainer that secures the fan guard to the fan. In some configurations, the fan guard can comprise a frame. In some configurations, the frame can comprise one or more clips that can be oriented towards the outside of the frame. In some configurations, the frame can comprise clips that can be oriented towards the inside of the frame. In some configurations, a clip oriented towards the outside of the frame can receive a retainer that secures the length and width of the fan to the frame. In some configurations, a clip oriented towards the inside of the frame can receive the fan.

System Components

Elongated Fan Plenum

In various configurations, an elongated fan plenum of the present teachings can be made of any non-porous or airtight material, such as, but without limitation, canvas, woven cotton, metal, or a plastic such as, without limitation, vinyl, rayon, or polyester. The elongated fan plenum can have openings configured for accepting the fans or fan assemblies. An opening configured for accepting a fan can have any convenient shape, such as, without limitation, a square, a rectangle, a circle, or an oval. In some configurations, an elongated fan plenum can have one or more panels that can attach the elongated fan plenum to a chair.

In various configurations, an elongated fan plenum of the present teachings can be attached to a chair by various attachments or attachment means such as, for example and without limitation, stitching, glue, one or more snaps, hook and loop fasteners (such as, for example. VELCRO® (Velcro Industries B.V., Castorweg, Hengelo, Netherlands)), adhesives, heat molding, sliding fasteners (zippers) or a combination thereof. In some configurations, an elongated fan plenum can include one or more hooks configured for suspending the apparatus from the back of a chair. In some configurations, an elongated fan plenum can include one or more clamps configured for suspending the apparatus from the back of a chair.

Fans

As used herein, a fan is a mechanical device that directs air flow. There are commercially available fans that can be used in an apparatus of the present teachings, such as, for example and without limitation, propeller fans commonly used for cooling computers or other electronics. In various configurations, a propeller fan of an apparatus of the present teachings can range in length and width, without limitation, from 20 mm×20 mm to 220 mm×220 mm. A fan of an apparatus of the present teachings can have length and width dimensions of, for example and without limitation, from 25 mm×25 mm to 220 mm×220 mm. A fan of an apparatus of the present teachings can have length and width dimensions of, for example and without limitation, 20 mm×20 mm, 21 mm×21 mm, 22 m×22 mm, 23 mm×23 mm, 24 mm×24 mm, 25 mm×25 mm, 26 mm×26 mm, 27 mm×27 mm, 28 mm×28 mm, 29 mm×29 mm, 30 mm×30 mm, 51 mm×31 mm, 32 mm×32 mm, 33 mm×33 mm, 34 mm×34 mm, 35 mm×35 mm, 36 mm×36 mm, 37 mm×37 mm, 38 mm×38 mm, 39 mm×39 mm, 40 mm×40 mm, 41 mm×41 mm, 42 mm×42 mm, 43 mm×43 mm, 44 mm×44 mm, 45 mm×45 mm, 46 mm×46 mm, 47 mm×47 mm, 48 mm×48 mm, 49 mm×49 mm, 50 mm×50 mm, 51 mm×51 mm, 52 mm×52 mm, 53 mm×53 mm, 54 mm×54 mm, 55 mm×55 mm, 56 mm×56 mm, 57 mm×57 mm, 58 mm×58 mm, 59 mm×59 mm, 60 mm×60 mm, 61 mm×61 mm, 62 mm×62 mm, 63 mm×63 mm, 64 mm×64 mm, 65 mm×65 mm, 66 mm×66 mm, 67 mm×67 mm, 68 mm×68 mm, 69 mm×69 mm, 70 mm×70 mm, 71 mm×71 mm, 72 mm×72 mm, 73 mm×73 mm, 74 mm×74 mm, 75 mm×75 mm, 76 mm×76 mm, 77 mm×77 mm, 78 mm×78 mm, 79 mm×79 mm, 80 mm×80 mm, 81 mm×81 mm, 82 mm×82 mm, 83 mm×83 mm, 84 mm×84 mm, 85 mm×85 mm, 86 mm×86 mm, 87 mm×87 mm, 88 mm×88 mm, 89 mm×89 mm, 90 mm×90 mm, 91 mm×91 mm, 92 mm×92 mm, 93 mm×93 mm, 94 mm×94 mm, 95 mm×95 mm, 96 mm×96 mm, 97 mm×97 mm, 98 mm×98 mm, 99 mm×99 mm, 100 mm×100 mm, 101 mm×101 mm, 102 mm×102 mm, 103 mm×103 mm, 104 mm×104 mm, 105 mm×105 mm, 106 mm×106 mm, 107 mm×107 mm, 108 mm×108 mm, 109 mm×109 mm, 110 mm×110 mm, 111 mm×111 mm, 112 mm×112 mm, 113 mm×113 mm, 114 mm×114 mm, 115 mm×115 mm, 116 mm×116 mm, 117 mm×117 mm, 118 mm×118 mm, 119 mm×119 mm, 120 mm×120 mm, 121 mm×121 mm, 122 mm×122 mm, 123 mm×123 mm, 124 mm×124 mm, 125 mm×125 mm, 126 mm×126 mm, 127 mm×127 mm, 128 mm×128 mm, 129 mm×129 mm, 130 mm×130 mm, 131 mm×131 mm, 132 mm×132 mm, 133 mm×133 mm, 134 mm×134 mm, 135 mm×135 mm, 136 mm×136 mm, 137 mm×137 mm, 138 mm×138 mm, 139 mm×139 mm, 140 mm×140 mm, 141 mm×141 mm, 142 mm×142 mm, 143 mm×143 mm, 144 mm×144 mm, 145 mm×145 mm, 146 mm×146 mm, 147 mm×147 mm, 148 mm×148 mm, 149 mm×149 mm, 150 mm×150 mm, 151 mm×151 mm, 152 mm×152 mm, 153 mm×153 mm, 154 mm×154 mm, 155 mm×155 mm, 156 mm×156 mm, 157 mm×157 mm, 158 mm×158 mm, 159 mm×159 mm, 160 mm×160 mm, 161 mm×161 mm, 162 mm×162 mm, 163 mm×163 mm, 164 mm×164 mm, 165 mm×165 mm, 166 mm×166 mm, 167 mm×167 mm, 168 mm×168 nm 169 mm×169 mm, 170 mm×170 mm, 171 mm×171 mm, 172 mm×172 mm, 173 mm×173 mm, 174 mm×174 mm, 175 mm×175 mm, 176 mm×176 mm, 177 mm×177 mm, 178 mm×178 mm, 179 mm×179 mm, 180 mm×180 mm, 181 mm×181 mm, 182 mm×182 mm, 183 mm×183 mm, 184 mm×184 mm, 185 mm×185 mm, 186 mm×186 mm, 187 mm×187 mm, 188 mm×188 mm, 189 mm×189 mm, 190 mm×190 mm, 191 mm×191 mm, 192 mm×192 mm, 193 mm×193 mm, 194 mm×194 mm, 195 mm×195 mm, 196 mm×196 mm, 197 mm×197 mm, 198 mm×198 mm, 199 mm×199 mm, 200 mm×200 mm, 201 mm×201 mm, 202 mm×202 mm, 203 mm×203 mm, 204 mm×204 mm, 205 mm×205 mm, 206 mm×206 mm, 207 mm×207 mm, 208 mm×208 mm, 209 mm×209 mm, 210 mm×210 mm, 211 mm×211 mm, 212 mm×212 mm, 213 mm×213 mm, 214 mm×214 mm, 215 mm×215 mm, 216 mm×216 mm, 217 mm×217 mm, 218 mm×218 mm, 219 mm×219 mm or 220 mm×220 mm. In various embodiments, a fan comprising an apparatus of the present teachings can have a thickness (depth) of from 10 mm up to 32 mm. In various configurations, a fan can have a depth of 10 mm, 11 mm, 12 mm, 13 mm, 14 mm, 15 mm, 16 mm, 17 mm, 18 mm, 19 mm, 20 mm, 21 mm, 22 mm, 23 mm, 24 mm, 25 mm, 26 mm, 27 mm, 28 mm, 29 mm, 30 mm, 31 mm, or 32 mm.

In various configurations, a propeller fan comprising an apparatus of the present teachings can, in operation, have a capacity (volumetric flow rate) of displacing 30 to 200 cubic feet per minute (cfm). In some configurations, a fan of the present teachings can displace 30 cfm, 31 cfm, 32 cfm, 33 cfm, 34 cfm, 35 cfm, 36 cfm, 37 cfm, 38 cfm, 39 cfm, 40 cfm, 41 cfm, 42 cfm, 43 cfm, 44 cfm, 45 cfm, 46 cfm, 47 cfm, 48 cfm, 49 cfm, 50 cfm, 51 cfm, 52 cfm, 53 cfm, 54 cfm, 55 cfm, 56 cfm, 57 cfm, 58 cfm, 59 cfm, 60 cfm, 61 cfm, 62 cfm, 63 cfm, 64 cfm, 65 cfm, 66 cfm, 67 cfm, 68 cfm, 69 cfm, 70 cfm, 71 cfm, 72 cfm, 73 cfm, 74 cfm, 75 cfm, 76 cfm, 77 cfm, 78 cfm, 79 cfm, 80 cfm, 81 cfm, 82 cfm, 83 cfm, 84 cfm, 85 cfm, 86 cfm, 87 cfm, 88 cfm, 89 cfm, 90 cfm, 91 cfm, 92 cfm, 93 cfm, 94 cfm, 95 cfm, 96 cfm, 97 cfm, 98 cfm, 99 cfm, 100 cfm, 101 cfm, 102 cfm, 103 cfm, 104 cfm, 105 cfm, 106 cfm, 107 cfm, 108 cfm, 109 cfm, 110 cfm, 111 cfm, 112 cfm, 113 cfm, 114 cfm, 115 cfm, 116 cfm, 117 cfm, 118 cfm, 119 cfm, 120 cfm, 121 cfm, 122 cfm, 123 cfm, 124 cfm, 125 cfm, 126 cfm, 127 cfm, 128 cfm, 129 cfm, 130 cfm, 131 cfm, 132 cfm, 133 cfm, 134 cfm, 135 cfm, 136 cfm, 137 cfm, 138 cfm, 139 cfm, 140 cfm, 141 cfm, 142 elm, 143 cfm, 144 cfm, 145 cfm, 146 cfm, 147 cfm, 148 cfm, 149 cfm, 150 cfm, 160 cfm, 161 cfm, 162 cfm, 163 cfm, 164 cfm, 165 elm, 166 cfm, 167 cfm, 168 cfm, 169 cfm, 170 cfm, 171 cfm, 172 cfm, 173 cfm, 174 cfm, 175 cfm, 176cfm, 177 cfm, 178 cfm, 179 cfm, 180 cfm, 181 cfm, 182 cfm, 183 cfm, 184 cfm, 185 cfm, 186 cfm, 187 cfm, 188 cfm, 189 cfm, 190 cfm, 191 cfm, 192 cfm, 193 cfm, 194 cfm, 195 cfm, 196 cfm, 197 cfm, 198 cfm, 199 cfm, or 200 cfm.

Fan Assembly

Figure 5:
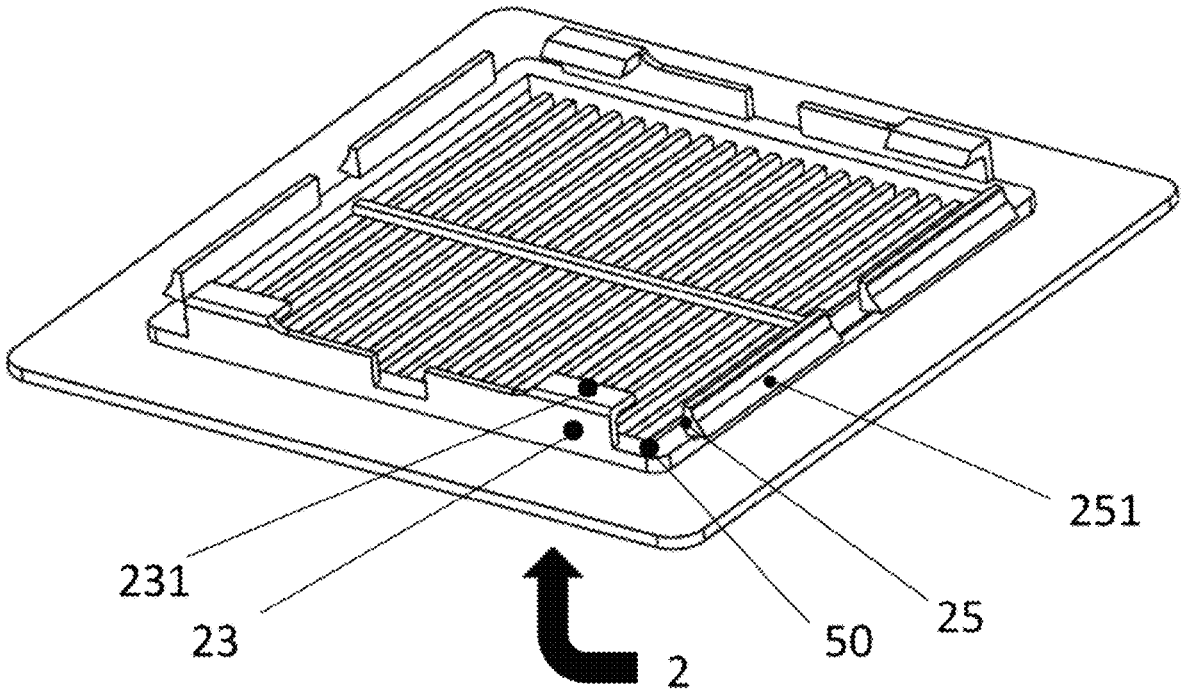
FIG. 5 illustrates a fan guard of the present teachings.
Figure 6:
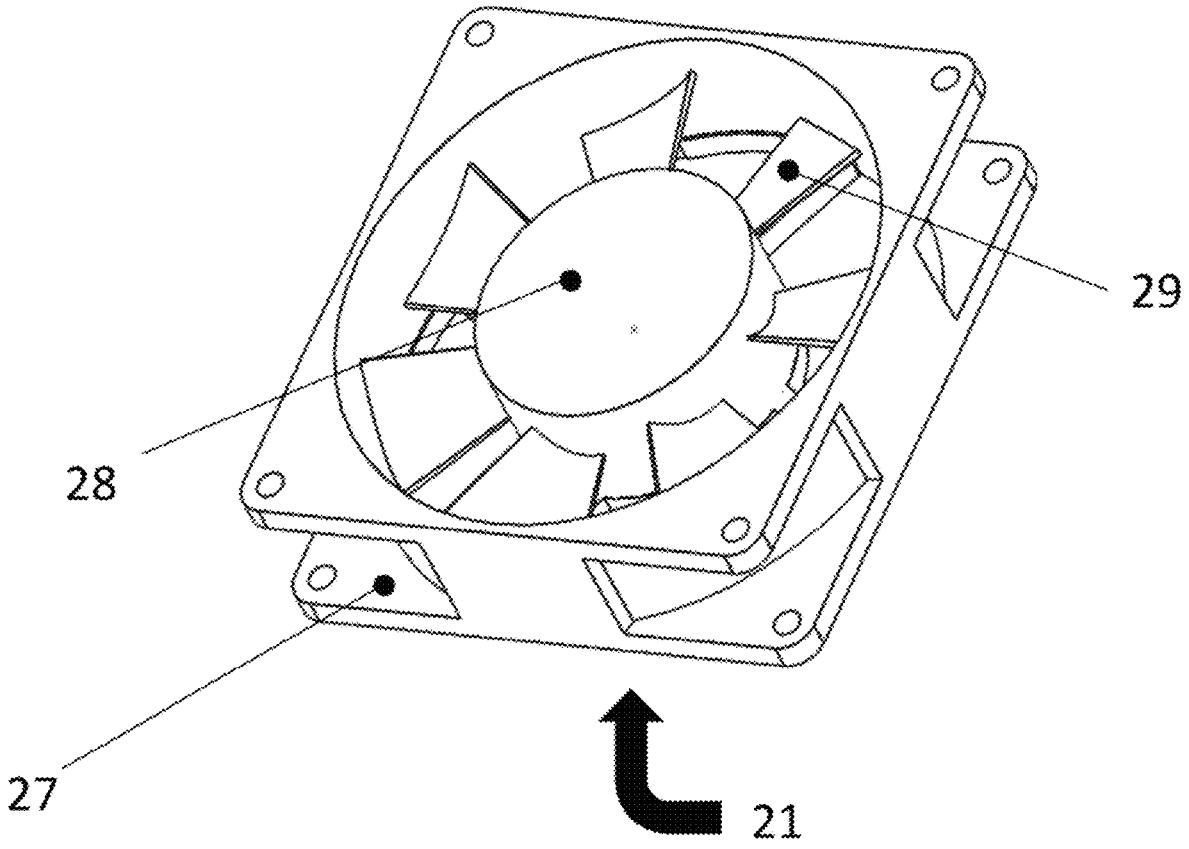
FIG. 6 illustrates a fan of the present teachings.

In some embodiments, a fan assembly 30 (FIG. 4) of an apparatus of the present teachings can comprise a fan guard 2 (FIG. 5) which comprises a frame 50 (FIG. 5) having protrusions 23 (FIG. 5) and 25 (FIG. 5) ending in clips 251 (FIG. 5) and 231 (FIG. 5), and a fan 21 (FIG. 6). In some configurations, a first set of clips 251 (FIG. 5) can be oriented towards the outside of the frame 50 (FIG. 5), and a second set of clips 231 (FIG. 5) can be oriented towards the inside of the frame 50 (FIG. 5). In some configurations, clips 231 (FIG. 5) can be used to reversibly attach a fan 21 (FIG. 6) to a fan guard 2 (FIG. 5).

Skilled artisans will recognize there are many other ways to configure a fan with like results.

Power Source

A fan that can be used in an apparatus of the present teachings can be powered by a wide variety of power sources, such as, without limitation, a standard AC power outlet (120V or 220V), a solar panel, or a battery. In various configurations a battery can be a rechargeable battery or a single use (disposable) battery. A battery can have an EXT voltage output of 1 V, 1.5V, 2 V, 3 V, 4 V, 5 V, 6 V, 7 V, 8 V, 9 V, 10 V, 11 V, 12 V, 13 V, 14 V, 15 V, 16 V, 17 V, 18 V, 19 V, or 20 V. A battery can be a 1,000-10,000 milliamp hour battery. In some configurations a battery can have a capacity of 3000 milliamp hours (i.e., can provide power for 3 hours to a device drawing 1 ampere) or 6000 milliamp hours. A battery that can be used in a device of the present teachings can have a capacity of, for example, 1,000 milliamp hour, 1,250 milliamp hour, 1,500 milliamp hour, 1,750 milliamp hour, 2,000 milliamp hour, 2,250 milliamp hour, 2,500 milliamp hour, 2,750 milliamp hour, 3,000 milliamp hour, 3,250 milliamp hour, 3.500 milliamp hour, 3,750 milliamp hour, 4,000 milliamp hour, 4,250 milliamp hour, 4.500 milliamp hour, 4,750 milliamp hour, 5.000 milliamp hour, 5.250 milliamp hour, 5,500 milliamp hour, 5,750 milliamp hour, 6,000 milliamp hour, 6,250 milliamp hour, 6,500 milliamp hour, 6,750 milliamp hour, 7,000 milliamp hour, 7,250 milliamp hour, 7,500 milliamp hour, 7,750 milliamp hour, 8.000 milliamp hour, 8.250 milliamp hour, 8,500 milliamp hour, 8,750 milliamp hour, 9,000 milliamp hour, 9,250 milliamp hour, 9,500 milliamp hour, 9.750 milliamp hour, or 10,000 milliamp hour batteries. A "battery," as used herein, can include multiple batteries connected in series to achieve a desired voltage output.

Chair

In some embodiments, an apparatus of the present teachings can include a chair having a porous back rest. A porous back rest, as used herein, includes a back rest that admits air flow. A porous back rest can comprise any material that provides channels for air flow. Non-limiting examples of materials comprising a back rest of a chair of the present teachings can include a porous material or mesh, such as, for example, wicker; a plastic mesh such as nylon mesh, polyester mesh, vinyl-coated polyester mesh (PVC mesh), a metal mesh, or any combination thereof. In some configurations, a back rest of a chair of the present teachings can comprise a porous fabric such as, for example, TEXTILINE® Wicker Weave fabric (manufactured by Twitchell Holding Company (Dothan, Ala.) and supplied by Patio Products, Inc. (Boca Raton, Fla.)). In various configurations a porous back test can be secured on a chair frame by a securing means, such as, without limitation, sewing, hook-and-loop fasteners (VELCRO®), one or more snaps, one or more zippers, or a combination thereof. In some configurations, the securing means can include VELCRO® strips such as 1-inch wide or 2-inch wide VELCRO® strips. In some configurations, a chair of the present teachings can further include a headrest, such as, for example, a rolled foam headrest.

Some non-limiting examples of a chair to which an elongated fan plenum of the present teachings can be attached include: a lawn chair, a camp chair, a folding chair, a wicker chair, a patio chair, a porch chair, a deck chair, a beach chair, an acapulco chair, an adirondack chair, a butterfly chair, a director's chair, a glider, a lifeguard chair, a sedan chair, a stroller, a power chair, a rocking chair, a stacking chair, a sweetheart chair, a wheelchair, a lounge chair, a reclining chair, and a quad-chair.

There are several differences between a chair of the present teachings and the chair described in Walmart catalog#564462126.

1) Because the Walmart chair has a larger cross-sectional area of the "Support" than a chair of the present teachings, airflow velocity is expected to be less for a given fan speed, resulting in less evaporative cooling.

The Fan Cooled Chair provides cooling to the occupant by primarily two principles, convective heal transfer and evaporative cooling.

Evaporative cooling is due to the phase change of liquid water (occupant's sweat) to water vapor. The latent heat of vaporization of water ($h_e$) is 2256 kJ/kg water which means that for every gram of sweat evaporated from the occupant, 2256 joules of heal arc removed from the occupant, thus providing cooling to the occupant. The rate of evaporative cooling is governed by several factors, one of which is the airflow velocity. The rate of evaporation slows if stagnate air becomes saturated at the occupant's back.

Figure 2:
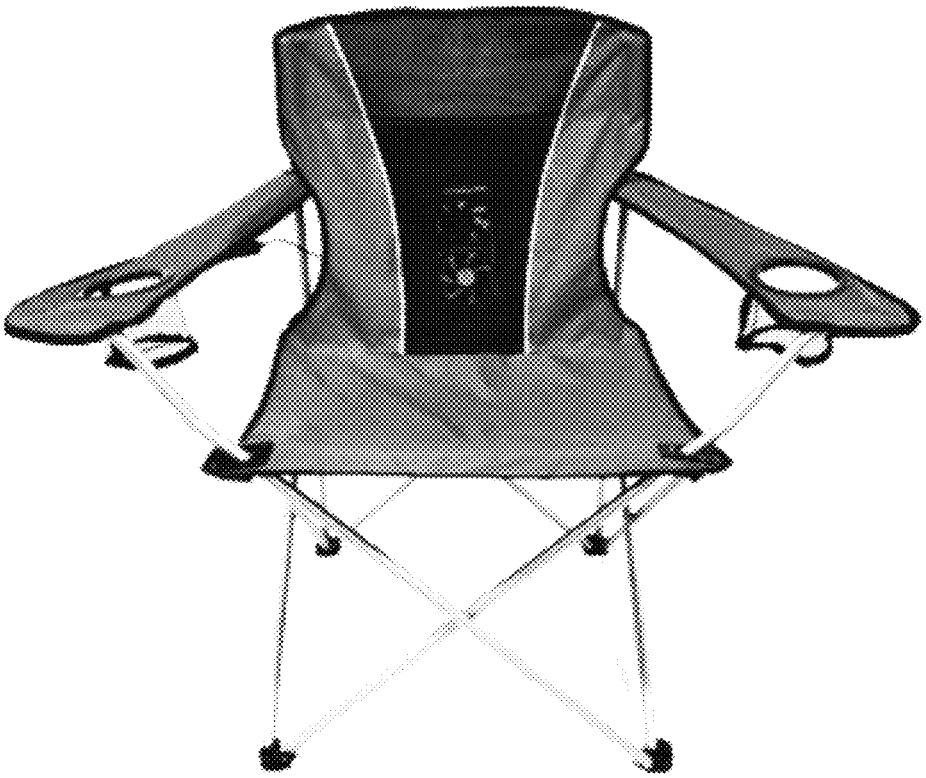
FIG. 2 depicts a frontal view of a fan-equipped chair disclosed as Walmart catalog product #564462126.
Figure 31:
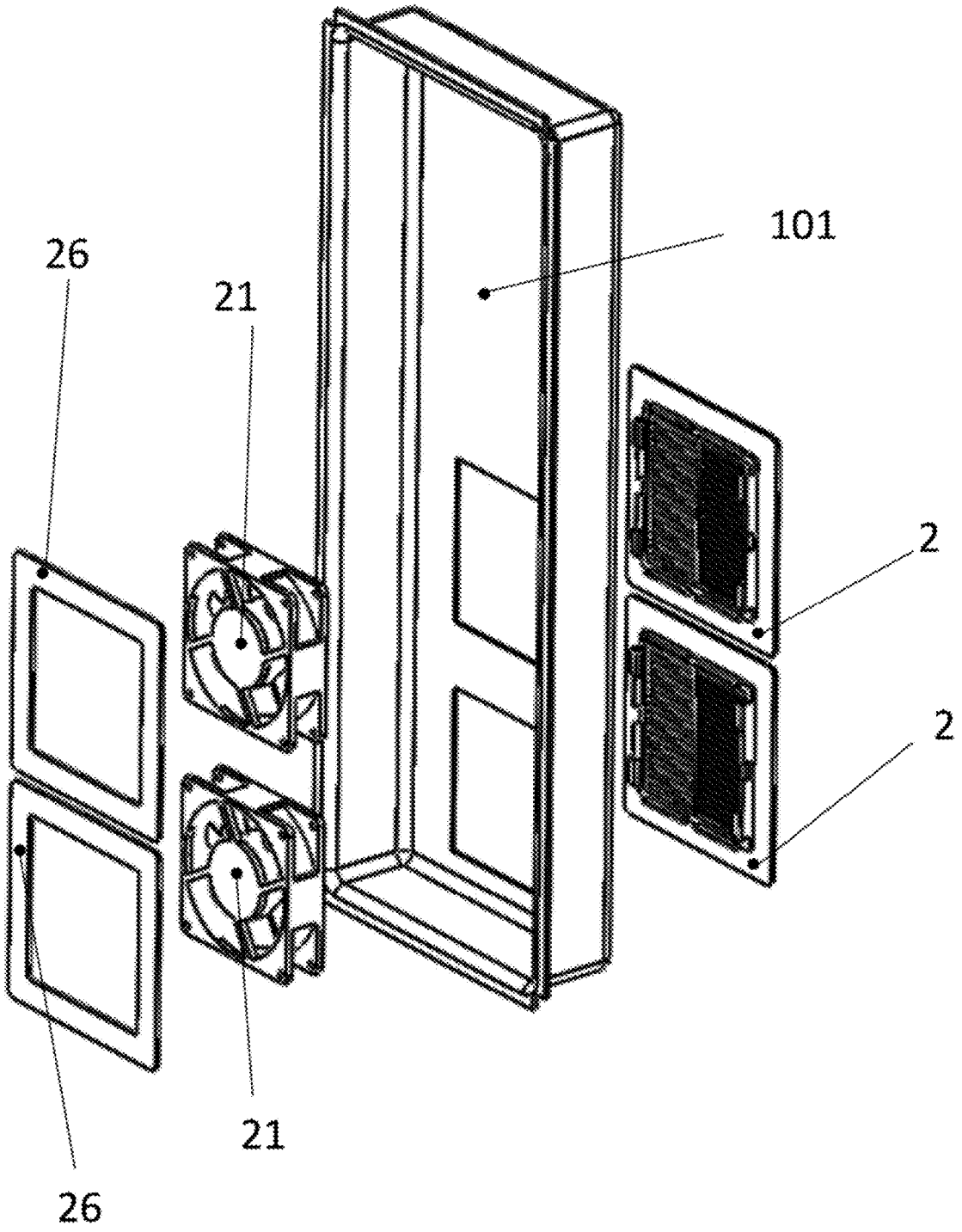
FIG. 31 illustrates an exploded view of a rectangular elongated fan plenum comprising two fans of the present teachings.

To maintain an increased rate of evaporation and thus effective cooling, air with a higher water content must be removed quickly and replaced by dryer air. The quick exchange of air can be facilitated by high airflow velocities in the elongated fan plenum. The high airflow con be achieved in a chair of the present teachings by reducing the cross-sectional area of the elongated fan plenum in comparison to a fan support in the Walmart chair. In various configurations, the cross-sectional area of an elongated fan plenum of the present teachings can be 0.08 $ft^2$ while that of the fan support of the Walmart chair (FIG. 2, FIG. 31 appears to be much larger. That, combined with the 12 VDC Li-ion batteries that can power a fan of a chair of the present teachings compared to the power available from the two AA batteries (3 VDC total) in the Walmart chair indicates substantially increased cooling effectiveness of a chair of the present teachings in comparison to the Walmart chair. The lower voltage of the Walmart chair batteries also makes the airflow velocity in the Walmart chair comparatively low and cooling by evaporation less effective compared to a chair of the present teachings.

2) Airflow Velocity of a chair of the present teachings (3 fans): (75 $ft^3$/min fan) (0.08 $ft^2$)=2813 ft/s=14.3 m/s. Because the Walmart chair has a larger cross-sectional area of a fan support compared to an elongated fan plenum, airflow velocity is expected to be less, resulting in less convective cooling.

As previously stated, the Fan Cooled Chair provides cooling to the occupant by primarily two methods, convective heat transfer and evaporative cooling. Convective cooling, otherwise known as Newton's Law of Cooling is given by:

$$q=h\Delta T$$

with regard to a chair of the present teachings:
q=is the heat flux removed from the occupants back ($W.m^{-2}$)
h=is the convective heat transfer coefficient ($W.m^{-2}.K^{-1}$)
ΔT=is the temperature difference between the occupants back and free stream air temperature (K).

Figure 53:
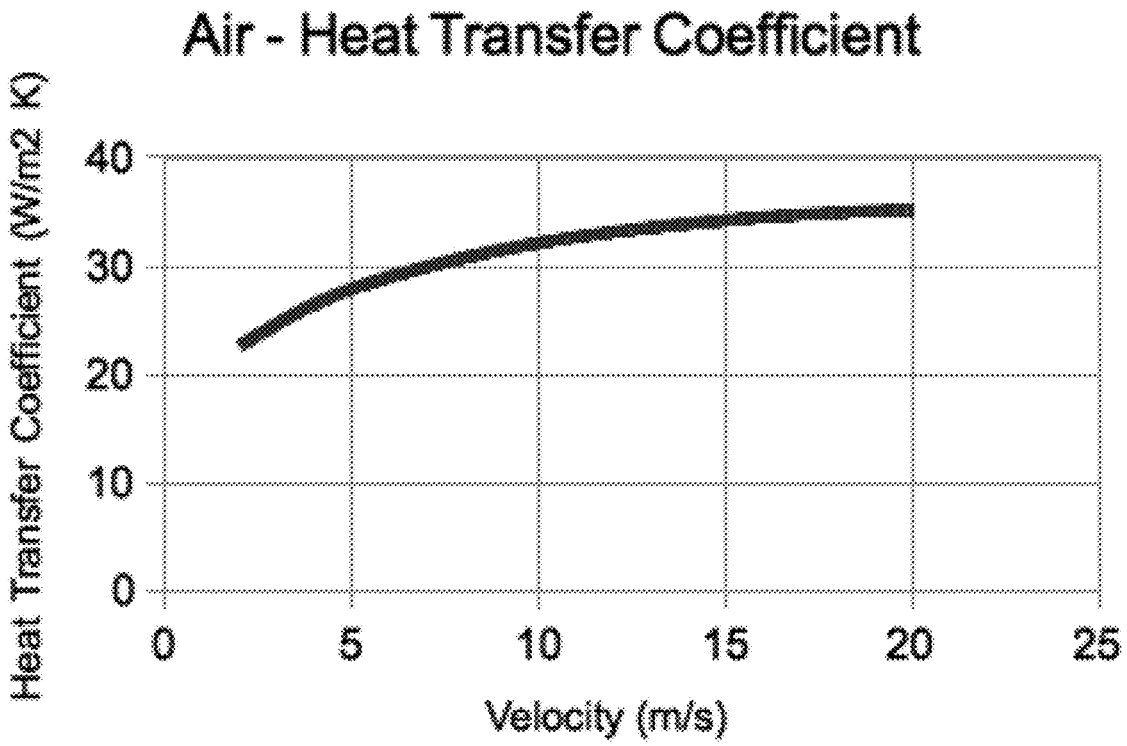
FIG. 53 illustrates Air-Heat Transfer Coefficient.

In this application, with regard to a chair of the present teachings, the value of h is driven by airflow velocity and can be approximated by:

$$h_e=10.45-v+10v^{1/2*}$$

where v=the airflow velocity. This empirical equation can be used for velocities 2 to 20 m/s, and can be graphed as shown in FIG. 53.

Engineering ToolBox, (2003).
Airflow Velocity of a chair of the present teachings=(3 fans )(75 $ft^3$/min/fan) (0.08 $ft^2$)=2813 ft/s=14.3 m/s
With:

$$v=14.3\text{ m/s},\ h_e=10.45-v+10v^{1/2*}$$

then h=34 $W.m^{-2}.K^{-1}$ for a chair of the present teachings.

Lower airflow velocities result in much lower values of h: with v=2 m/s then h=23 $W.m^{-2}.K^{-1}$. Again. Newton's Law of Cooling: q/hΔT. One can see for a given ΔT more conductive cooling can be achieved by increasing h. An increase of 48% in convective cooling can be achieved by increasing the airflow velocity from 2 to 14.3 m/s. This increase in airflow velocity and thus more convective cooling can be made possible by reducing the elongated fan support cross-sectional area. The larger cross-sectional area of the Walmart chair fan support reduces convective cooling, making the Walmart chair less effective in cooling.

3) Because the Walmart chair has a shorter "Support" compared to an elongated fan plenum of the present teachings, airflow will be mostly or completely blocked by the occupant, resulting in less no airflow velocity thus less no convective or evaporative cooling. As compared to the Walmart chair, a chair of the present teachings has a taller elongated fan plenum that is not blocked by the occupant.

Figure 3:
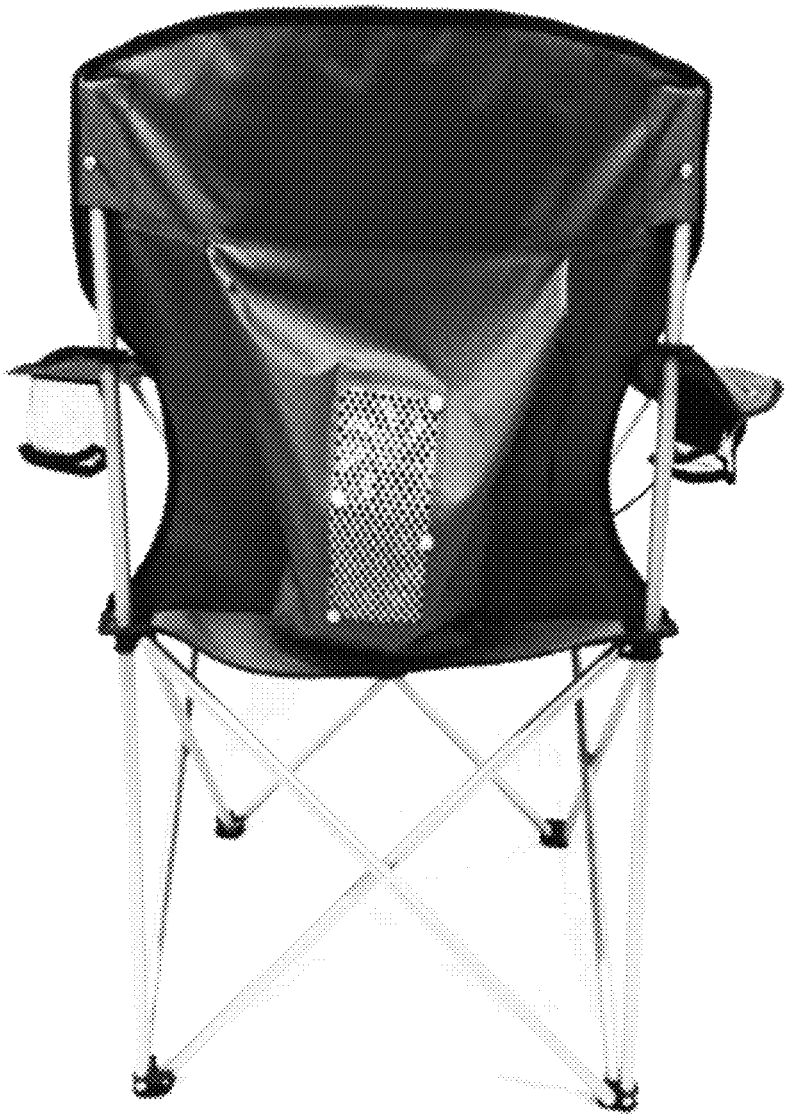
FIG. 3 depicts a rear view of a fan-equipped chair disclosed as Walmart catalog product π564462126.

From the photos (FIG. 2, FIG. 3), it appears that the height of the back of the Walmart chair is comparatively short as one would expect on a Quad chair. Also, the height of the "Support" docs not run the lull height of this already short back. If the opening is blocked to a point where there is no airflow in the Support, then there will be little or no evaporative cooling, and most or all heat removed from the occupant's hack will be by conductive heat transfer only.

Conductive heat transfer can be expressed by Fourier's Law:

$$q=(k/s)\Delta T$$

Where, in this instance:
q=is the heat flux removed from the occupants back ($W.m^{-2}$)
k=is the conductive heat transfer coefficient of air, 0.0262 $W.m^{-1}.K^{-1}$
s=the thickness of the air in the Support, approximately 0.13 m for the Walmart chair
ΔT=is the temperature difference between the occupant's back and air temperature (K)
Therefore: k/s=0.0262/0.13=0.20 $W.m^{-2}.K^{-1}$ Now one can see that a chair of the present teachings can be much more effective than the Walmart chair since:
A chair of the present teachings: h=34 $W.m^{-2}.K^{-1}$
A Walmart chair (with blocked airflow) h=0.20 $W.m^{-2}.K^{-1}$
If the Walmart chair Support becomes blocked by the occupant, the cooling rate would be 0.6% of the cooling rate of a chair of the present teachings, further reducing the cooling effectiveness of the Walmart chair.

4) Because the Walmart chair has a short Support, airflow is not directed onto the occupant's shoulders, neck and head. A chair of the present teachings can have a tall Support extending to the headrest. This can allow airflow to be directed to the occupant's shoulders, neck and head, and thus can provide an added cooling feature.

5) The clips on the Fan Guard in some embodiments allows one to attach a Fan to the Fan Guard and also attach the Fan Guard to the Support, without sewing or additional attachment hardware.

6) The Walmart chair is a quad chair which has a steel chair frame and thus would be 2-3 times heavier than an aluminum chair frame of the present teachings.

7) A chair of the present teachings can include a headrest such as a rolled foam headrest. The Walmart chair has no headrest.

EXAMPLES

The present teachings including descriptions provided in the Examples that are not intended to limit the scope of any claim or aspect. Unless specifically presented in the past tense, an example can be a prophetic or an actual example. The following non-limiting examples are provided to further illustrate the present teachings. Those of skill in the art, in light of the present disclosure, will appreciate that many changes can be made in the specific embodiments that are disclosed and still obtain a like or similar result without departing from the spirit and scope of the present teachings.

In investigations of cooling capabilities of chairs (Examples 12-18), all testing was conducted with the same fully charged battery, on the same day, at the same ambient air temperature.

Example 1

Figure 4:
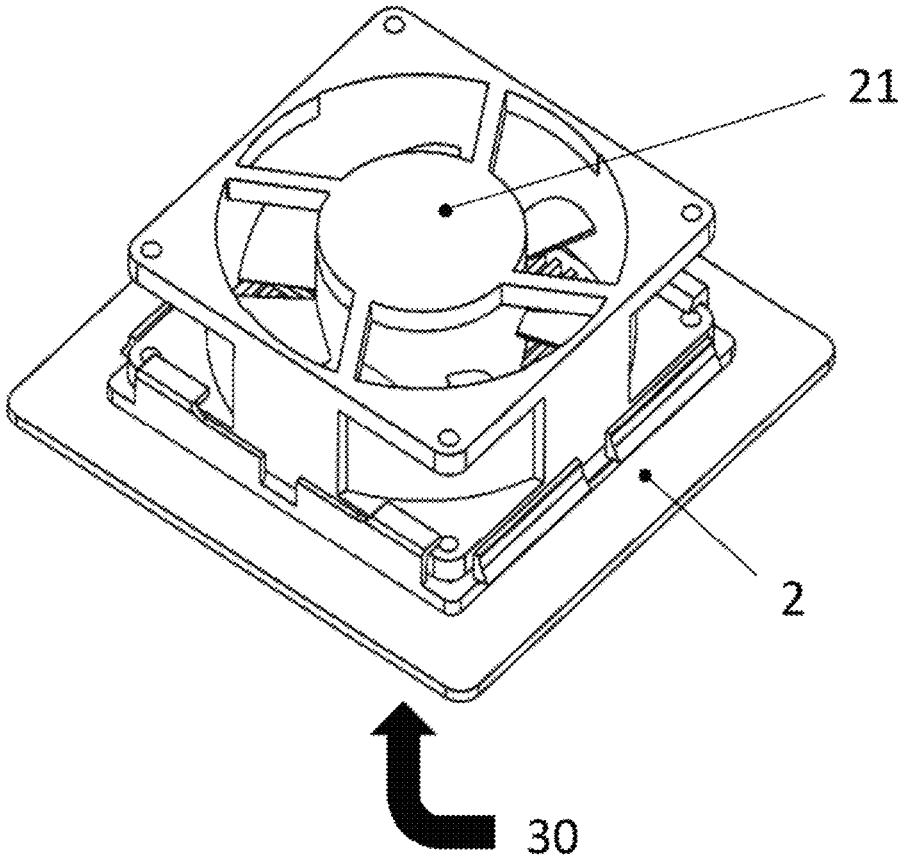
FIG. 4 illustrates a fan assembly of the present teachings.

This example illustrates a fan assembly 30 (FIG. 4).

Figure 8:
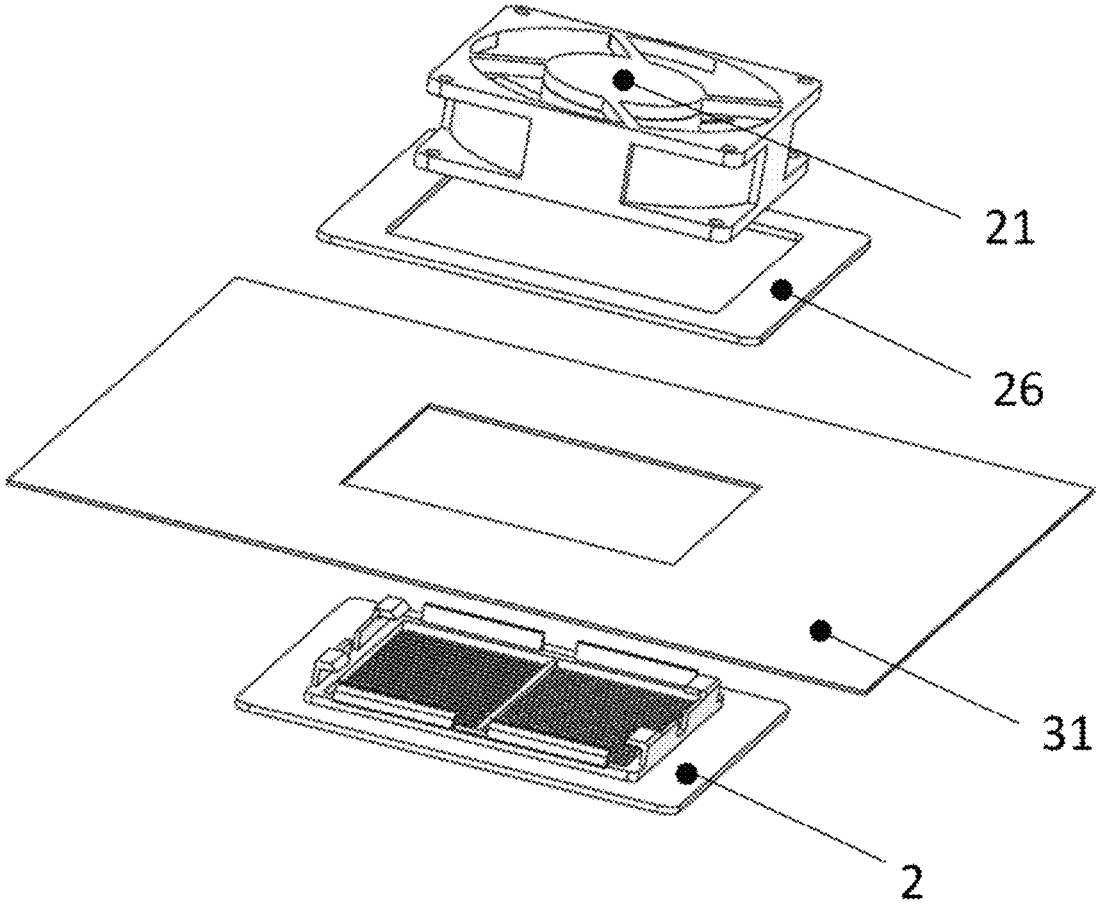
FIG. 8 illustrates an exploded view of components assembled on a support frame of the present teachings.
Figure 9:
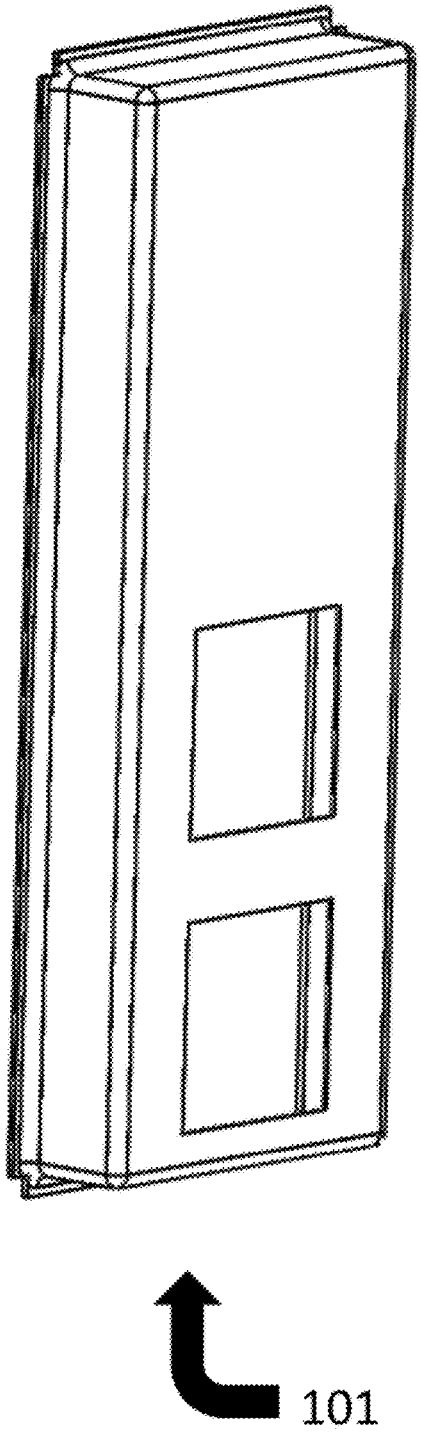
FIG. 9 illustrates an elongated fan plenum for a two-fan chair of the present teachings.
Figure 19:
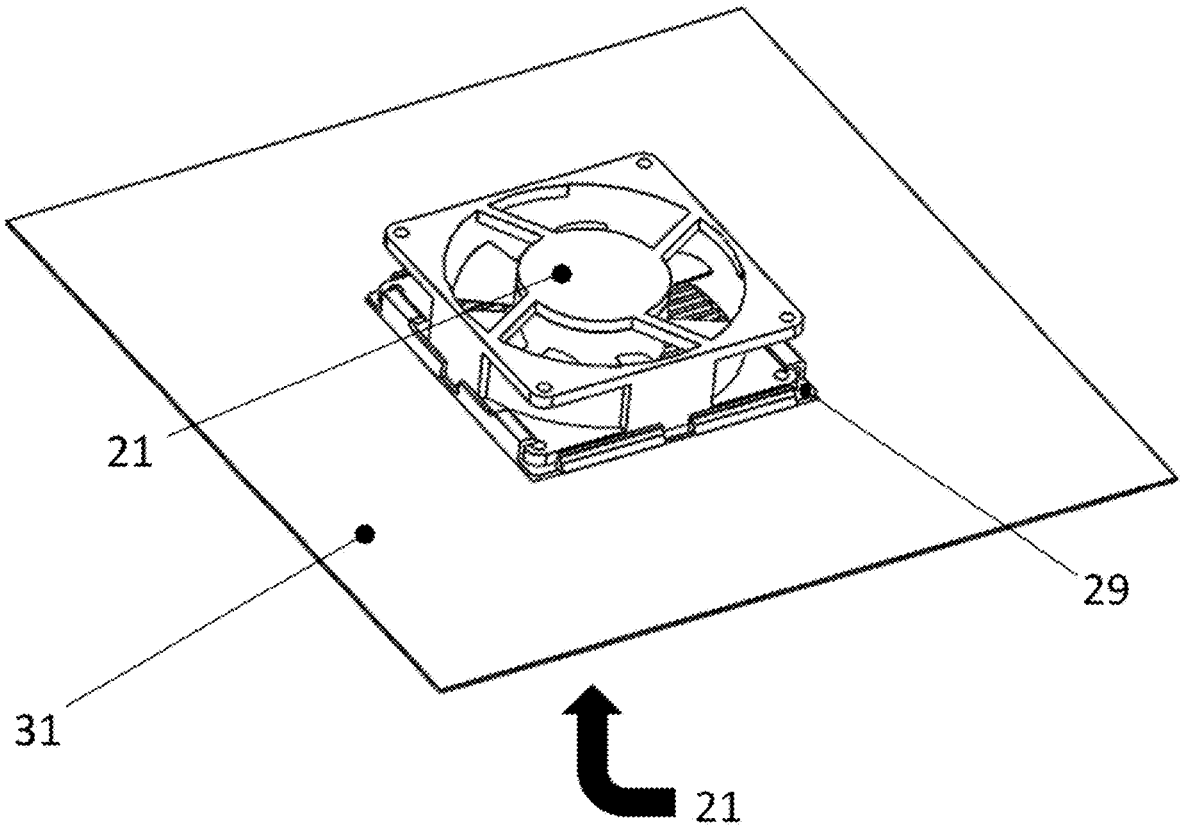
FIG. 19 illustrates a support frame of the present teachings.
Figure 20:
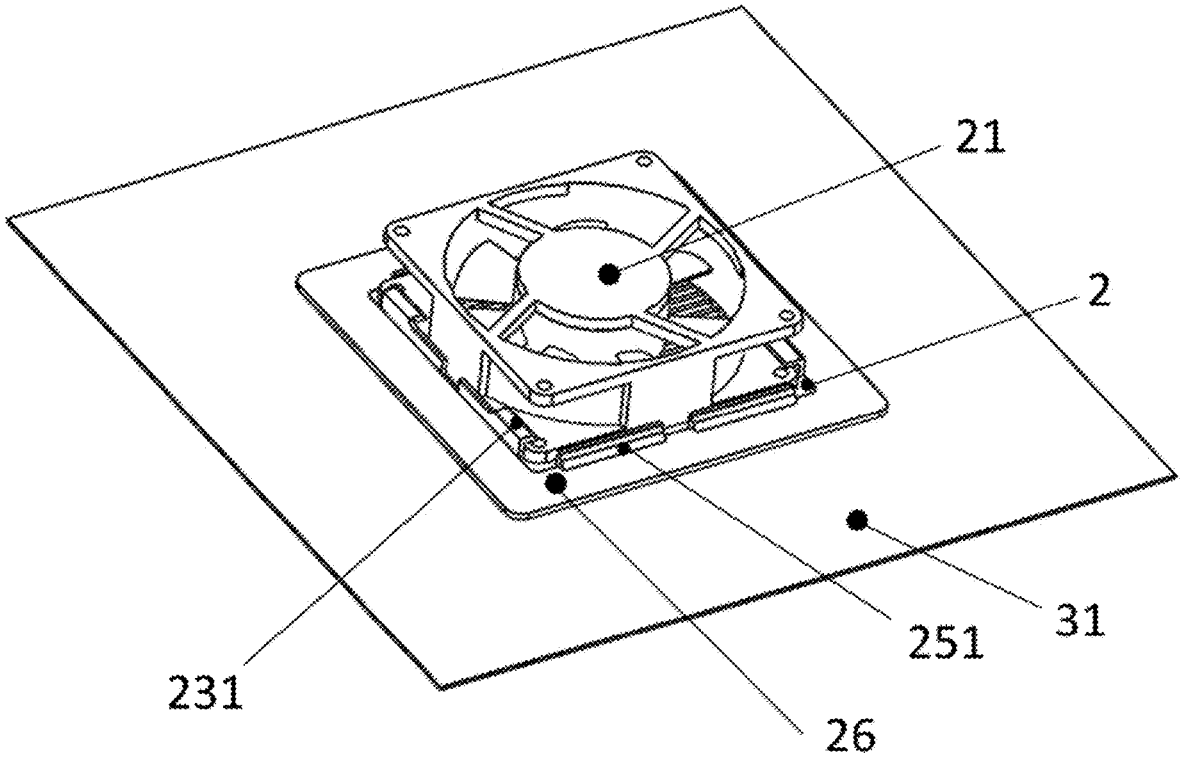
FIG. 20 illustrates components assembled on a support frame of the present teachings.

A fan assembly 30 (FIG. 4) comprises a fan guard 2 (FIG. 5) and a fan 21 (FIG. 6). The fan guard 2 (FIG. 5) comprises a frame 50 (FIG. 5) having protrusions 23 (FIG. 5) ending in clips 231 (FIG. 5) configured to accept a fan 21 (FIG. 6). The fan 21 (FIG. 6) having been installed via the clips 231 (FIG. 5) on the fan guard 2 (FIG. 5), is held by the clips. The fan 21 (FIG. 6) is inserted through a square hole in the elongated fan plenum 31 (FIG. 19). A retainer 26 (FIG. 8) is installed onto the fan guard 2 (FIG. 5) via the clips 251 (FIG. 5) thus securing the fan assembly 30 (FIG. 4) to the elongated fan plenum 31 (FIG. 19). The assembled components are shown in FIG. 20 and the components are shown in an exploded view in FIG. 8.

Example 2

This example illustrates a three-fan chair 11 (FIG. 21, FIG. 52) of the present teachings.

Figure 7:
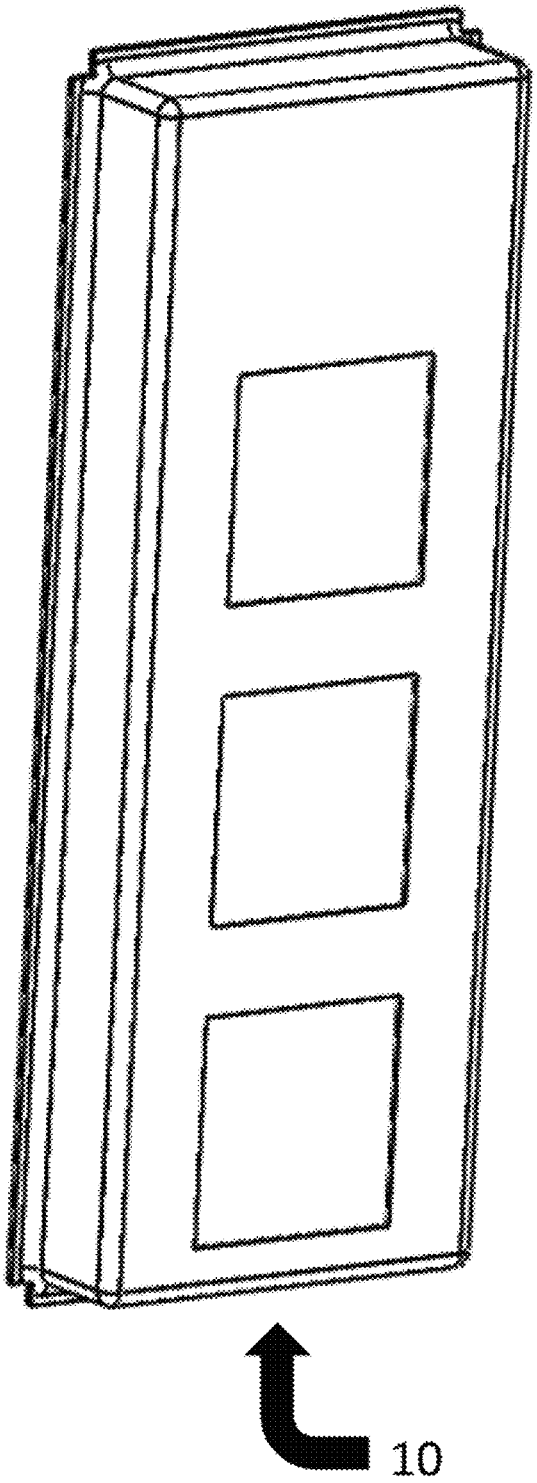
FIG. 7 illustrates a rectangular elongated plenum of the present teachings.
Figure 21:
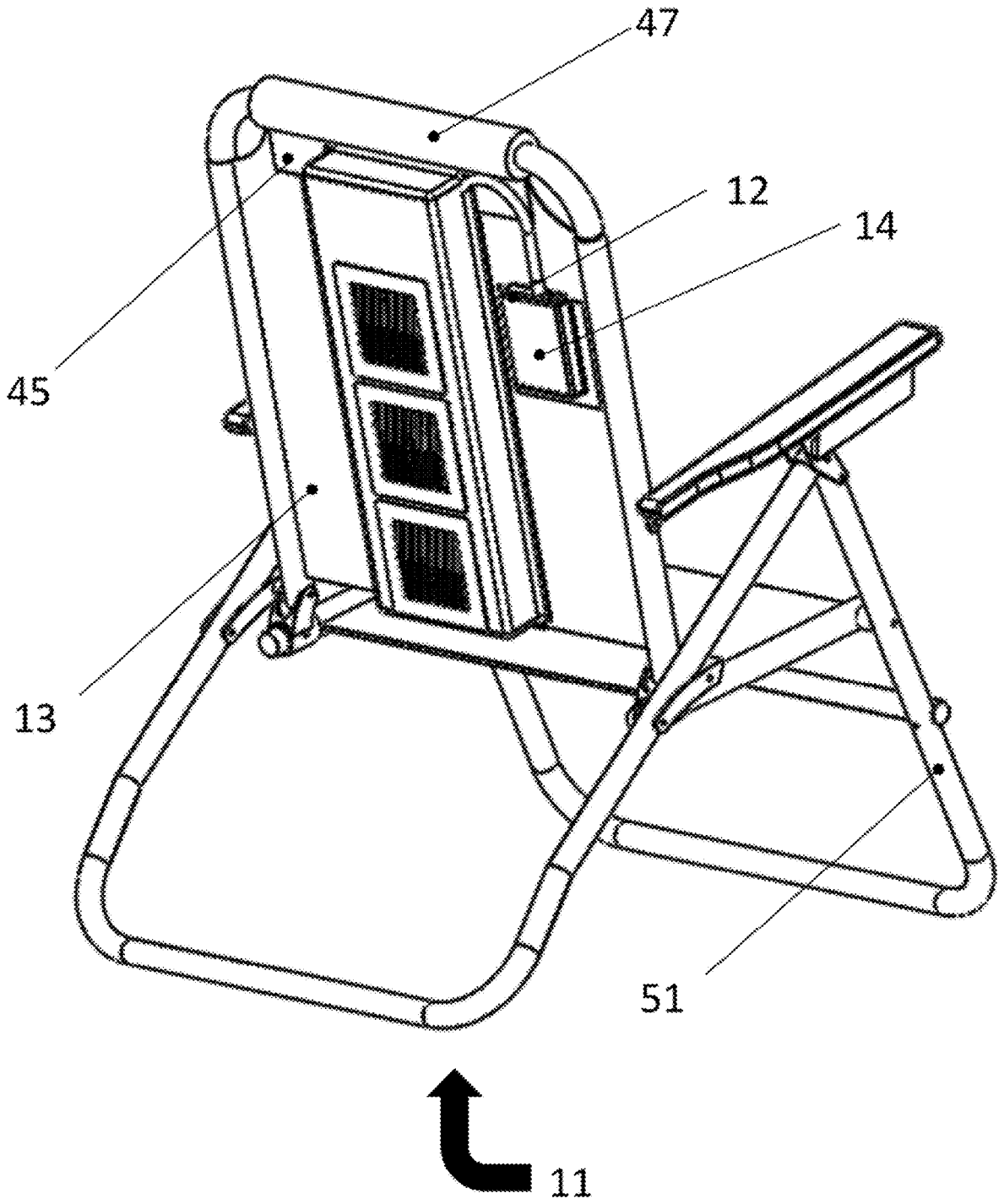
FIG. 21 illustrates a chair of the present teachings.
Figure 22:
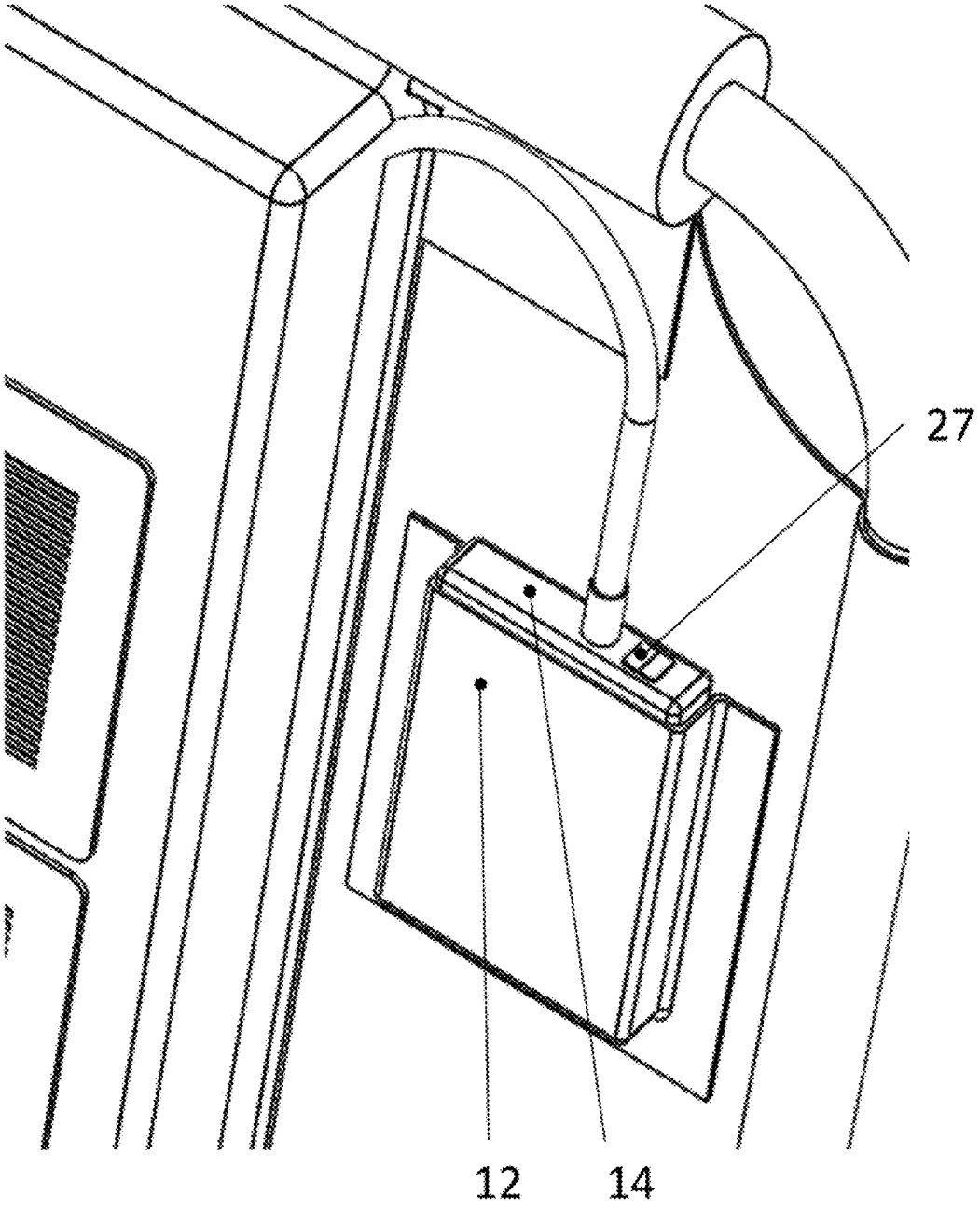
FIG. 22 illustrates a battery pack in a pouch as mounted on a chair of the present teachings.
Figure 23:
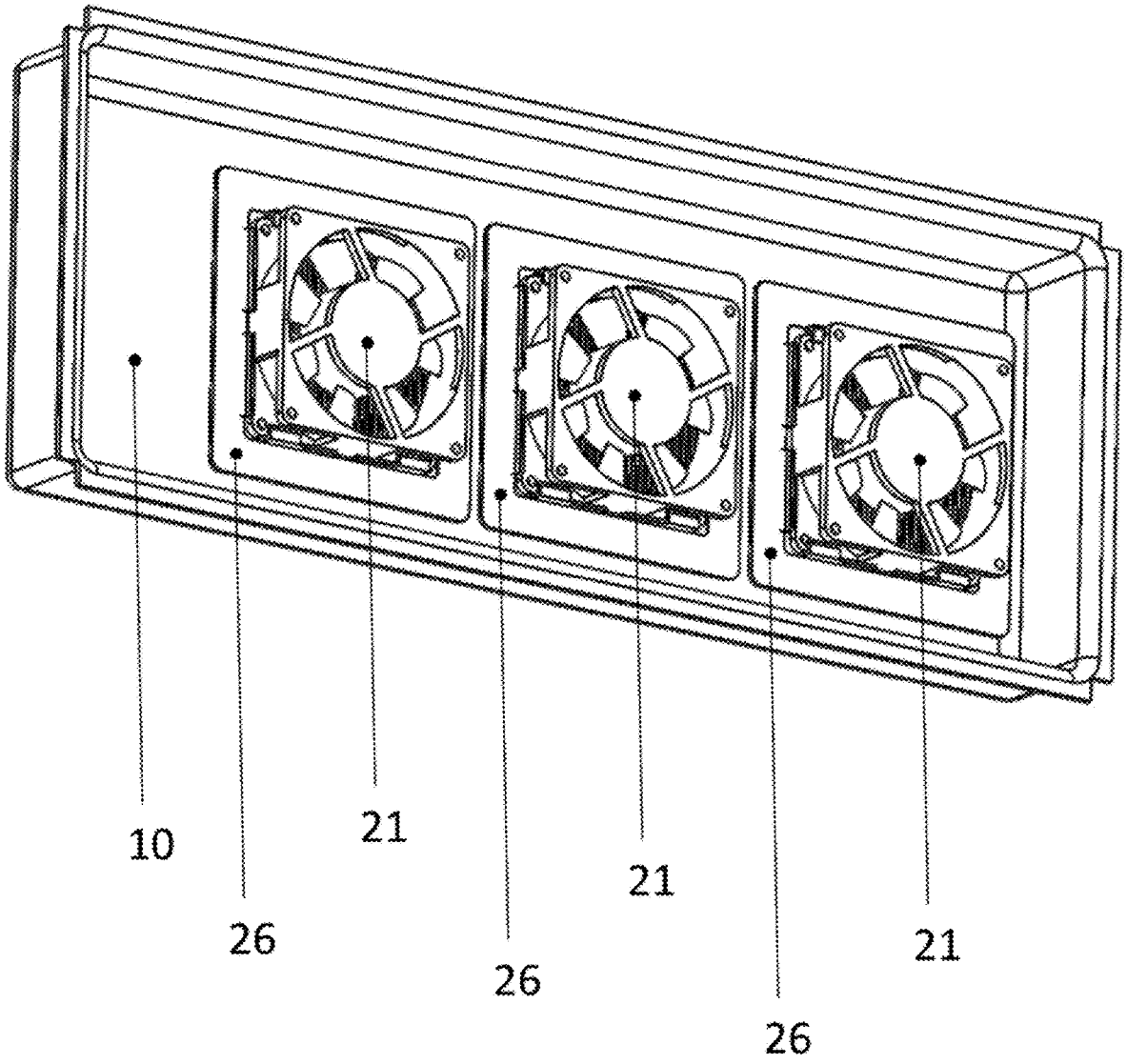
FIG. 23 illustrates fans mounted in a rectangular elongated fan plenum of the present teachings.
Figure 24:
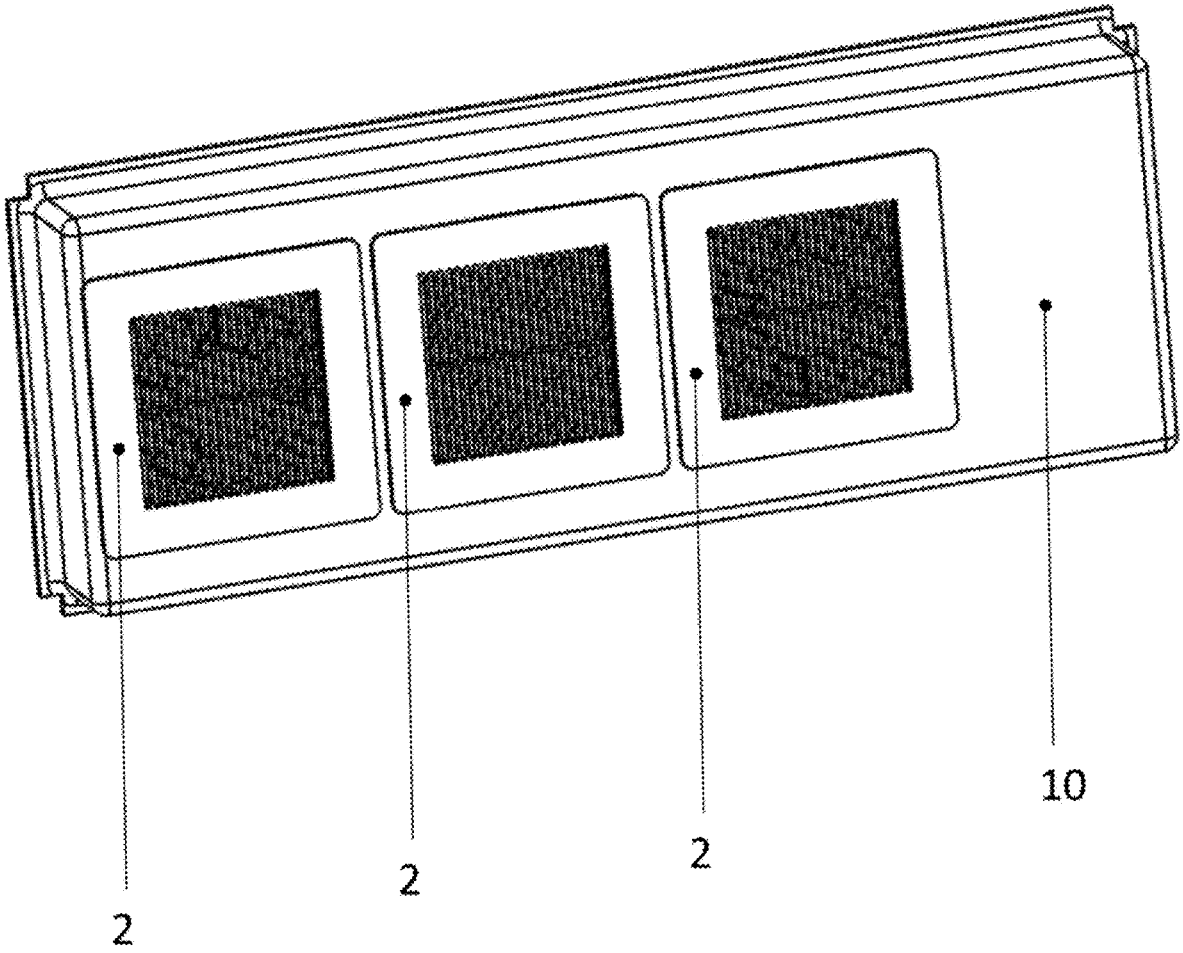
FIG. 24 illustrates a rectangular elongated fan plenum with three fan guards of the present teachings.
Figure 25:
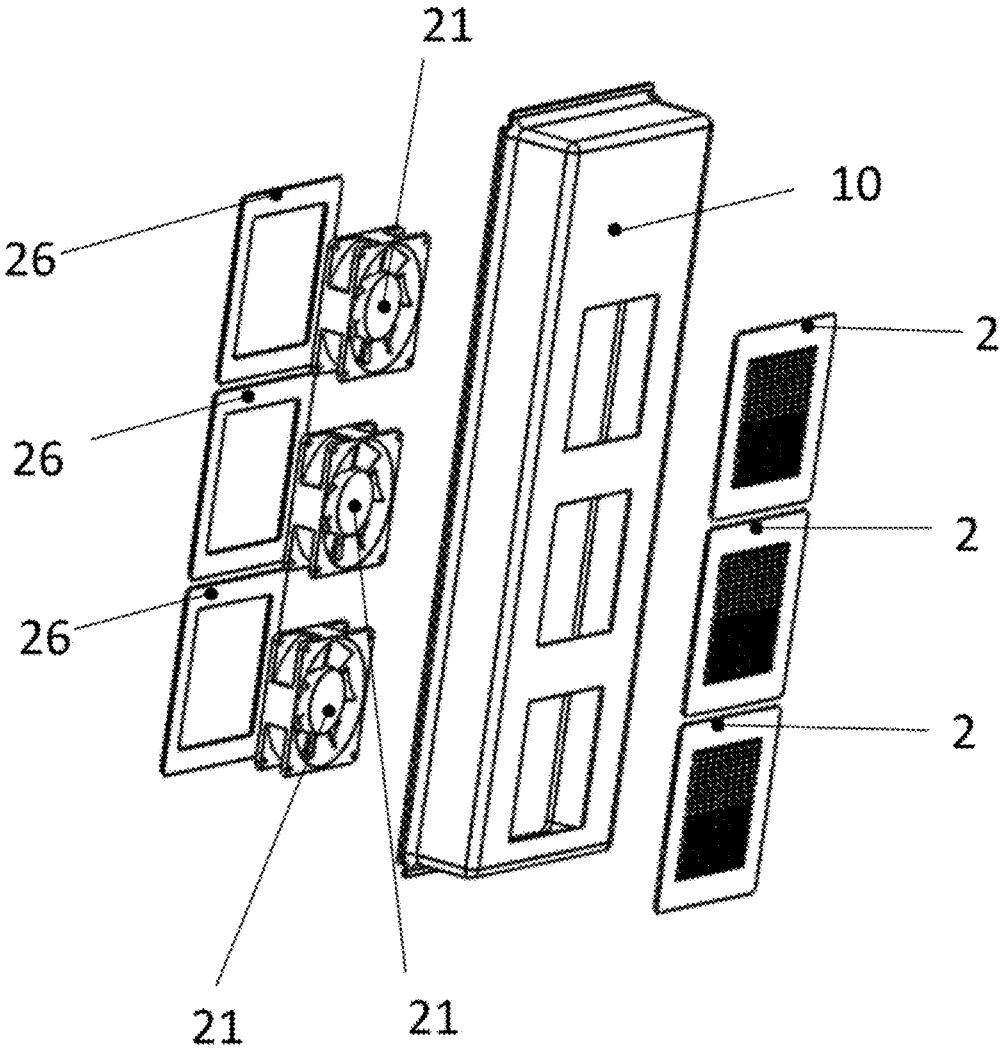
FIG. 25 illustrates an exploded view of a rectangular elongated fan plenum comprising three fans of the present teachings.
Figure 26:
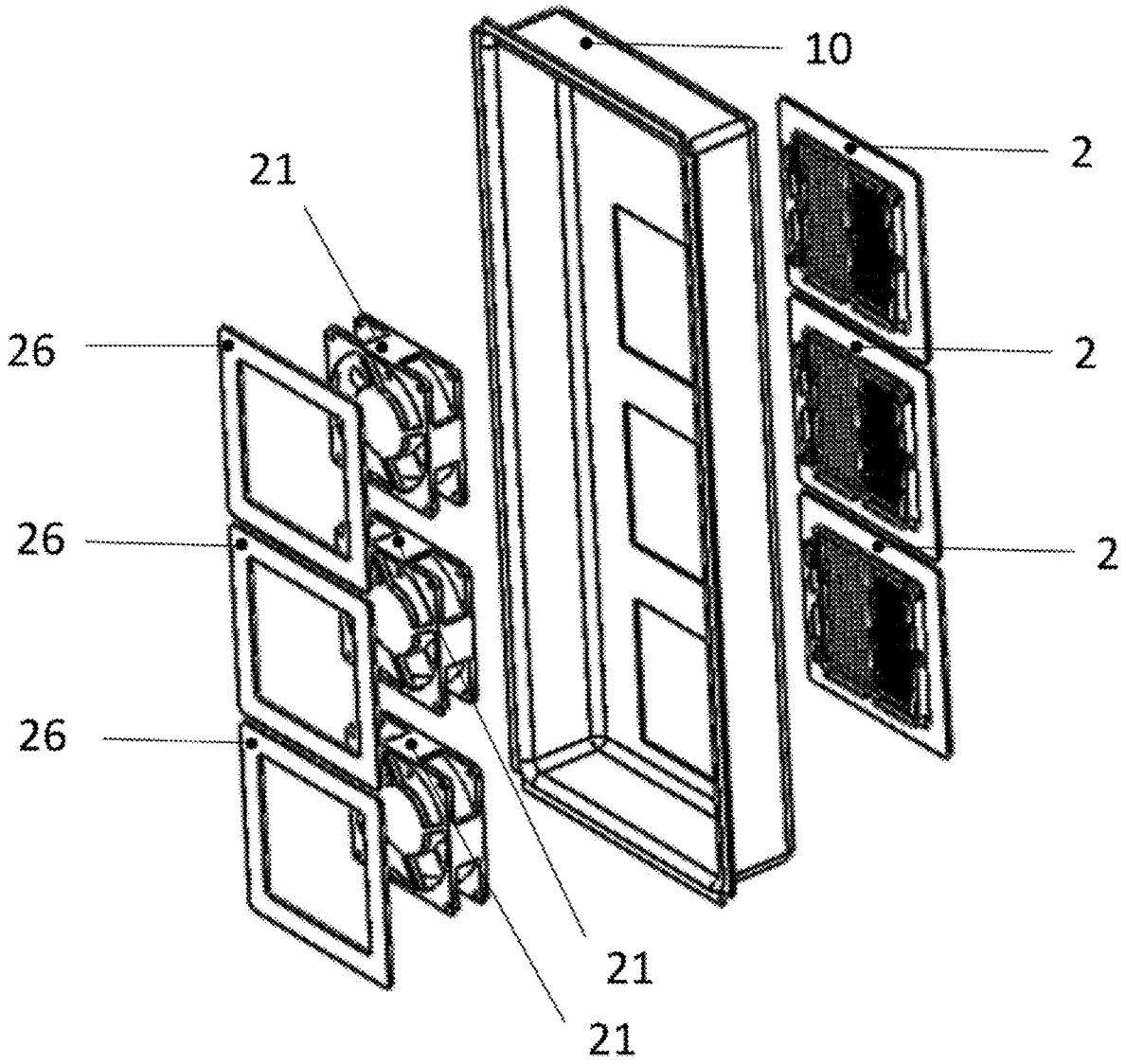
FIG. 26 illustrates an exploded view of a rectangular elongated fan plenum comprising three fans of the present teachings.
Figure 52:
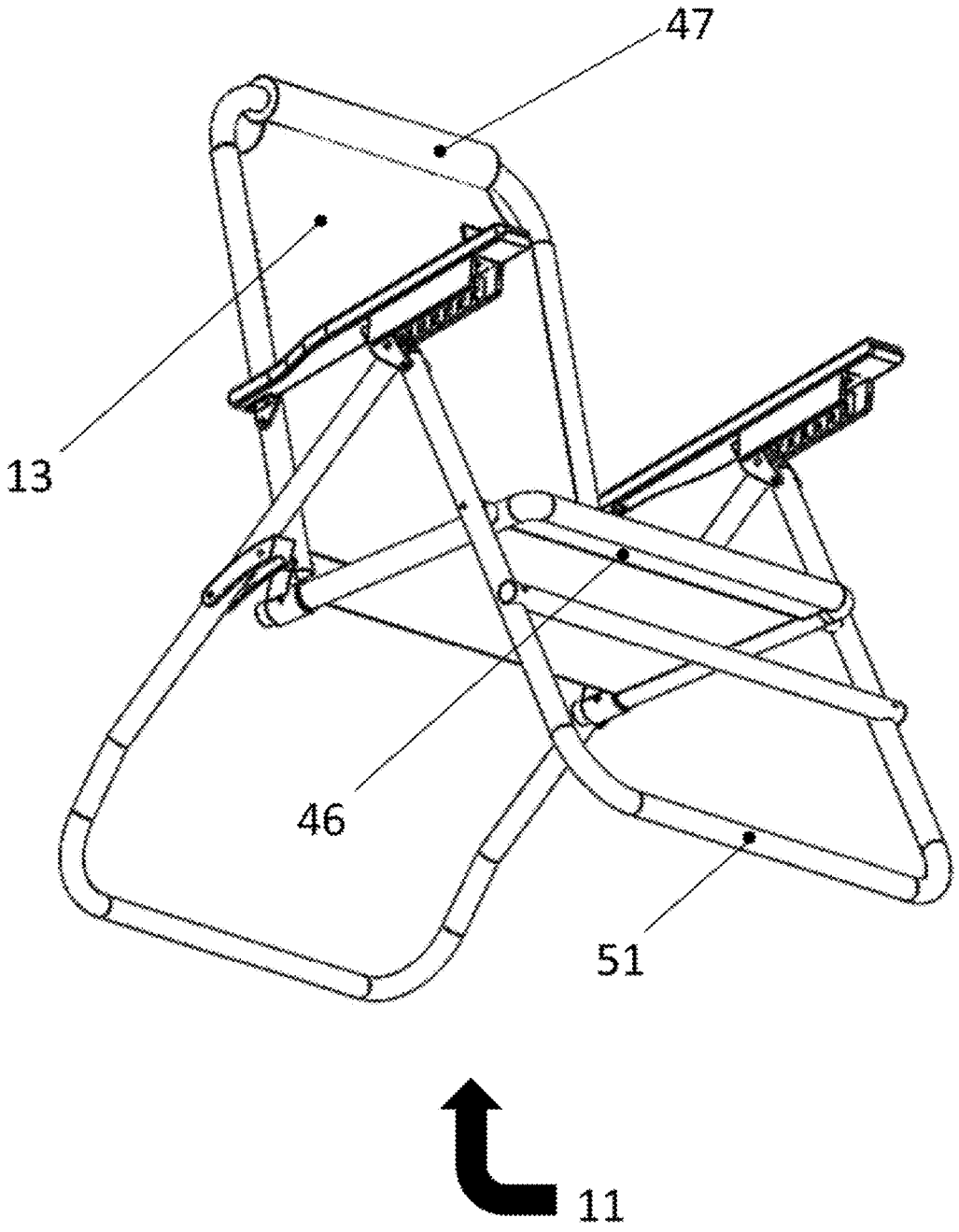
FIG. 52 illustrates a chair of the present teachings, including a frame, a back comprising a porous material, a backrest, a seat, and hook and loop fasteners (such as VELCRO®) for securing the seat to the frame.

A rectangular elongated fan plenum 10 (FIG. 7) was constructed out of canvas with three square holes to accommodate three fan assemblies 30 (FIG. 4). Each of the fan assemblies 30 (FIG. 4) were constructed as described in Example 1. The clip 231 (FIG. 5) and retainer 26 (FIG. 5) configuration allows the fans 21 (FIG. 6) to be securely affixed to the elongated fan plenum 10 (FIG. 7) without sewing. The three fan assemblies 30 (FIG. 4) are configured so that in operation, the fans 21 (FIG. 6) direct airflow towards the inside of the rectangular elongated fan plenum 10 (FIG. 7). The fans 21 (FIG. 6) (92 mm×92 mm×25 mm. speed 3000 rpm, Air Flow 75CFM, 12 VDC, Model HD9225S12H, manufacturer Shenzhen Henglixin Electronic Co., Ltd., Shenzhen, Guangdong, China) are electrically connected in parallel, and attached to a battery pack 14 (FIG. 22)(12 VDC, 3000 mAh Lithium Ion Battery Pack, Model YB1203000, Talentcell, Shenzhen, Guangdong Province, China). An On-Off switch 27 (FIG. 22) allows the user to activate or shut-off the fans 21 (FIG. 6). The rectangular elongated fan plenum 10 (FIG. 7) is attached to the open mesh fabric back 13 (FIG. 21) of the chair 11 (FIG. 21). The open mesh fabric back rest is secured to the chair frame 51 (FIG. 21) by sewing and by strips of hook and loop fasteners 45 (FIG. 21) (VELCRO®). The hook and loop (VELCRO®) strips are 2 inch-wide strips. Three sides of the rectangular elongated fan plenum 10 (FIG. 7) are attached by sewing to the back 13 (FIG. 21, FIG. 52). The fourth side is attached with hook and loop fasteners (VELCRO®) allowing for maintenance of the fans 21 (FIG. 6). Sewing, and hook and loop (VELCRO®) strips 46 (FIG. 52) secure the scat bottom to the frame 51. A chair further comprises a headrest 47 (FIG. 21, FIG. 52). In some embodiments hook and loop (VELCRO®) fasteners can be used on all four sides of the rectangular elongated fan plenum 10 (FIG. 7) for attachment to the back 13 (FIG. 21). A battery pouch 12 (FIG. 22) with an open side is also sewn to the back of the chair 11 (FIG. 21) and can be used for holding or storing the battery pack 12 (FIG. 22). The battery pack 12 (FIG. 22) includes an On-Off switch 27 (FIG. 22). This design is illustrated in FIG. 23. FIG. 24. FIG. 22, FIG. 21 and FIG. 52, and in exploded views in FIG. 25 and FIG. 26.

Example 3

This example illustrates a two-fan chair 111 (FIG. 27) of the present teachings.

Figure 27:
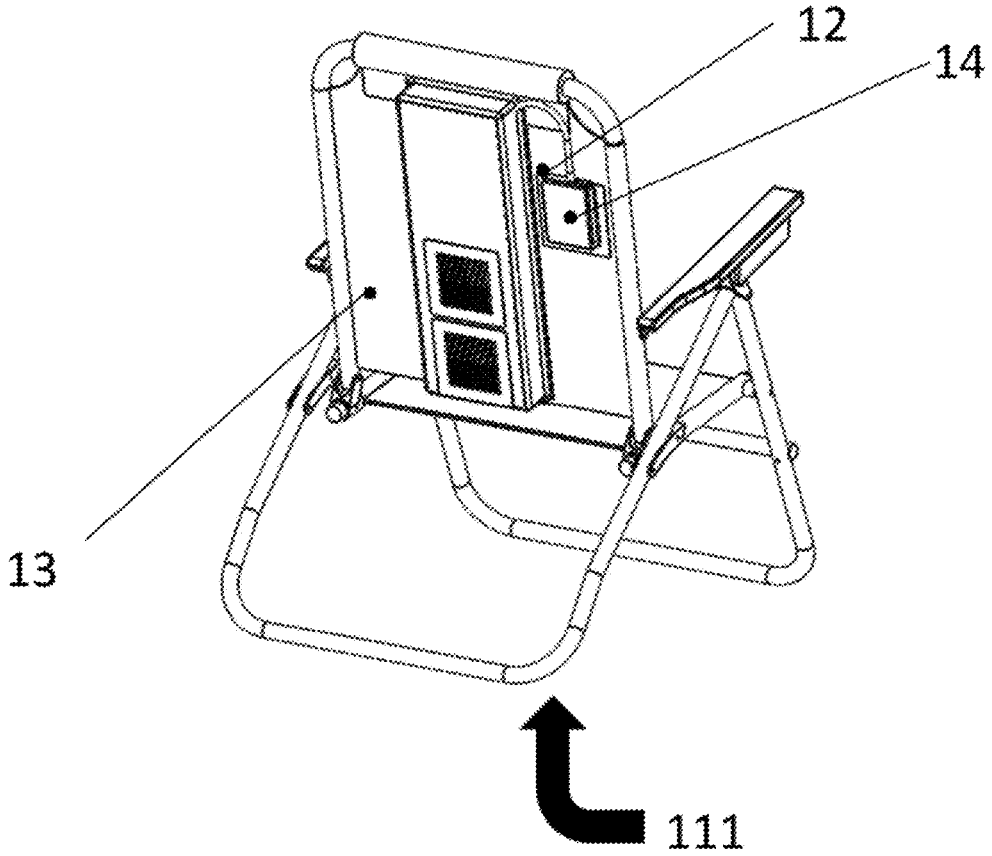
FIG. 27 illustrates a two-fan chair of the present teachings.
Figure 28:
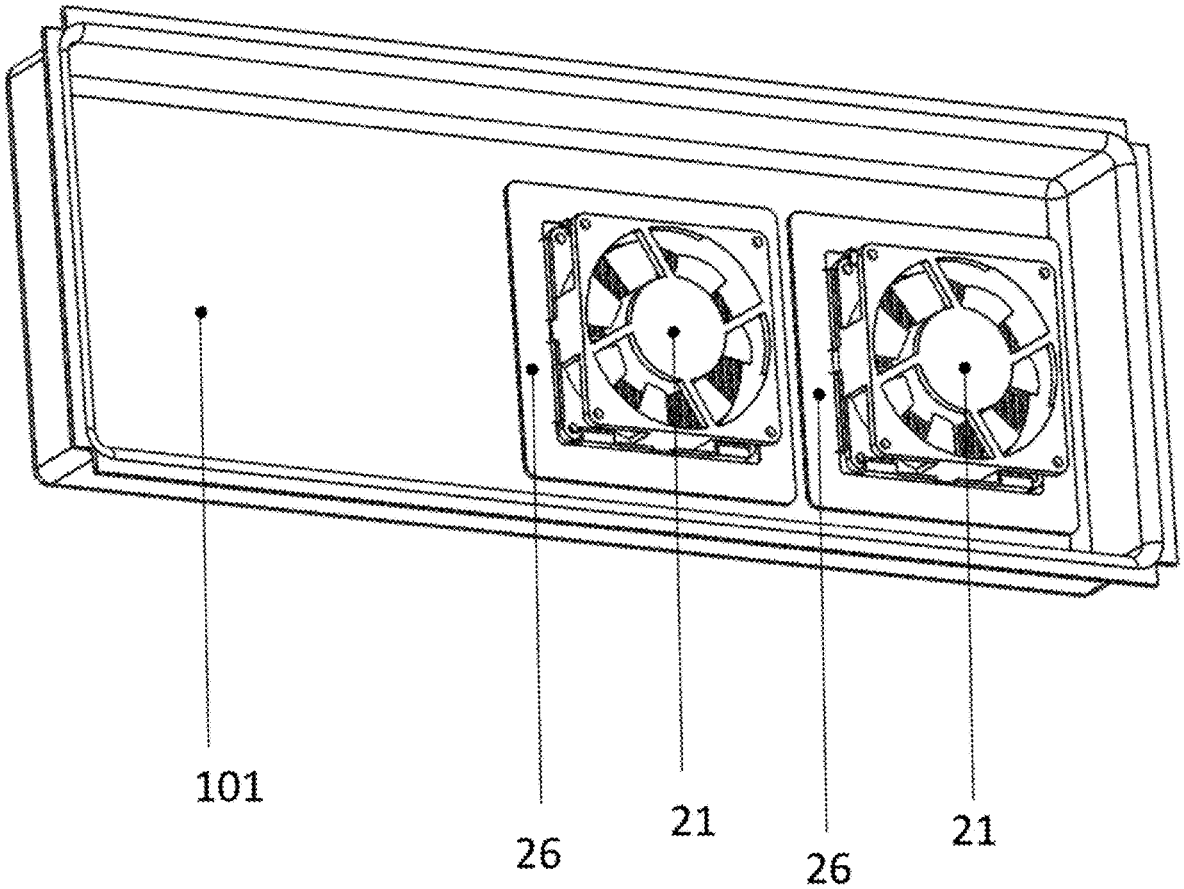
FIG. 28 illustrates fans mounted within an elongated fan plenum for a two-fan chair of the present teachings.
Figure 29:
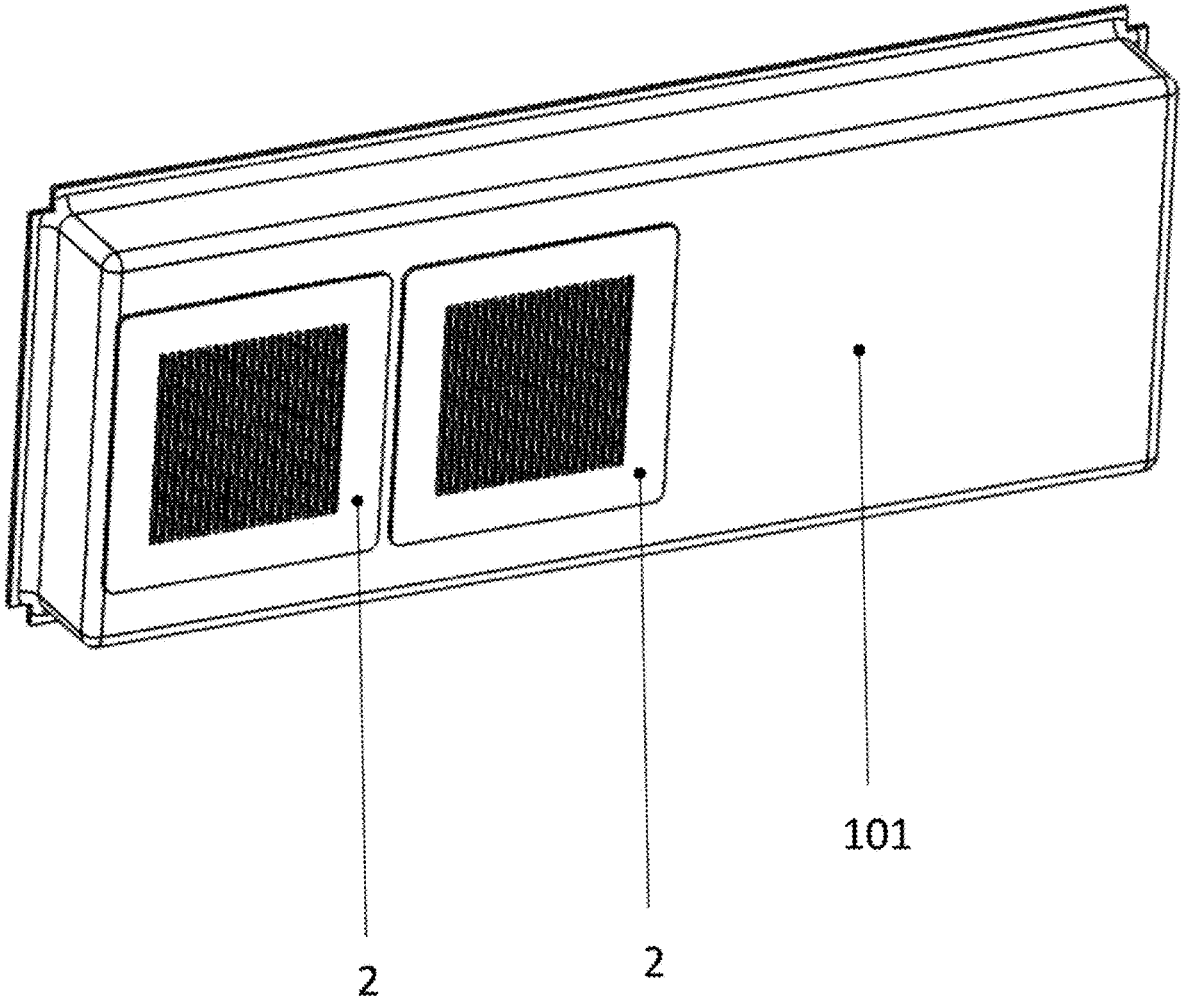
FIG. 29 illustrates a rectangular elongated fan plenum with two fan guards of the present teachings.
Figure 30:
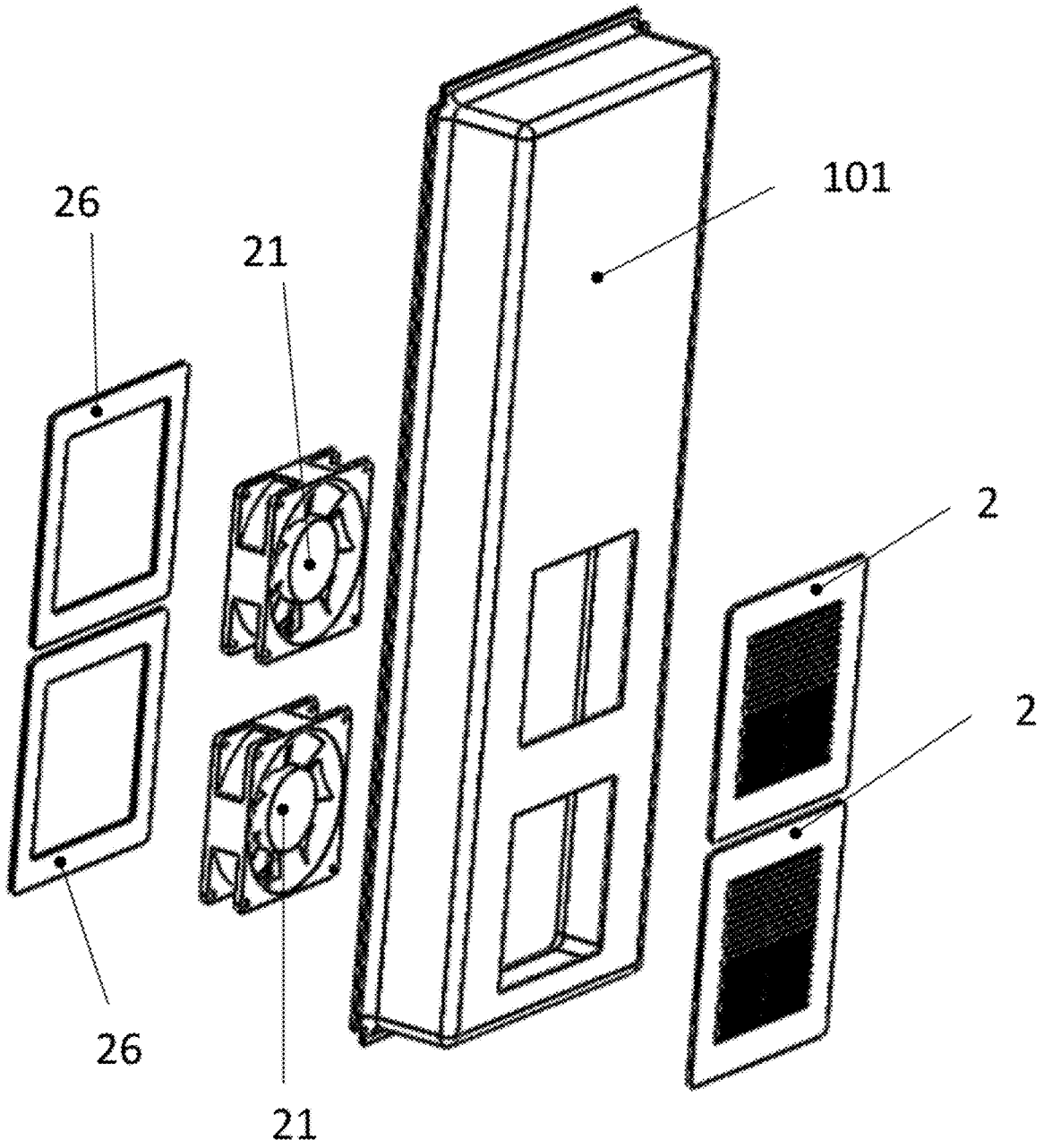
FIG. 30 illustrates an exploded view of a rectangular elongated fan plenum comprising two fans of the present teachings.

A rectangular elongated fan plenum 101 (FIG. 9) was constructed out of canvas with two square holes to accommodate two fan assemblies 30 (FIG. 4). Each of the fan assemblies 30 (FIG. 4) were constructed as described in Example 1. The clip 231 (FIG. 5) and retainer 26 (FIG. 8) configuration allow the fans 21 (FIG. 6) to be securely affixed to the rectangular elongated fan plenum 101 (FIG. 9) without sewing. The two fan assemblies 30 (FIG. 4) were configured so that the fans 21 (FIG. 6) direct airflow towards the inside of the rectangular elongated fan plenum 101 (FIG. 9), were electrically connected in parallel, and attached to a battery pack 14 (FIG. 22). An On-Off Switch 27 (FIG. 22) allows the user to activate or shut-off the fans 21 (FIG. 6). The rectangular elongated fan plenum 101 (FIG. 9) is attached to the open mesh fabric back 13 (FIG. 27) of the chair 111 (FIG. 27). Three sides of the rectangular elongated fan plenum 101 (FIG. 9) were attached by sewing to the hack 13 (FIG. 27). The fourth side was attached with hook and loop fasteners (VELCRO®), allowing for maintenance of the fans 21 (FIG. 6). In some embodiments hook and loop fasteners can be used on all four sides of the rectangular elongated fan plenum 101 (FIG. 28) for attachment to the back 13 (FIG. 27). A battery pouch 14 (FIG. 27) with an open side is also sew n to the back of the chair 111 (FIG. 27) and can be used for holding or storing the battery pack 12 (FIG. 27) which includes an On-Off Switch 27 (FIG. 22). This design is illustrated in FIG. 27, FIG. 9, FIG. 28, FIG. 29, and exploded views FIG. 30 and FIG. 31.

Example 4

This example illustrates a three-fan chair 112 (FIG. 32) of the present teachings.

Figure 32:
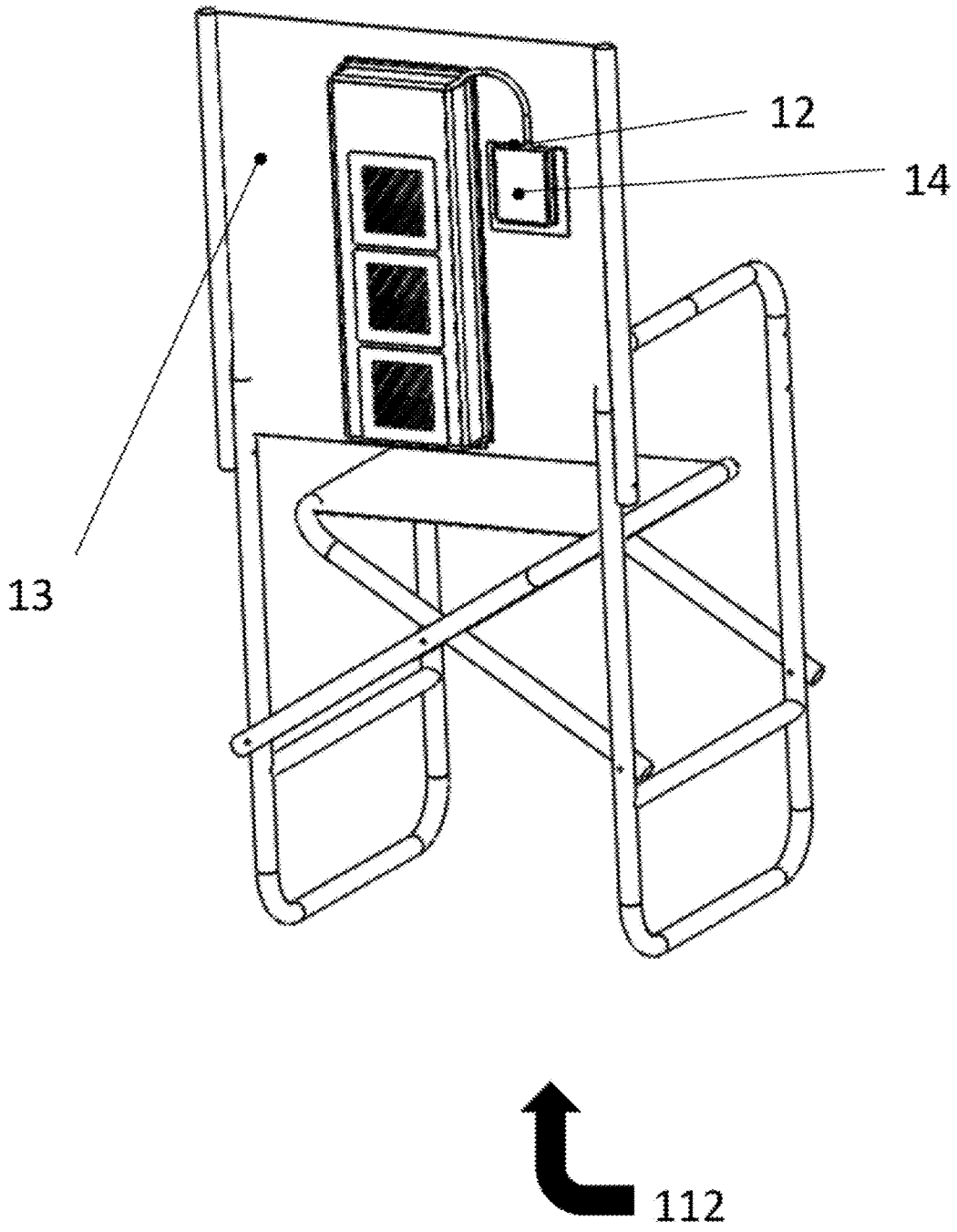
FIG. 32 illustrates a three-fan chair of the present teachings.
Figure 33:
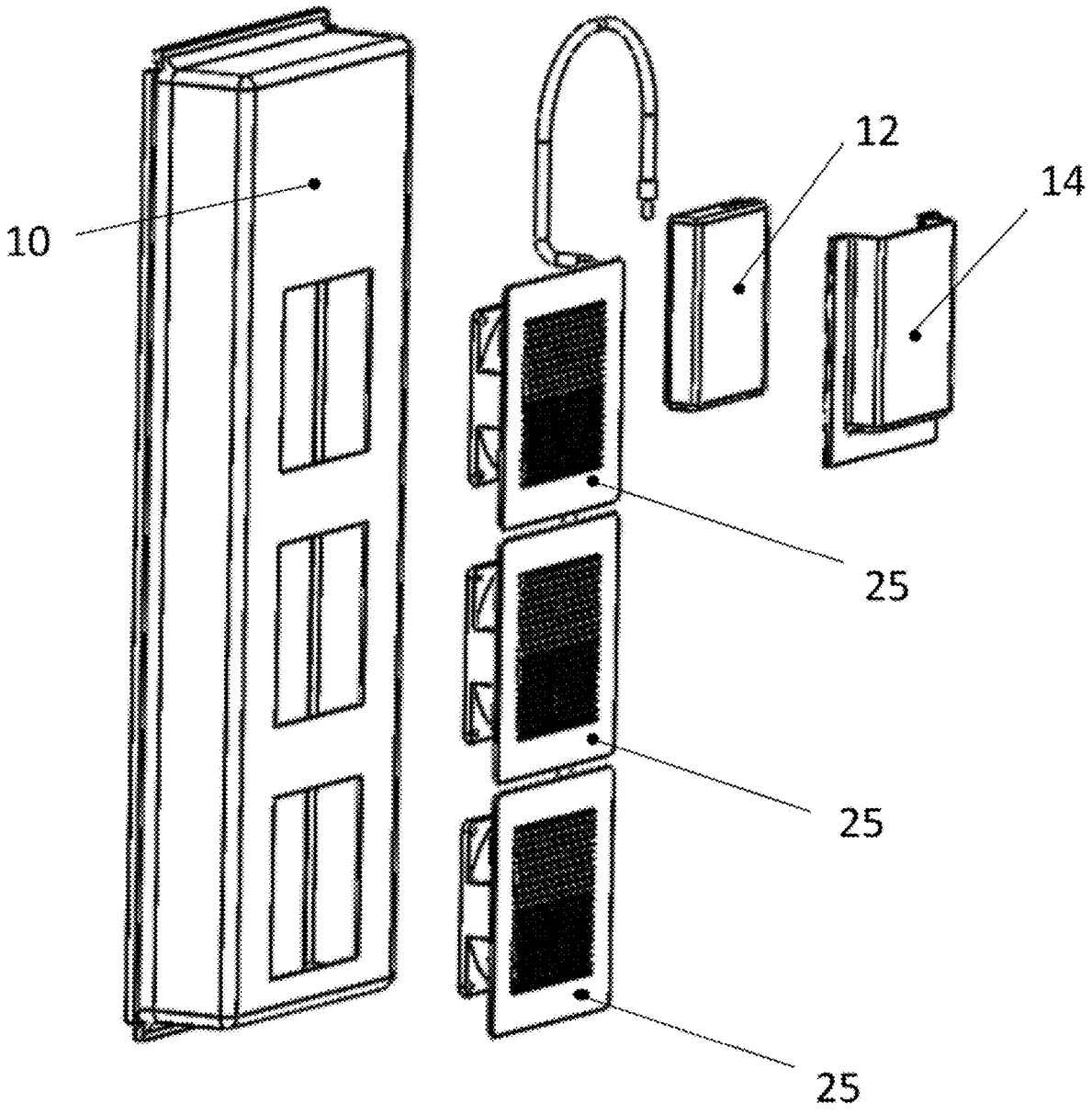
FIG. 33 illustrates an exploded view of an apparatus of the present teachings.

A rectangular elongated fan plenum 10 (FIG. 33) is constructed out of canvas with three square holes in the back to accommodate three 60 mm fans 25 (FIG. 33). Three fans are sewn into the elongated fan plenum. The fans 25 (FIG. 33) are configured to direct airflow towards the inside of the rectangular elongated fan plenum 10 (FIG. 33), are wired in parallel, and are attached to a battery pack 12 (FIG. 33). The rectangular elongated fan plenum 10 (FIG. 33) is attached to the back of a director's chair that has a porous back 13 (FIG. 32). Three sides of the rectangular elongated fan plenum 10 (FIG. 33) are attached by sewing to the chair. The fourth side is attached with hook and loop fasteners (VELCRO®), allowing for maintenance of the fans 25 (FIG. 33). A battery pouch 14 (FIG. 33) with an open side is also sewn to the back of the chair 112 (FIG. 32) for holding or storing the battery pack 12 (FIG. 33).

Example 5

This example illustrates a two-fan chair 113 (FIG. 34) of the present teachings.

Figure 34:
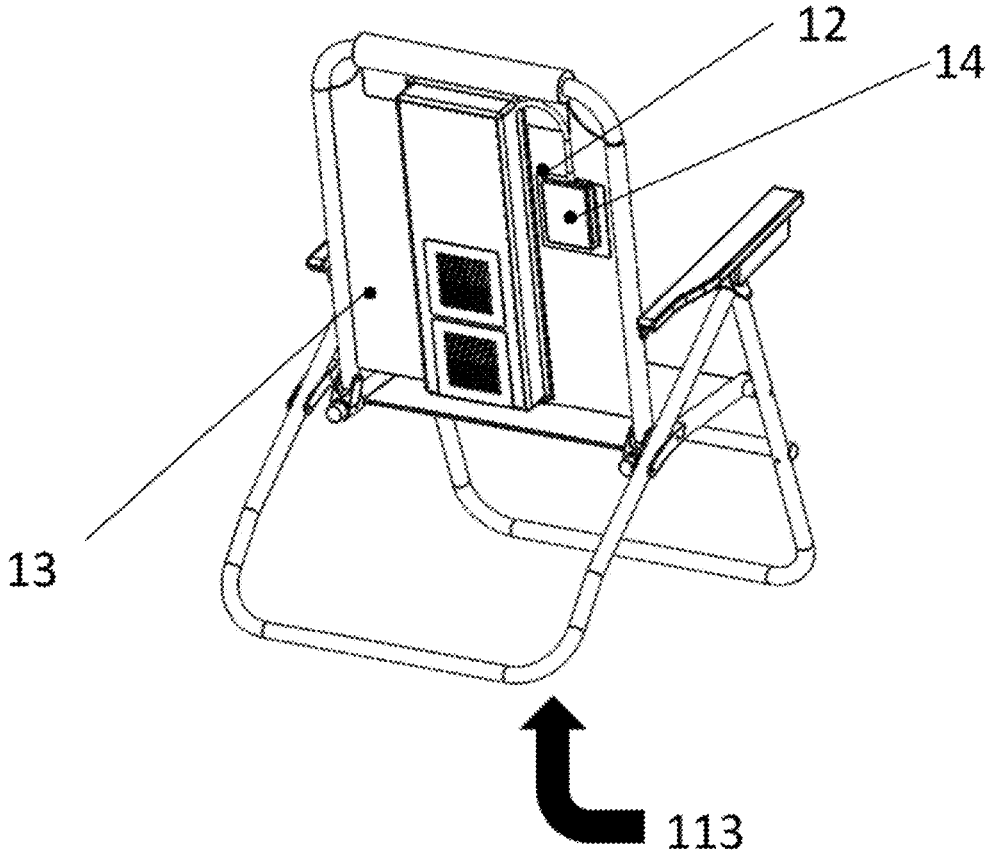
FIG. 34 illustrates a two-fan chair of the present teachings.
Figure 35:
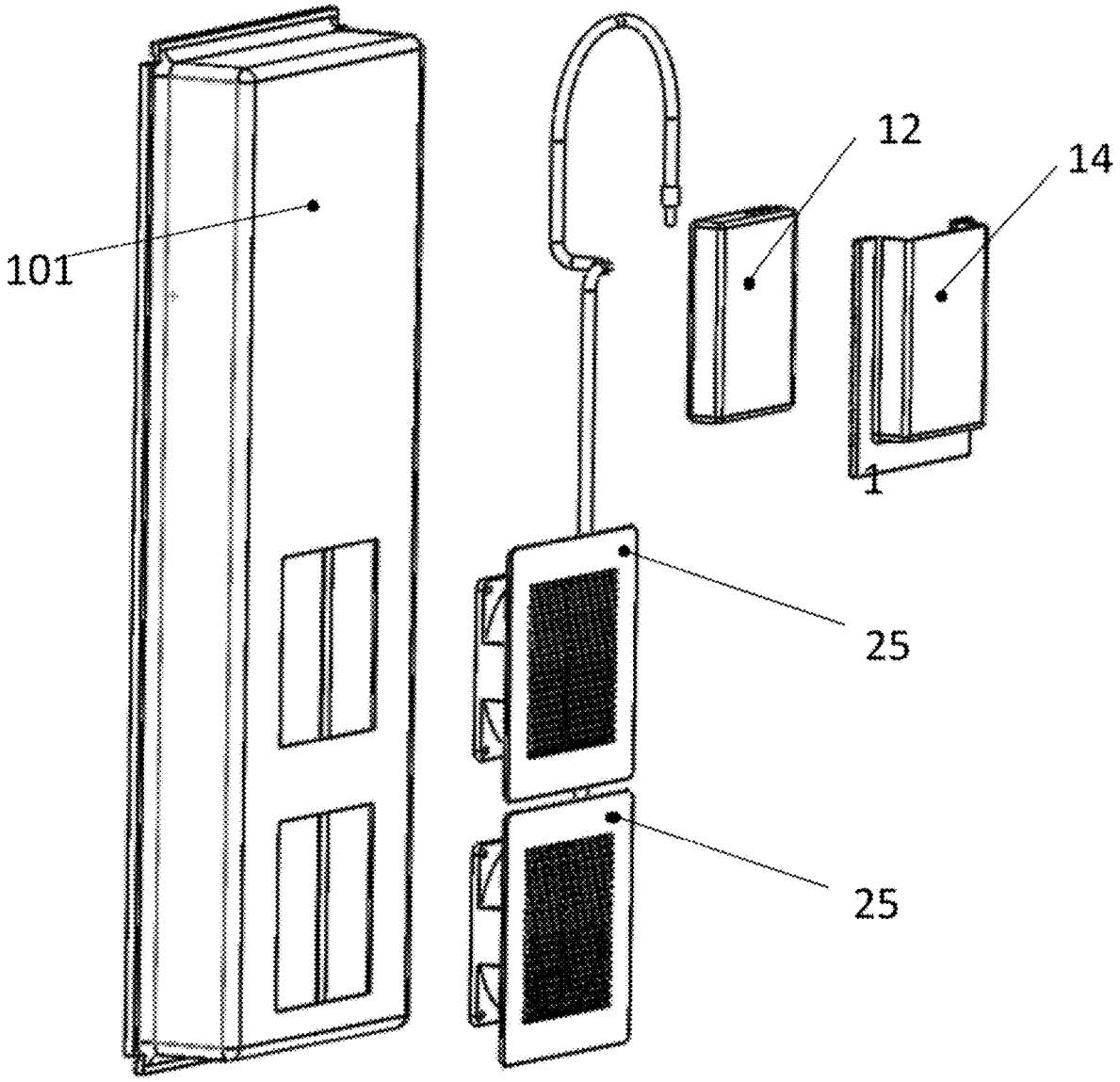
FIG. 35 illustrates an exploded view of a rectangular elongated fan plenum of a two-fan configuration of the present teachings.

A rectangular elongated fan plenum 101 (FIG. 35) is constructed out of canvas with two square holes in the back to accommodate two 80 mm fans 25 (FIG. 35) which are sewn into the rectangular elongated fan plenum 101 (FIG. 35). The fans are configured to direct airflow towards the inside of the rectangular elongated fan plenum 101 (FIG. 35), are wired in parallel, and are attached to a battery pack 12 (FIG. 35). The rectangular elongated elongated fan plenum 101 (FIG. 35) is attached to the back of a lawn chair 113 (FIG. 34) that has a porous back 13 (FIG. 34). Three sides of the rectangular elongated fan plenum 101 (FIG. 34) are attached by sewing to the chair. The fourth side is attached with hook and loop fasteners (VELCRO®), allowing for maintenance of the two 80 mm fans 25 (FIG. 35). A battery pouch 14 (FIG. 35) with an open side is also sewn the that back of the chair 113 (FIG. 34) for storing the battery pack 12 (FIG. 35).

Example 6

Figure 36:
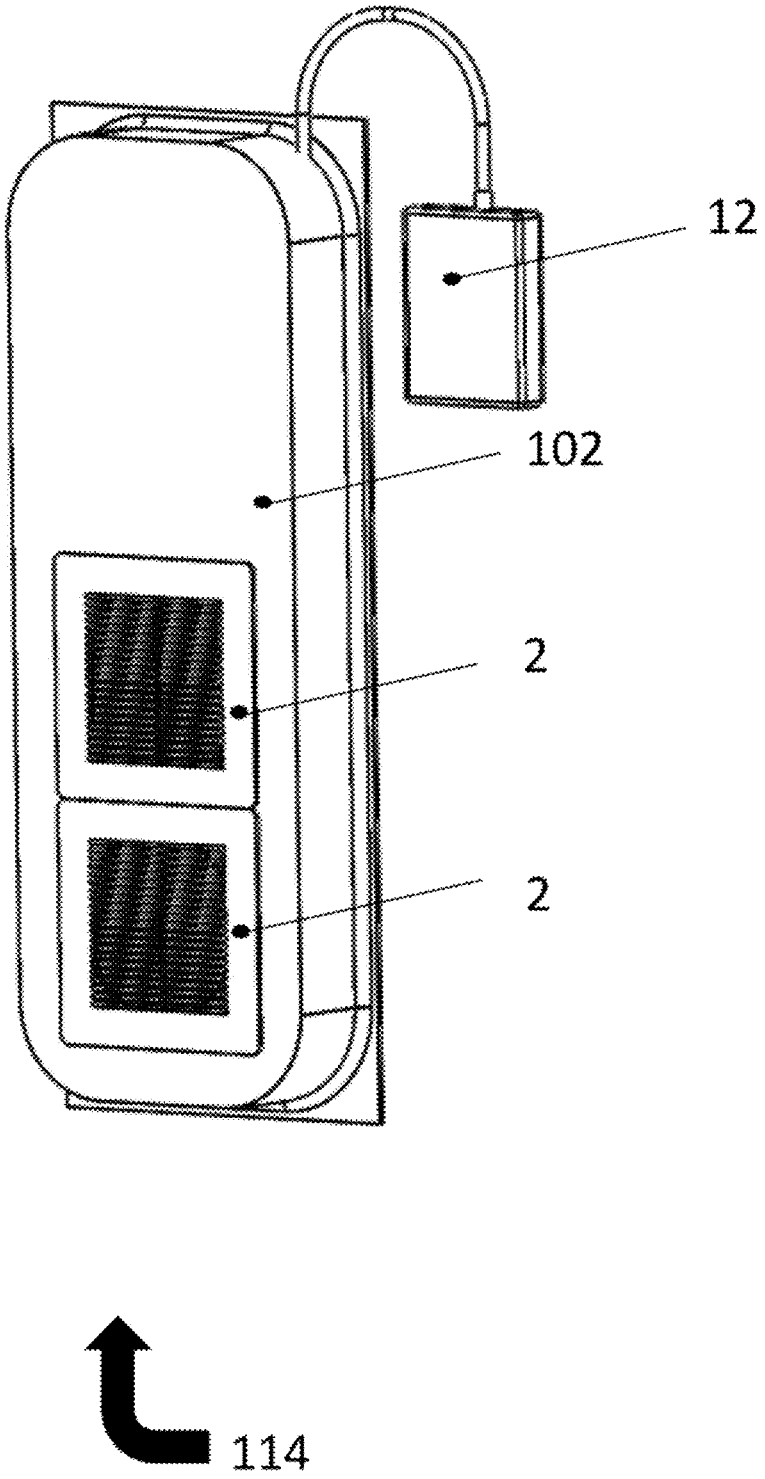
FIG. 36 illustrates a rectangular elongated fan plenum of a two-fan configuration of the present teachings.
Figure 37:
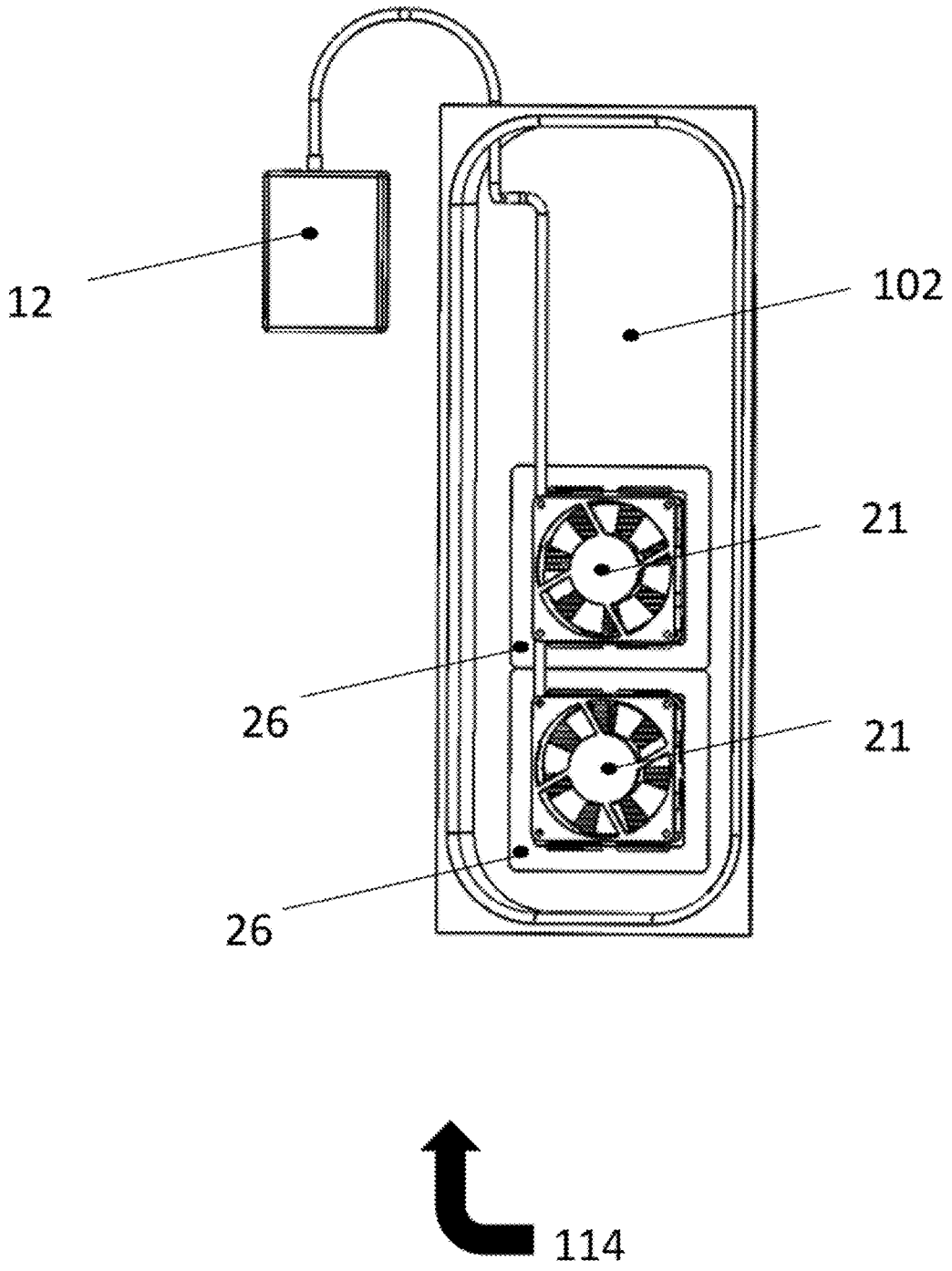
FIG. 37 illustrates a rectangular elongated fan plenum of a two-fan configuration of the present teachings.

This example illustrates a two-fan wo ling apparatus 114 (FIG. 36, FIG. 37 and exploded FIG. 10) of the present teachings.

Figure 10:
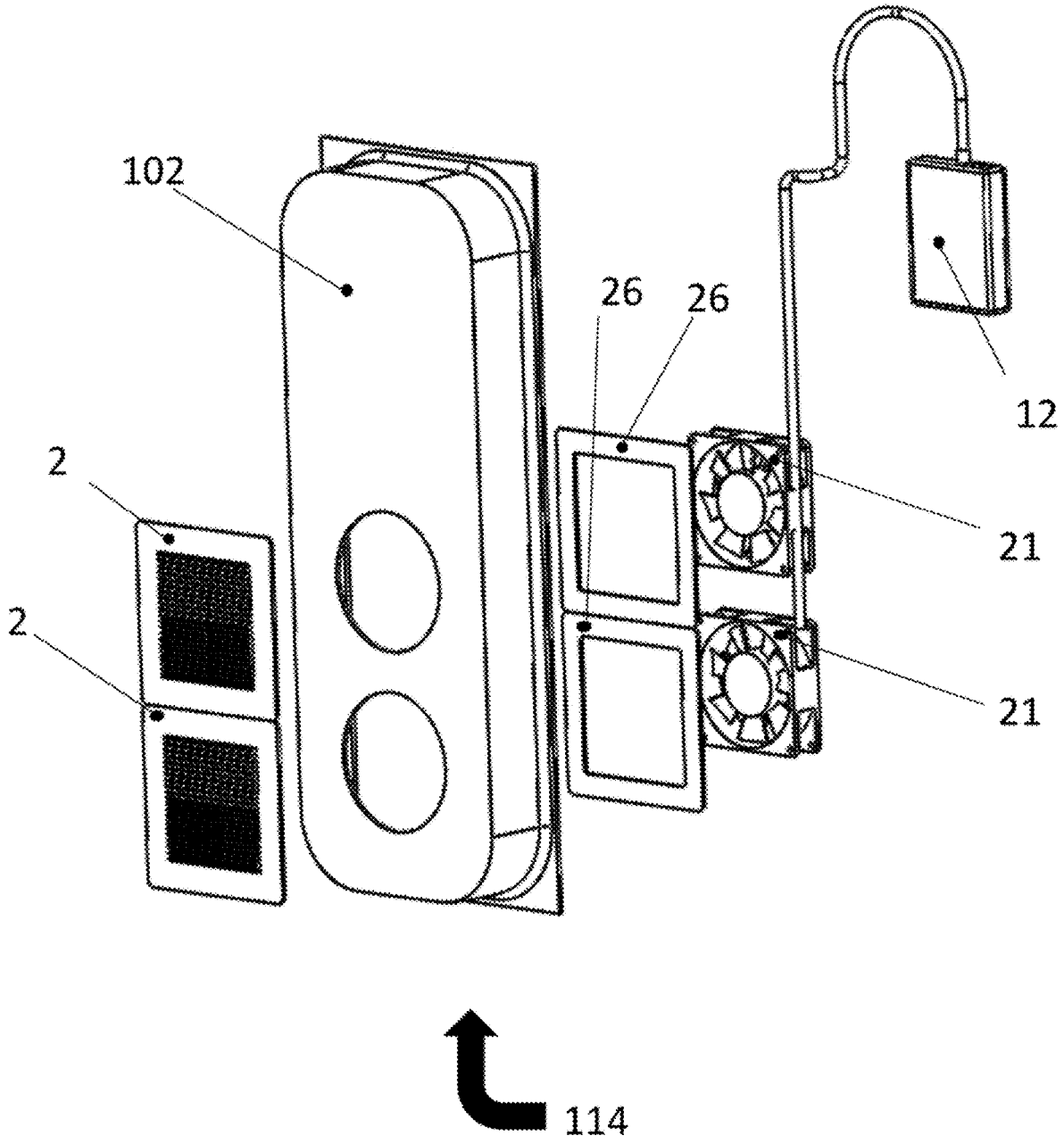
FIG. 10 illustrates an exploded view of an ovoid elongated fan plenum of the present teachings.

An oval elongated elongated fan plenum 102 (FIG. 10) is constructed out of canvas containing two round holes to accommodate two fan assemblies 30 (FIG. 4). For each of the two fan assemblies 30 (FIG. 4), a fan guard 2 (FIG. 5) is affixed to the outside of the oval elongated fan plenum 102 (FIG. 10) by inserting the frame 50 (FIG. 5) through a round hole in the oval elongated fan plenum 102 (FIG. 10). The frame 50 (FIG. 5) ends in outward facing clips 251 (FIG. 5) in which a retainer 26 (FIG. 10) is inserted under the outward facing clips 251 (FIG. 5) and inside the oval elongated fan plenum 102 (FIG. 10). This allows each fan assembly 30 (FIG. 4) to be securely attached to the oval elongated fan plenum 102 (FIG. 10) without sewing. Each fan assembly 30 (FIG. 4) comprises a 66 mm fan 21 (FIG. 6) comprised of fan blades 29 (FIG. 6) and a hub 28 (FIG. 6). The two fan assemblies 30 (FIG. 4) are configured so that the fans 21 (FIG. 6) can direct airflow towards the inside of the oval elongated fan plenum 102 (FIG. 10), are wired in parallel, and are attached to the battery pack 12 (FIG. 10).

Example 7

Figure 38:
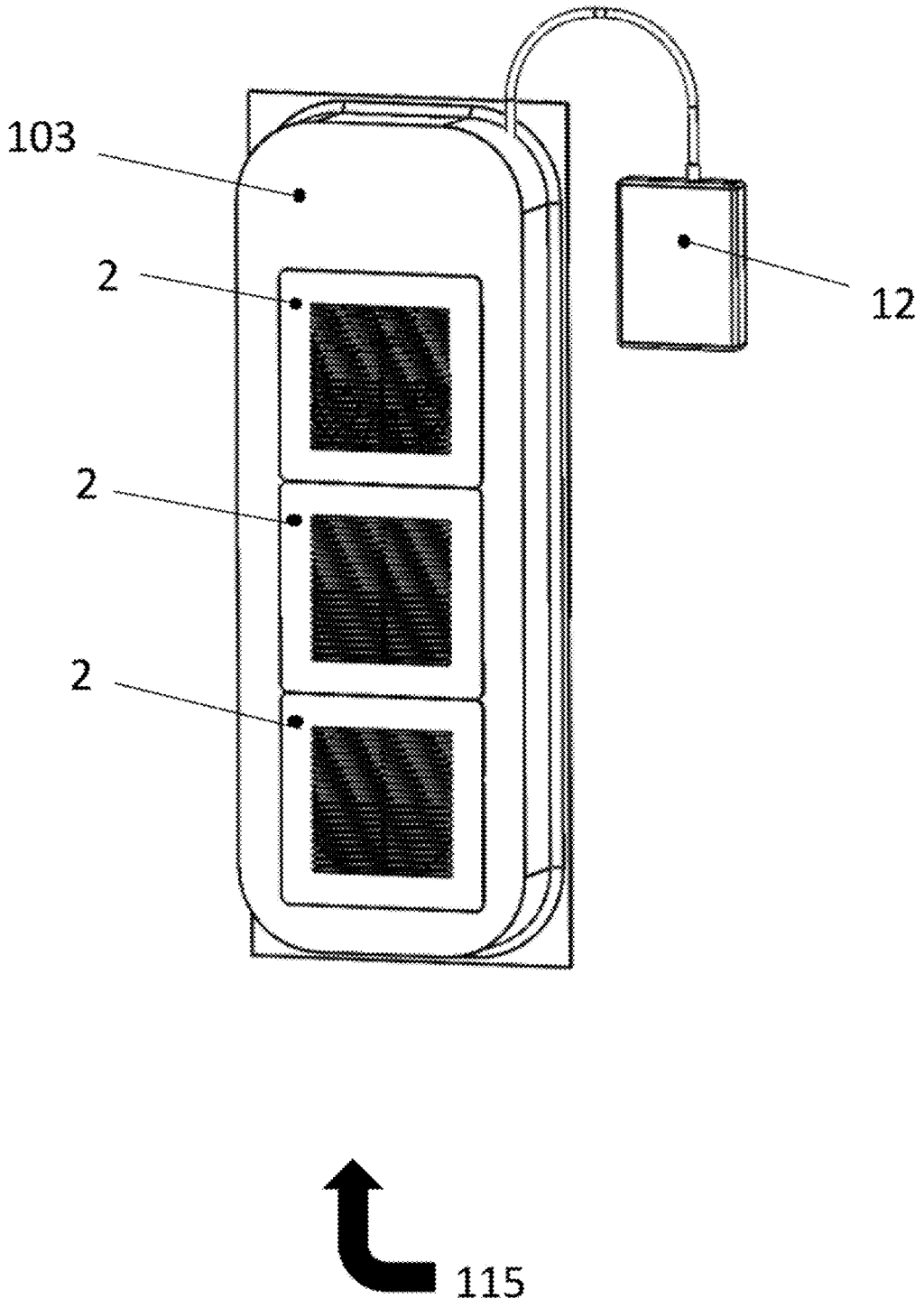
FIG. 38 illustrates a three-fan cooling apparatus of the present teachings.
Figure 39:
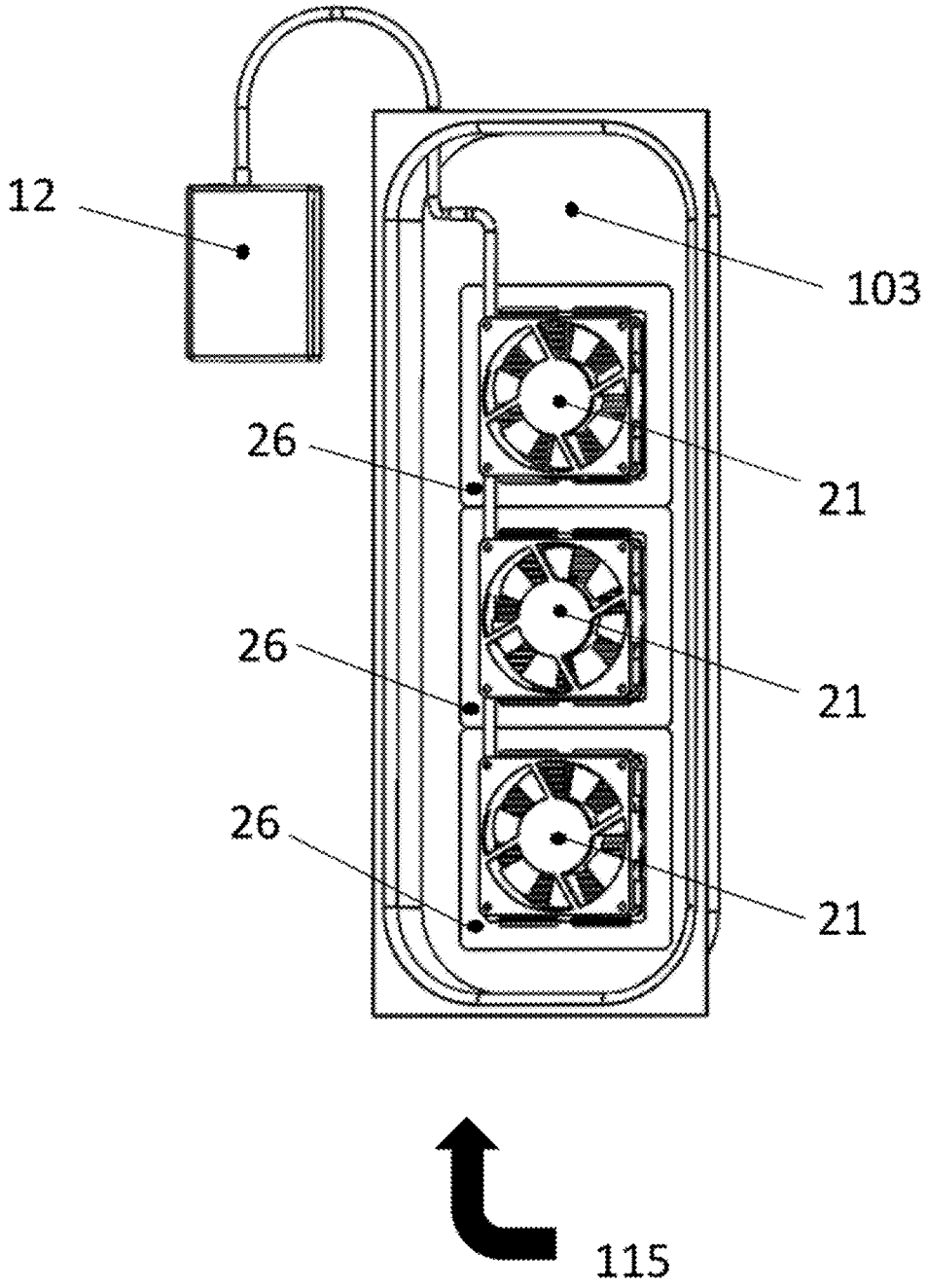
FIG. 39 illustrates a three-fan cooling apparatus of the present teachings.

This example illustrates a three-fan cooling apparatus 115 (FIG. 38, FIG. 39 and exploded view FIG. 11) of the present teachings.

Figure 11:
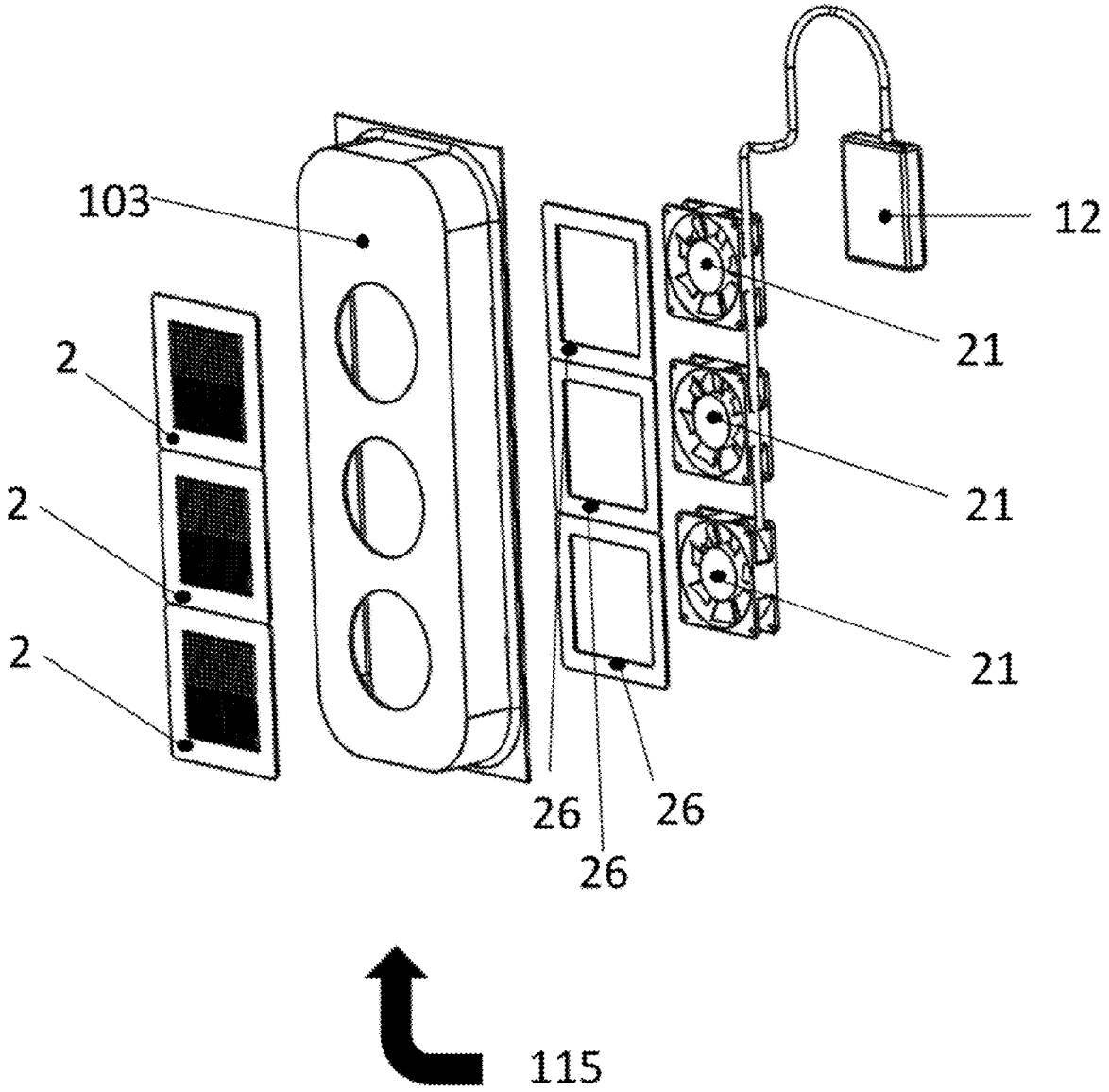
FIG. 11 illustrates an exploded view of a three-fan cooling apparatus of the present teachings.

An oval elongated fan plenum 103 (FIG. 11) is constructed out of canvas containing three round holes to accommodate three fan assemblies 30 (FIG. 4). For each of the three fan assemblies 30 (FIG. 4), a fan guard 2 (FIG. 5) is affixed to the outside of the oval elongated fan plenum 103 (FIG. 11) by inserting the frame 50 (FIG. 5) through a round hole in the oval elongated fan plenum 103 (FIG. 11). The frame 50 (FIG. 5) ends in outward facing clips 251 (FIG. 5) in which a retainer 26 (FIG. 11) is inserted under the outward facing clips 251 (FIG. 5) and inside the oval elongated fan plenum 103 (FIG. 11). This allows each fan assembly 30 (FIG. 4) to be securely attached to the oval elongated fan plenum 103 (FIG. 11) without sewing. Each fan assembly 30 (FIG. 4) comprises a 150 mm fan 21 (FIG. 6) comprised of fan blades 29 (FIG. 6) and a hub 28 (FIG. 6). The three fan assemblies 30 (FIG. 4) are configured so that the fans 21 (FIG. 6) can direct airflow towards the inside of the oval elongated fan plenum 103 (FIG. 11), are wired in parallel, and are attached to the battery pack 12 (FIG. 11).

Example 8

Figure 40:
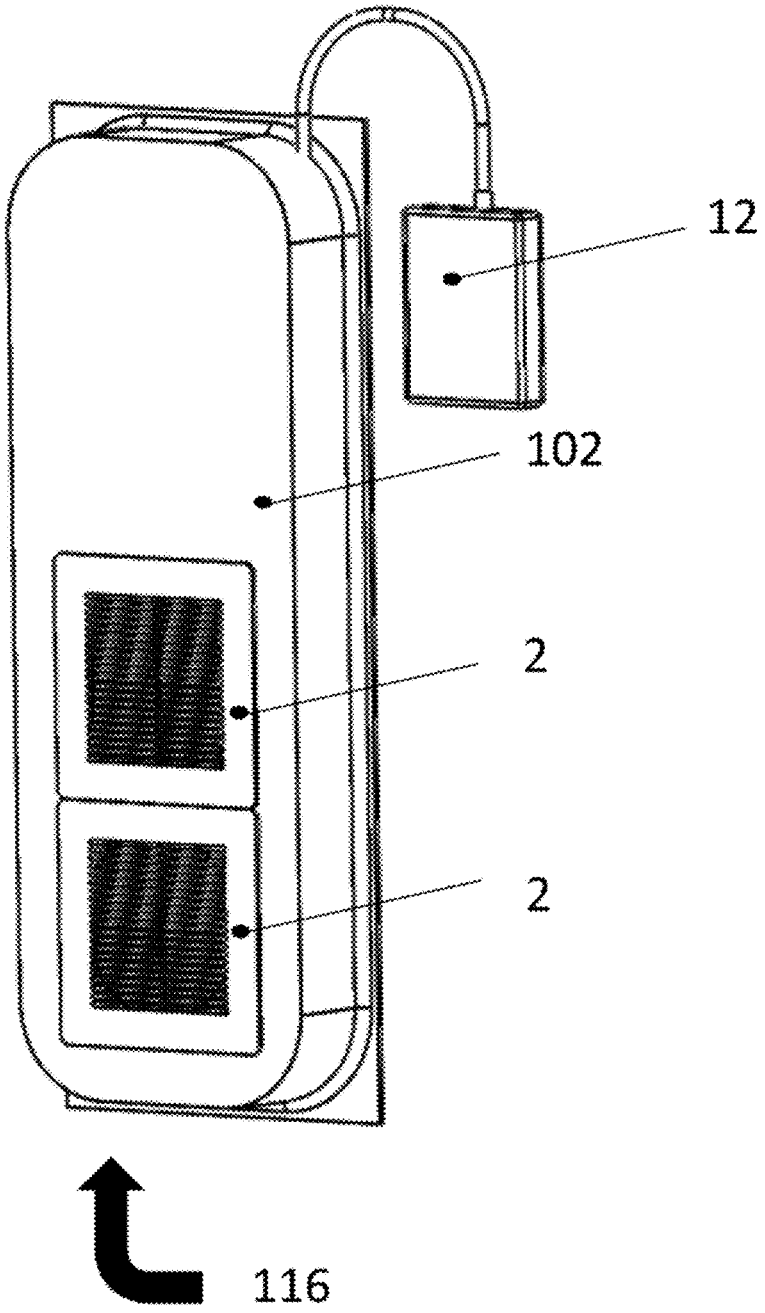
FIG. 40 illustrates a two-fan cooling apparatus of the present teachings.
Figure 41:
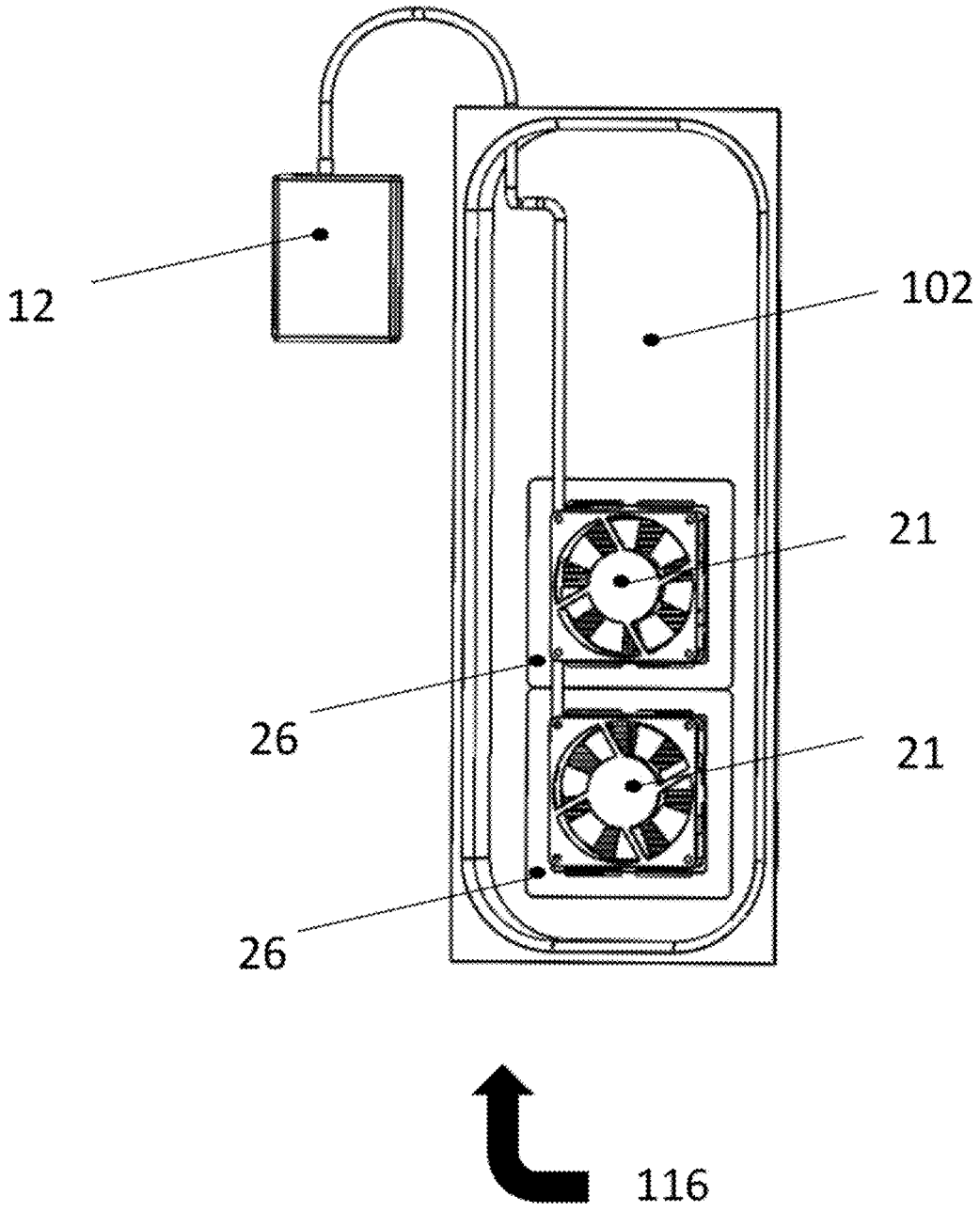
FIG. 41 illustrates a two-fan cooling apparatus of the present teachings.

This example illustrates a two-fan cooling apparatus 116 (FIG. 40, FIG. 41 and exploded FIG. 42) of the present teachings.

Figure 42:
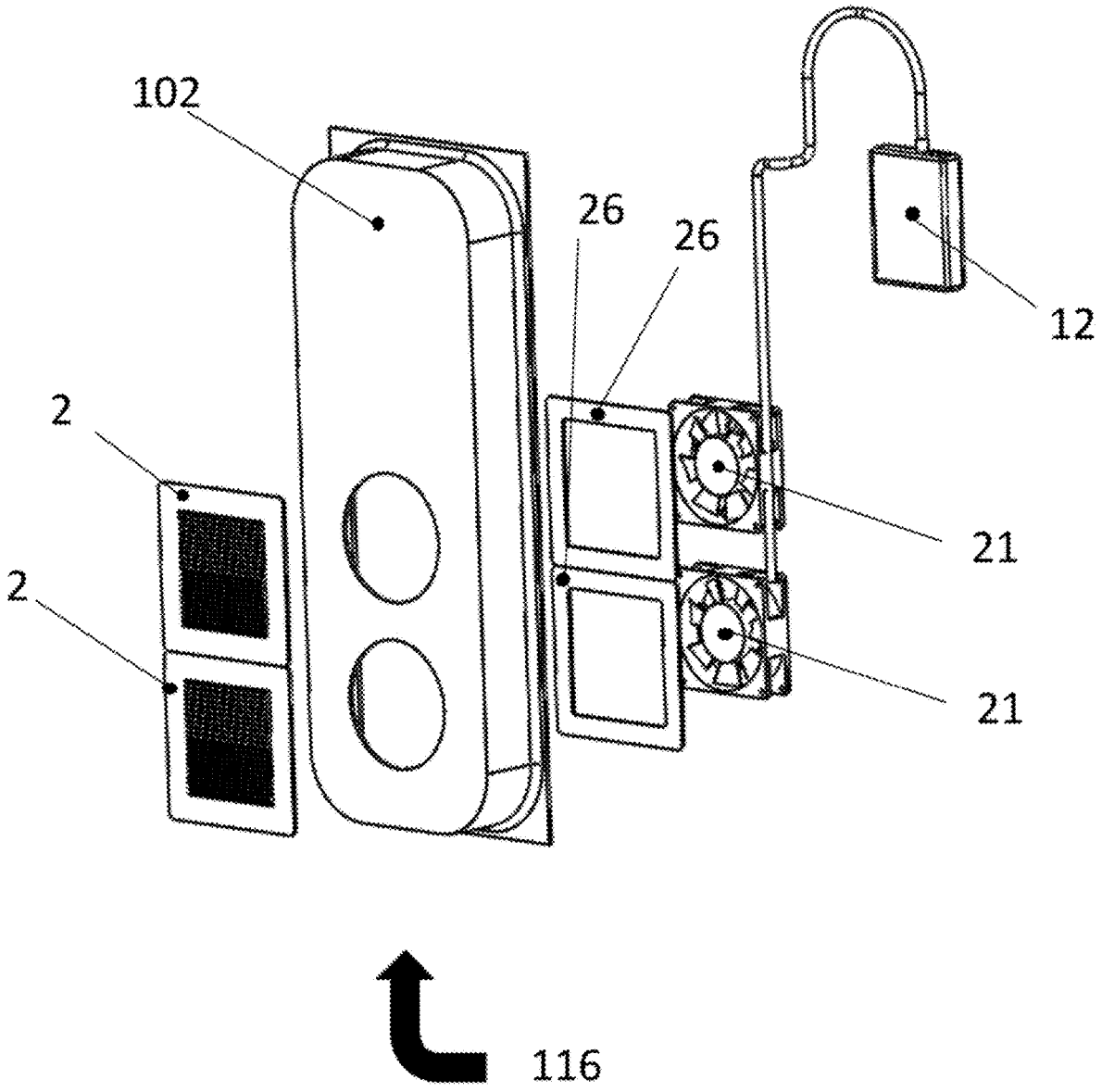
FIG. 42 illustrates an exploded view of a two-fan cooling apparatus of the present teachings.

An oval elongated fan plenum 102 (FIG. 42) is constructed out of canvas containing two round holes to accommodate two fan assemblies 30 (FIG. 4). For each of the two fan assemblies 30 (FIG. 4), a fan guard 2 (FIG. 5) is affixed to the outside of the oval elongated fan plenum 102 (FIG. 42) by inserting the frame 50 (FIG. 5) through a round hole in the oval elongated fan plenum 102 (FIG. 42). The frame 50 (FIG. 5) ends in outward facing clips 251 (FIG. 5) in which a retainer 26 (FIG. 42) is inserted under the outward facing clips 251 (FIG. 5) and inside the oval elongated fan plenum 102 (FIG. 42). This allows each fan assembly 30 (FIG. 4) to be securely attached to the oval elongated fan plenum 102 (FIG. 42) without sewing. Each fan assembly 30 (FIG. 4) comprises a 172 mm fan 21 (FIG. 6) comprised of fan blades 29 (FIG. 6) and a hub 28 (FIG. 6). The two fan assemblies 30 (FIG. 4) are configured so that the fans 21 (FIG. 6) can direct airflow towards the inside of the oval elongated fan plenum 102 (FIG. 42), are wired in parallel, and are attached to the battery pack 12 (FIG. 42).

Example 9

Figure 43:
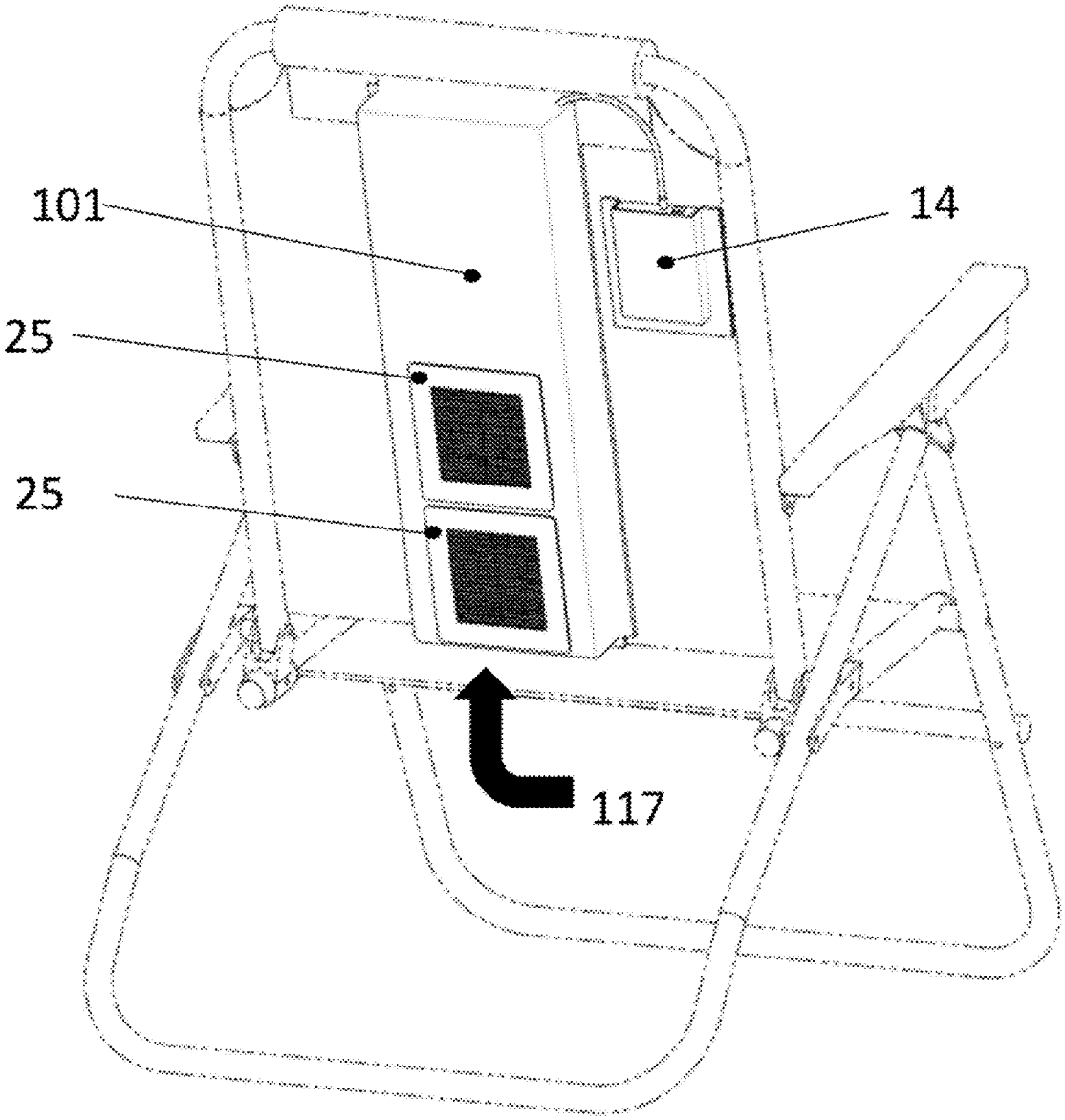
FIG. 43 illustrates a two-fan cooling apparatus of the present teachings as assembled from a kit and attached to a chair (shown in phantom line).
Figure 44:
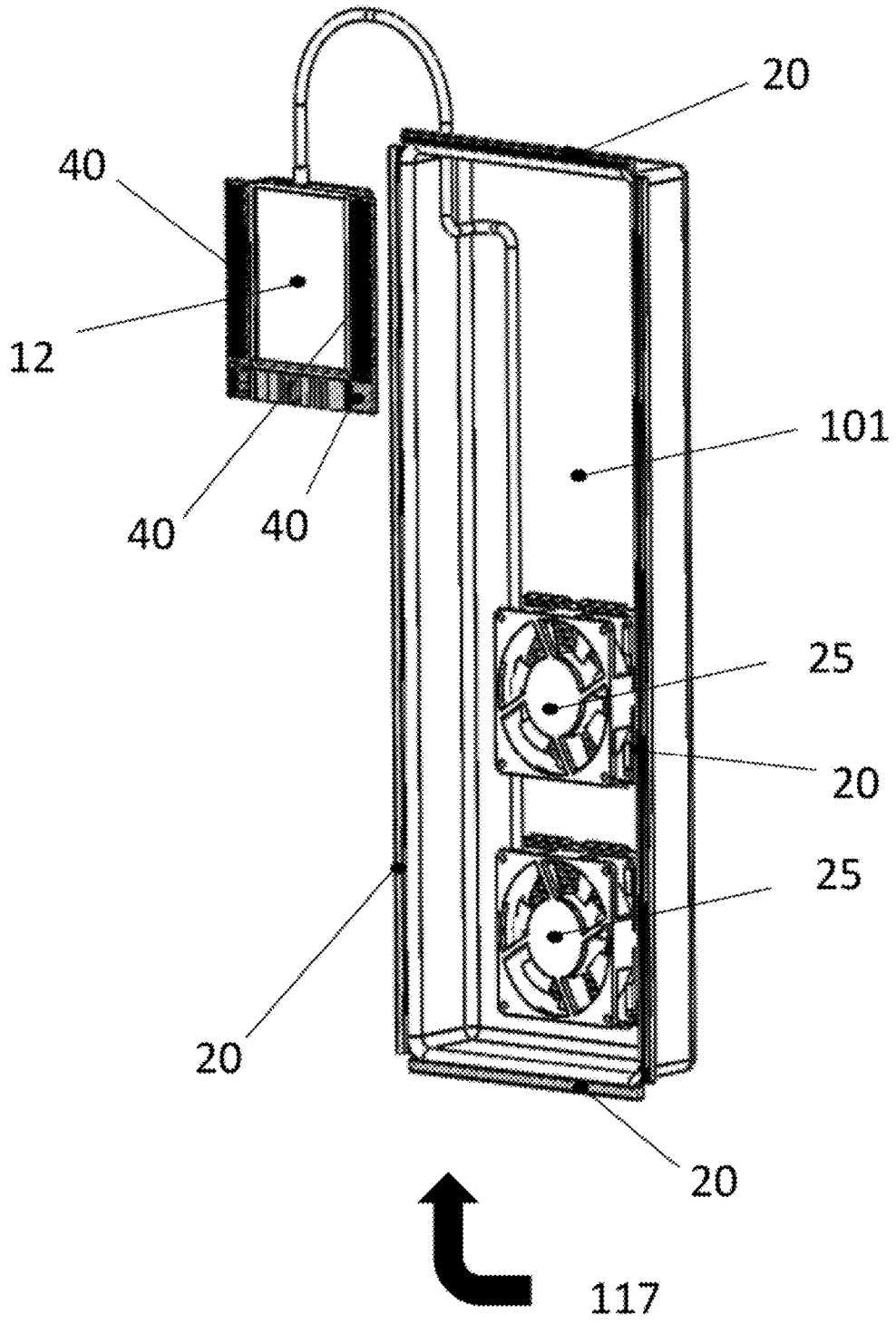
FIG. 44 illustrates a two-fan cooling apparatus of the present teachings as assembled from a kit.

The example illustrates a kit 117 (FIG. 43, FIG. 44 and exploded FIG. 45) for creating a chair of the present teachings.

Figure 45:
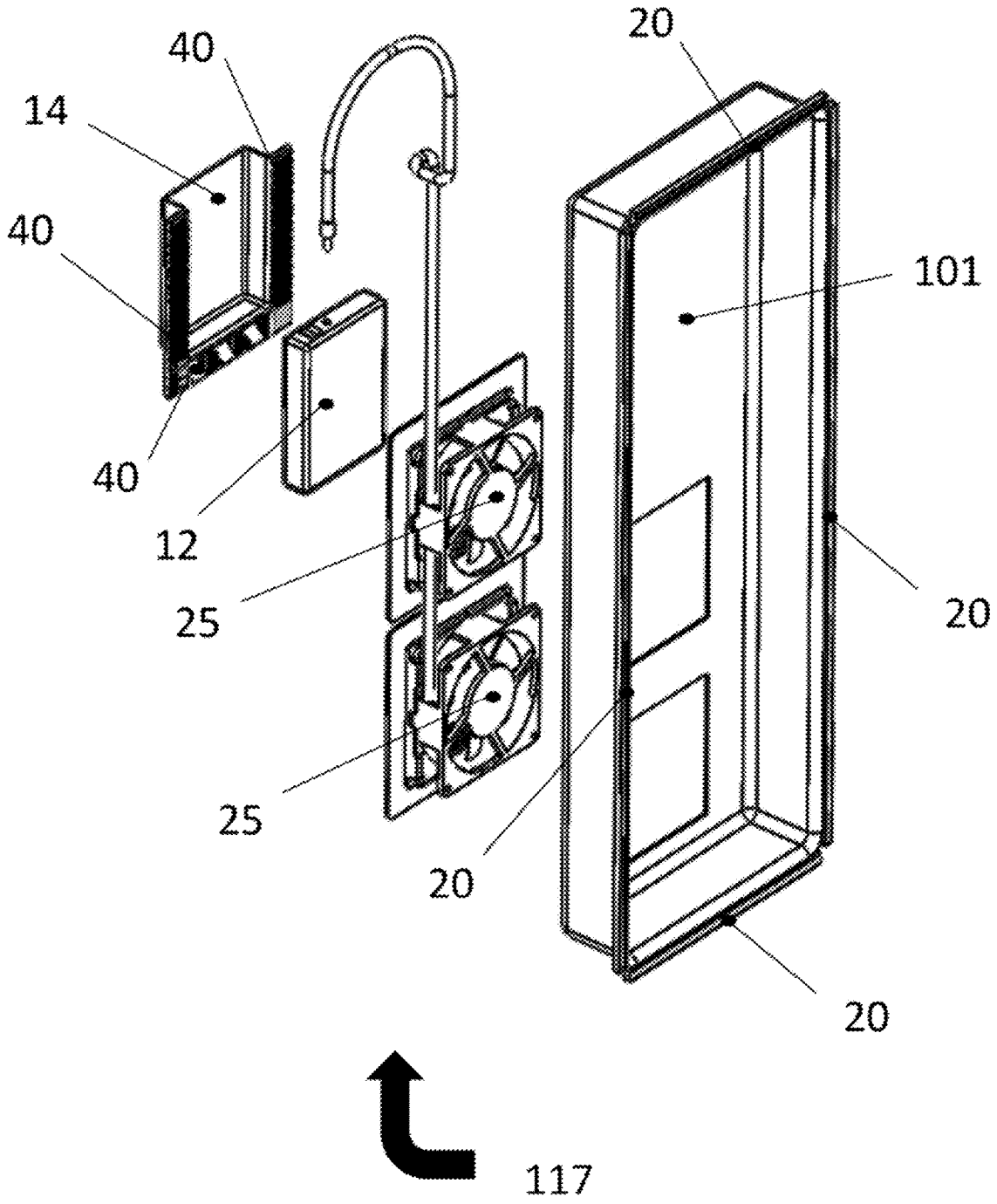
FIG. 45 illustrates an exploded view of a two-fan cooling apparatus of the present teachings as assembled from a kit.

A rectangular elongated fan plenum 101 (FIG. 45) is constructed out of canvas with two square holes in the back and accommodates two 92 mm fans 25 (FIG. 45). The two fans 25 (FIG. 45) are sewn into the rectangular elongated fan plenum 101 (FIG. 45). The fans 25 (FIG. 45) are configured to direct airflow towards the inside of the elongated fan plenum 101 (FIG. 45), are wired in parallel, and are attached to the battery pack 12 (FIG. 45). Hook and loop fasteners (Velcro®) are attached to flaps 20 (FIG. 45) on the elongated fan plenum 101 (FIG. 45). The kit 117 (FIG. 43, FIG. 44 and exploded FIG. 45) also includes a battery pouch 14 (FIG. 45) with hook and loop fasteners on three sides 40 (FIG. 45). The kit 117 (FIG. 43, FIG. 44 and exploded FIG. 45) provides hook and loop fasteners for affixing to a chair of the user's choice.

Example 10

Figure 46:
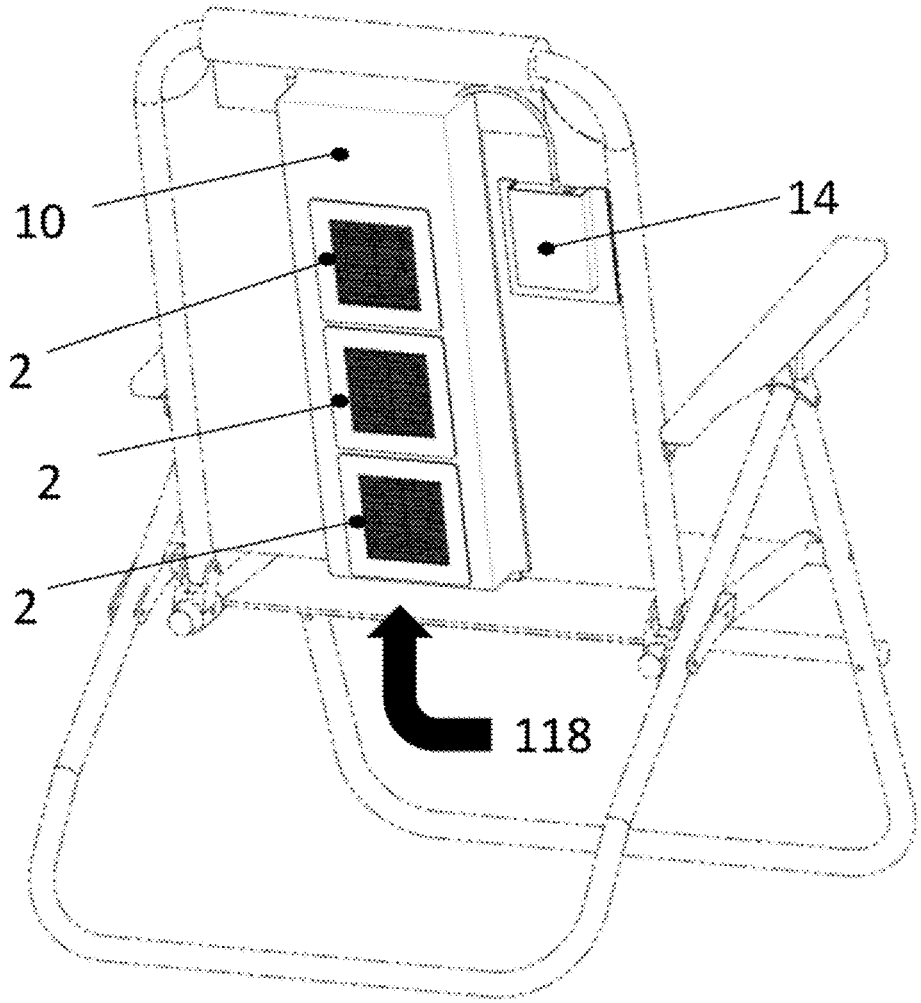
FIG. 46 illustrates a three-fan cooling apparatus of the present teachings as assembled from a kit and attached to a chair (shown in phantom line).
Figure 47:
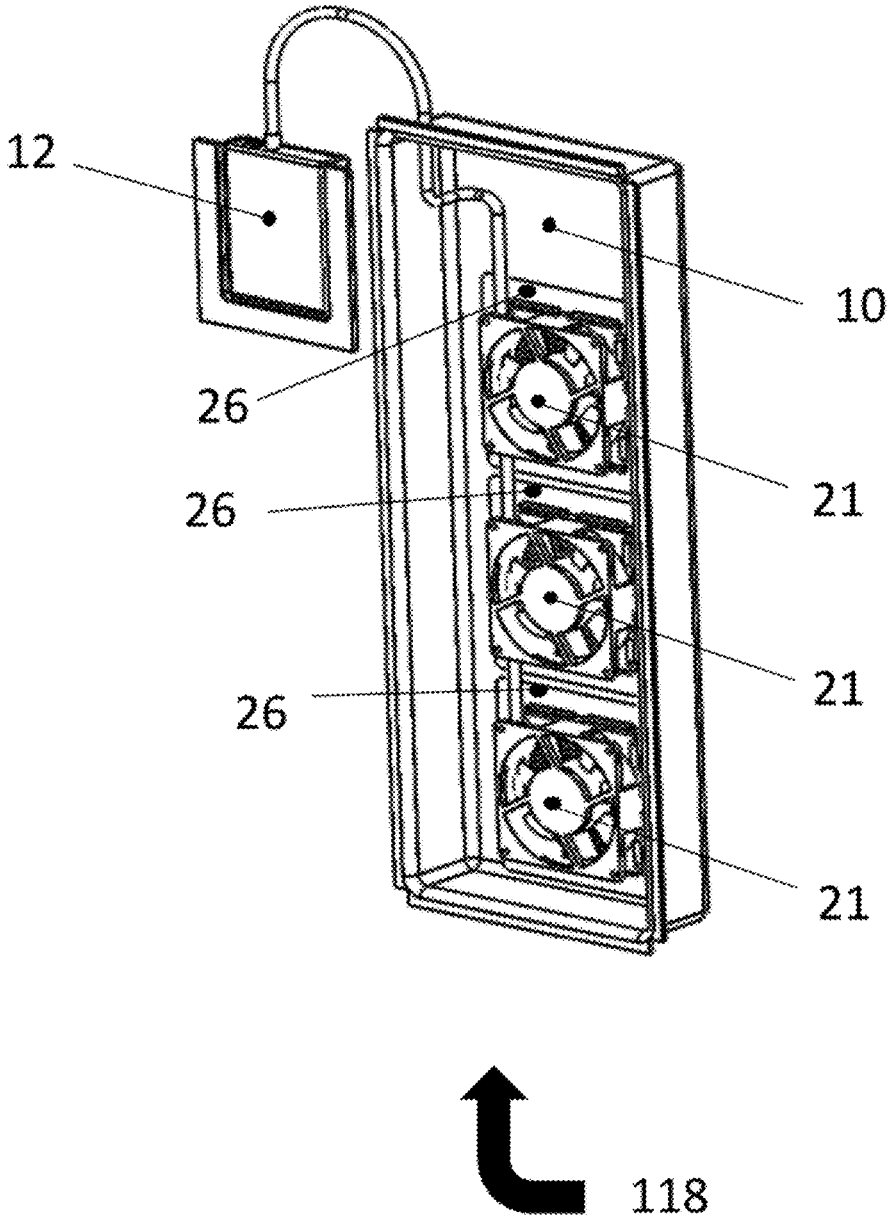
FIG. 47 illustrates a three-fan cooling apparatus of the present teachings as assembled from a kit.

This example illustrates a three-fan kit 118 (FIG. 46, FIG. 47 and exploded FIG. 48) for creating a chair of the present teachings.

Figure 48:
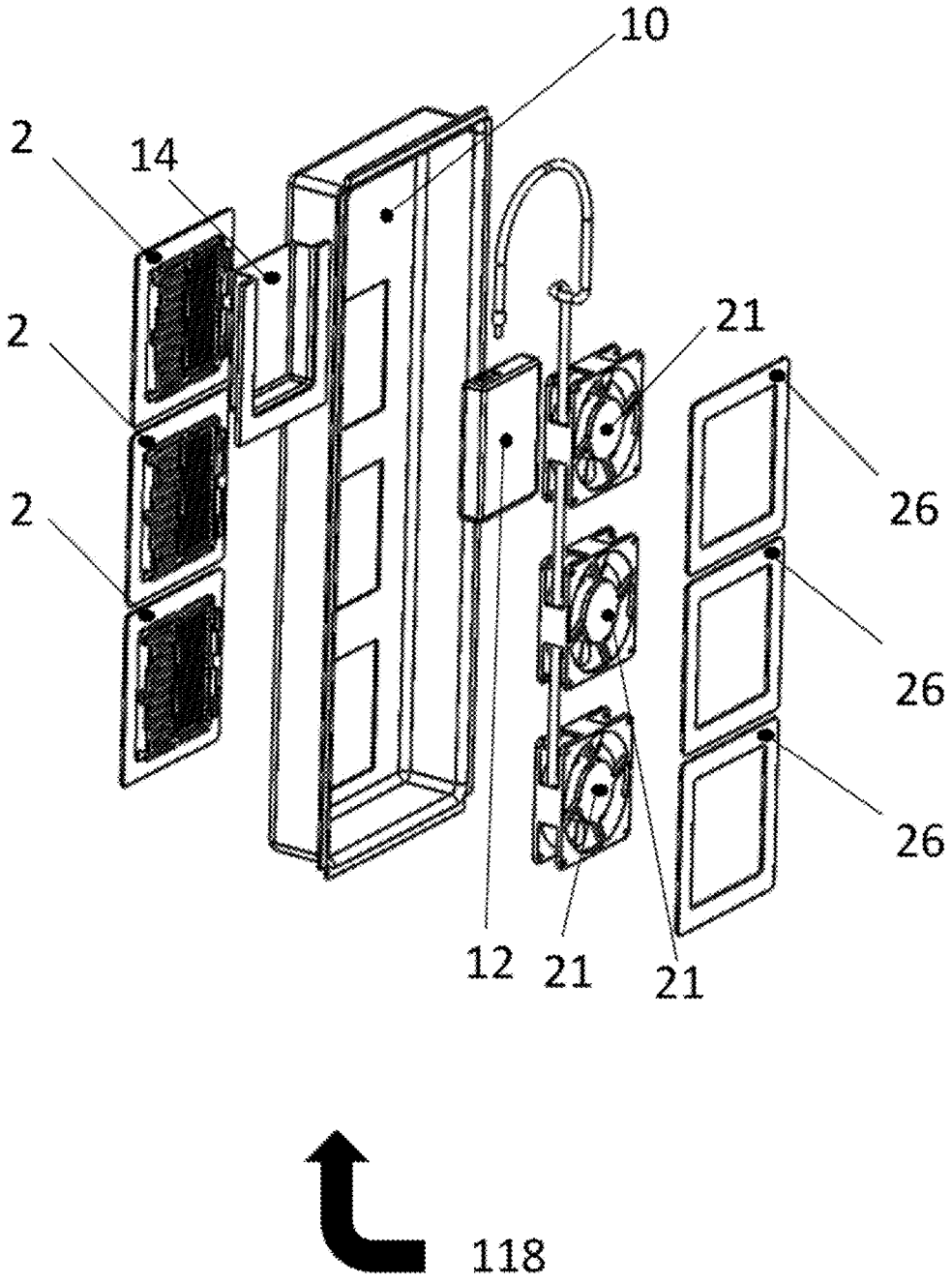
FIG. 48 illustrates an exploded view of three-fan cooling apparatus of the present teachings as assembled from a kit.

A rectangular elongated fan plenum 10 (FIG. 48) is constructed out of canvas containing three square holes to accommodate three fan assemblies 30 (FIG. 4). For each of the three fan assemblies 30 (FIG. 4), a fan guard 2 (FIG. 5) is affixed to the outside of the rectangular elongated fan plenum 10 (FIG. 48) by inserting the frame 50 (FIG. 5) through a square hole in the rectangular elongated fan plenum 10 (FIG. 48). The frame 50 (FIG. 5) ends in outward facing clips 251 (FIG. 5) in which a retainer 26 (FIG. 48) is inserted under the outward facing clips 251 (FIG. 5) and inside the oval elongated fan plenum 10 (FIG. 48). This allows each fan assembly 30 (FIG. 4) to be securely attached to the rectangular elongated fan plenum 10 (FIG. 48) without sewing. Each fan assembly 30 (FIG. 4) comprises a 92 mm fan 21 (FIG. 6) comprised of fan blades 29 (FIG. 6) and a hub 28 (FIG. 6). The three fan assemblies 30 (FIG. 4) are configured so that the fans 21 (FIG. 6) can direct airflow towards the inside of the rectangular elongated fan plenum 10 (FIG. 48), are wired in parallel, and are attached to the battery pack 12 (FIG. 48). One side of the rectangular elongated fan plenum 10 (FIG. 48) has hook and loop fasteners (VELCRO®) for attaching the rectangular elongated fan plenum 10 (FIG. 48) to the chair A battery pouch 14 (FIG. 48) with an open side is also included for storing the battery pack 12 (FIG. 48). The kit 118 (FIG. 46, FIG. 47 and exploded FIG. 48) comes with instructions to sew the rectangular elongated fan plenum 10 (FIG. 48) and battery pouch 14 (FIG. 48) to the chair.

Example 11

Figure 49:
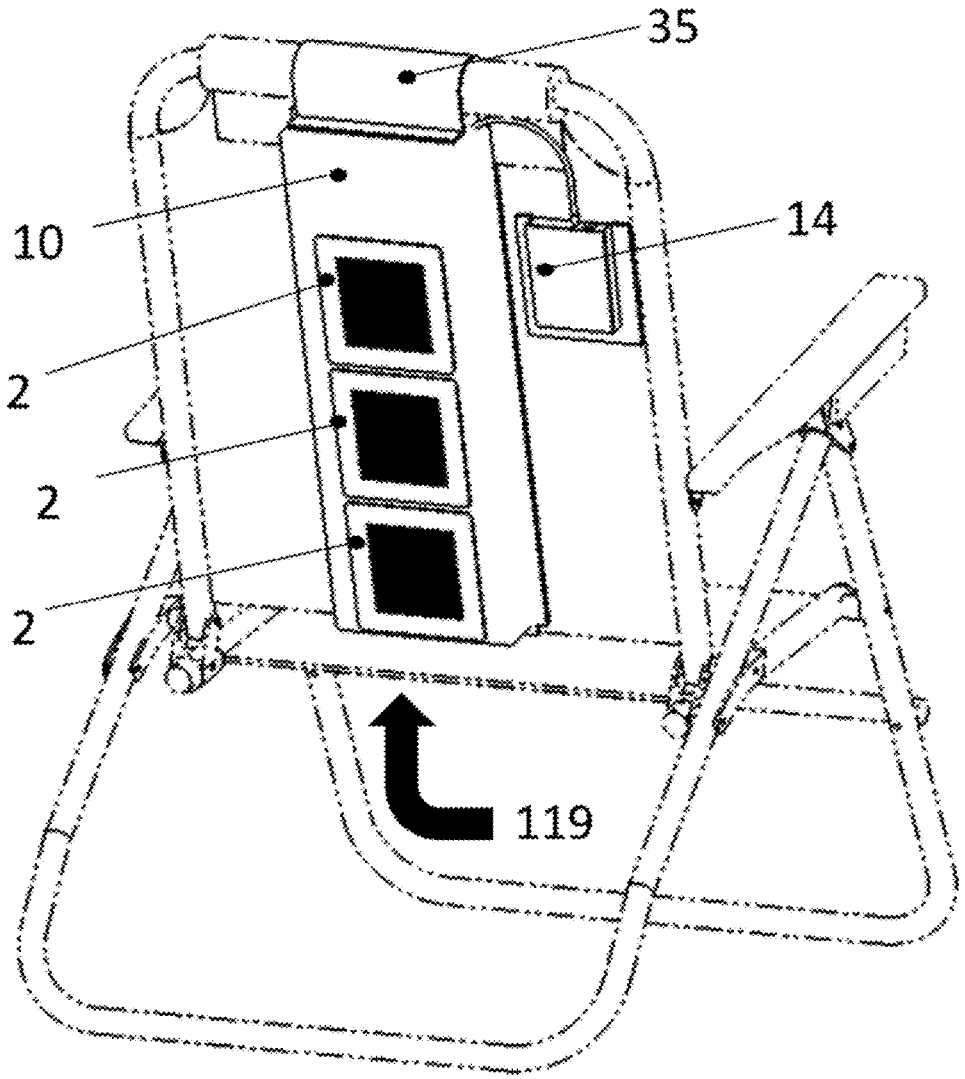
FIG. 49 illustrates a three-fan cooling apparatus of the present teachings as assembled from a kit and attached to a chair (shown in phantom line).
Figure 50:
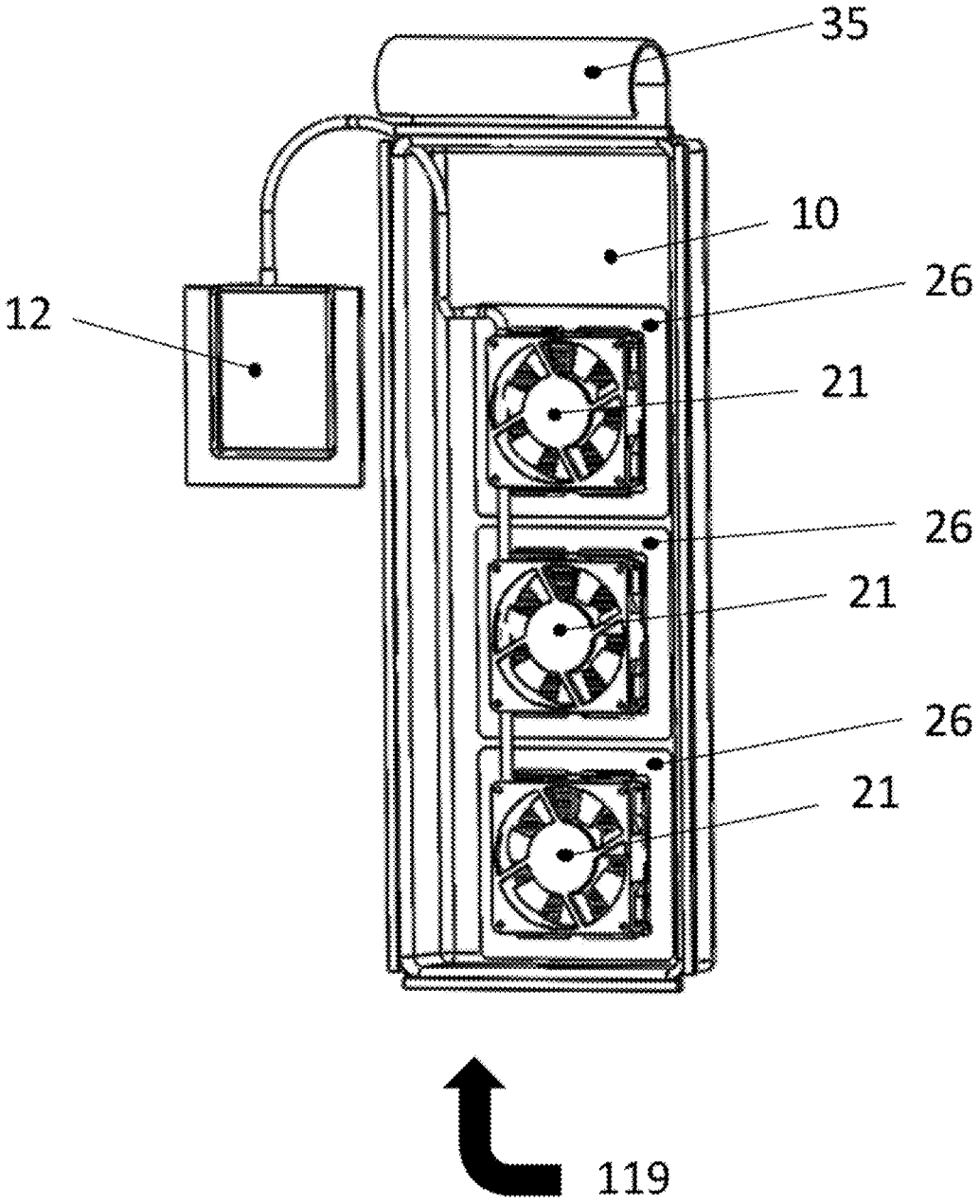
FIG. 50 illustrates assembled components of a three-fan kit of the present teachings (without showing a chair).

This example illustrates a three-fan kit 119 (FIG. 49, FIG. 50 and exploded FIG. 51) for creating a chair of the present teachings.

Figure 51:
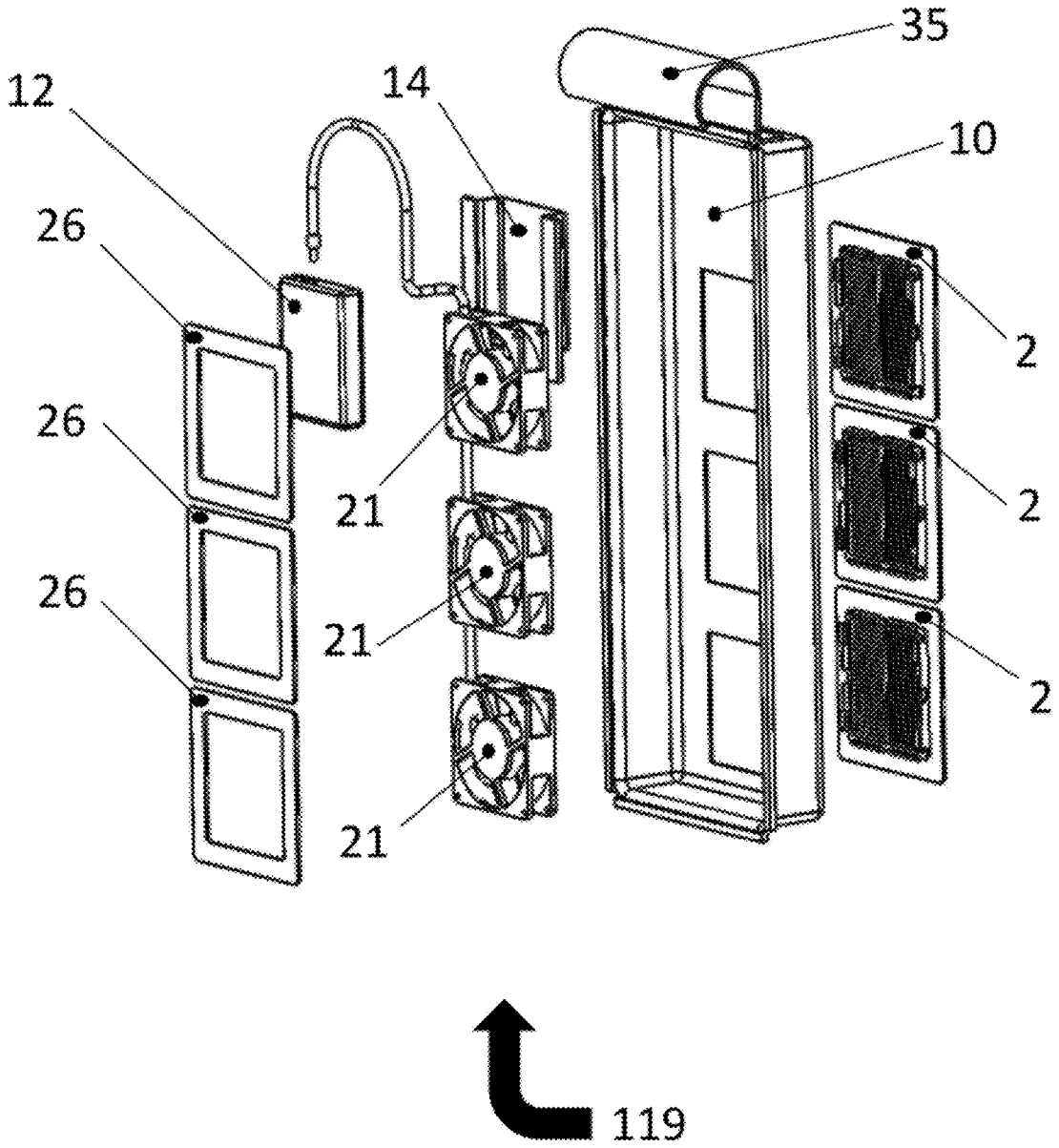
FIG. 51 illustrates an exploded view of assembled components of a three-fan kit of the present teachings (without showing a chair).

A rectangular elongated fan plenum 10 (FIG. 51) is constructed out of canvas containing three square holes to accommodate three fan assemblies 30 (FIG. 4). For each of the three fan assemblies 30 (FIG. 4), a fan guard 2 (FIG. 5) is affixed to the outside of the rectangular elongated fan plenum 10 (FIG. 51 ) by inserting the frame 50 (FIG. 5) through a square hole in the rectangular elongated fan plenum 10 (FIG. 51). The frame 50 (FIG. 5) ends in outward facing clips 251 (FIG. 5) in which a retainer 26 (FIG. 51) is inserted under the outward facing clips 251 (FIG. 5) and inside the oval elongated fan plenum 10 (FIG. 51). This allows each fan assembly 30 (FIG. 4) to be securely attached to the rectangular elongated fun plenum 10 (FIG. 51) without sewing. Each fan assembly 30 (FIG. 4) comprises a 92 mm fan 21 (FIG. 6) comprised of fan blades 29 (FIG. 6) and a hub 28 (FIG. 6). The three fan assemblies 30 (FIG. 4) are configured so that the fans 21 (FIG. 6) can direct airflow towards the inside of the rectangular elongated fan plenum 10 (FIG. 51), are wired in parallel, and are attached to the battery pack 12 (FIG. 51). The rectangular elongated fan plenum 10 (FIG. 51) has a hook 35 (FIG. 51) attached to the rectangular elongated fan plenum 10 (FIG. 51) that attaches the kit 119 (FIG. 49, FIG. 50 and exploded FIG. 51) to the chair. A battery pouch 14 (FIG. 51) with an open side is also included for storing the battery pack 12 (FIG. 51). The kit 119 (FIG. 49, FIG. 50 and exploded FIG. 51) comes with instructions to attach the rectangular elongated fan plenum 10 (FIG. 51) to a chair by use of the hook 35 (FIG. 51) and to sew the battery pouch 14 (FIG. 51) to the chair.

Example 12

This example illustrates cooling capability of a three-fan chair of the present teachings.

Figure 12:
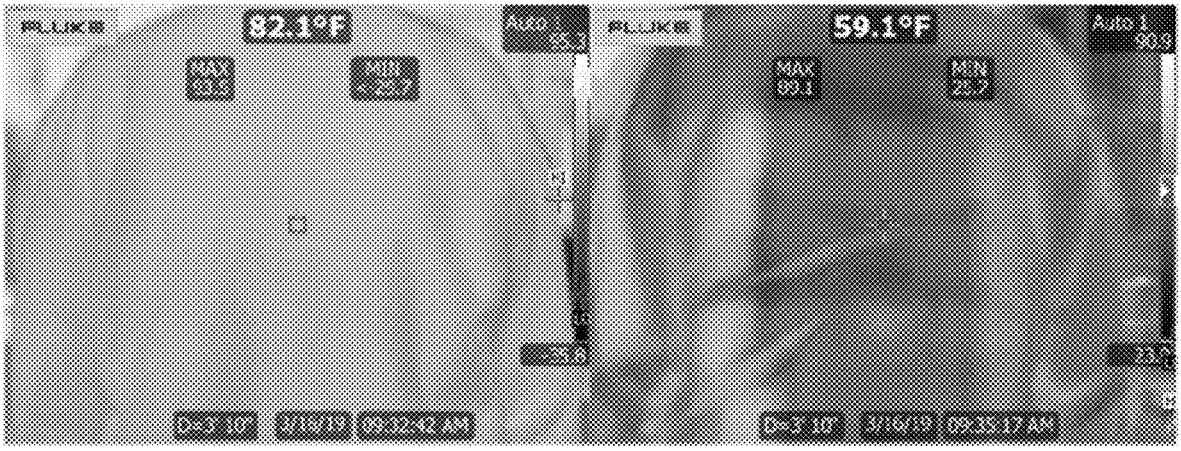
FIG. 12 presents thermal images of a subject, obtained before and after being subjected to cooling in a chair of the present teachings.

In this investigation, thermal images were recorded of the back of a clothed adult female weighing approximately 160 pounds (Subject A) sitting in a chair described in Example 2 using a Fluke Ti400 PRO Thermal Imaging Infrared Camera in accordance with the manufacturer's instructions (FIG. 12, left panel). Prior to turning on the fans, a temperature of 82.1° F. was recorded near the center of the subject's back (indicated by square). Subject A then sat in the chair of Example 2 with the fans running for 2 minutes, and new thermal images were then obtained (FIG. 12, right panel.) The temperature recorded near the center of the subject's back (indicated by square) was 59.1° F. a decrease of 23° F., demonstrating significant cooling of the subject.

Example 13

This example illustrates cooling capability of a three-fan chair of the present teachings.

Figure 13:
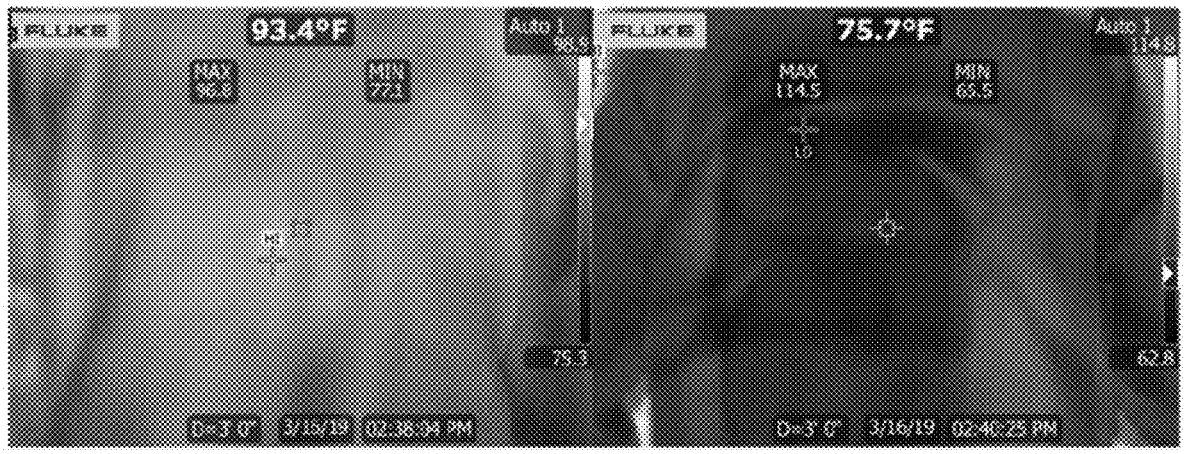
FIG. 13 presents thermal images of a subject, obtained before and after being subjected to cooling in a chair of the present teachings.

In this lest, thermal images were obtained of subject A's back using the thermal imaging camera as described in Example 12 (FIG. 13, left panel.) The camera recorded a temperature near the center of the subject's back (indicated by square) of 93.4° F. prior to turning on the fans. Subject A then sat in the chair of Example 2 with the fans running for 2 minutes, and new thermal images were then recorded (FIG. 13, right panel.) A temperature near the center of the subject's back (indicated by square) of 75.7° F. was recorded, showing a decrease of 17.7° F. demonstrating that the chair had a significant cooling effect.

Example 14

This example illustrates cooling capability of a three-fan chair of the present teachings.

Figure 14:
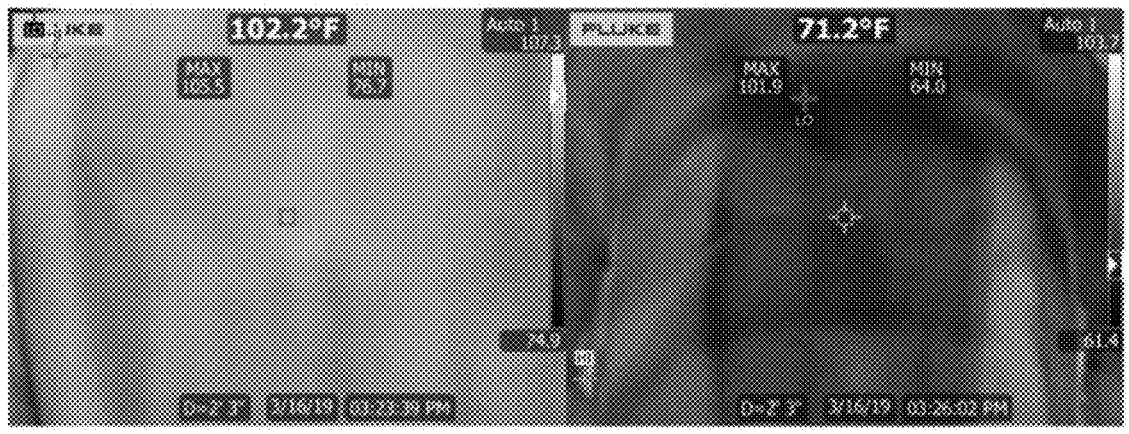
FIG. 14 presents thermal images of a subject, obtained before and after being subjected to a chair of the present teachings.

In this test, thermal images were recorded using a thermal imaging camera of subject A's back (FIG. 14, left panel.) The camera recorded a temperature near the center of the subject's back (indicated by square) of 102.2° F. prior to running the fans of a chair of Example 1. Subject A then sat in the chair of Example 2 for 2 minutes with the fans running, and new thermal images were then obtained (FIG. 14 right panel). A temperature near the center of the subject's back (indicated by square) was recorded as 71.2° F., showing a decrease of 31.0° F., demonstrating that the char had a significant cooling effect.

Example 15

This example illustrates cooling capability of a three-fan chair of the present teachings.

Figure 15:
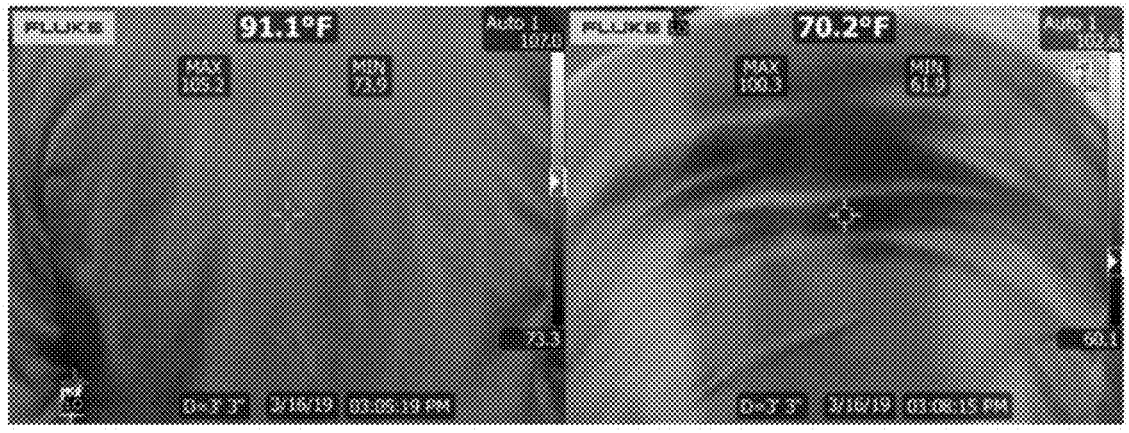
FIG. 15 presents thermal images of a subject, obtained before and after being subjected to a chair of the present teachings.

In this investigation, thermal images were taken of the back of an adult male weighing approximately 240 pounds (Subject S) using the Fluke Ti400 PRO Thermal Imaging Infrared Camera of Example 12. The camera recorded a temperature near the center of the subject's back (indicated by square) of 91.1° F.. Subject S sat in the chair of Example 2 for 2 minutes with the fans running, and new thermal images were obtained (FIG. 15, right panel.) A temperature near the center of the subject's back (indicated by square) of was recorded as 70.2° F.—a decrease of 20.9° F., showing that the chair had a significant cooling effect.

Example 16

This example illustrates cooling capability of a three-fan chair of the present teachings.

Figure 16:
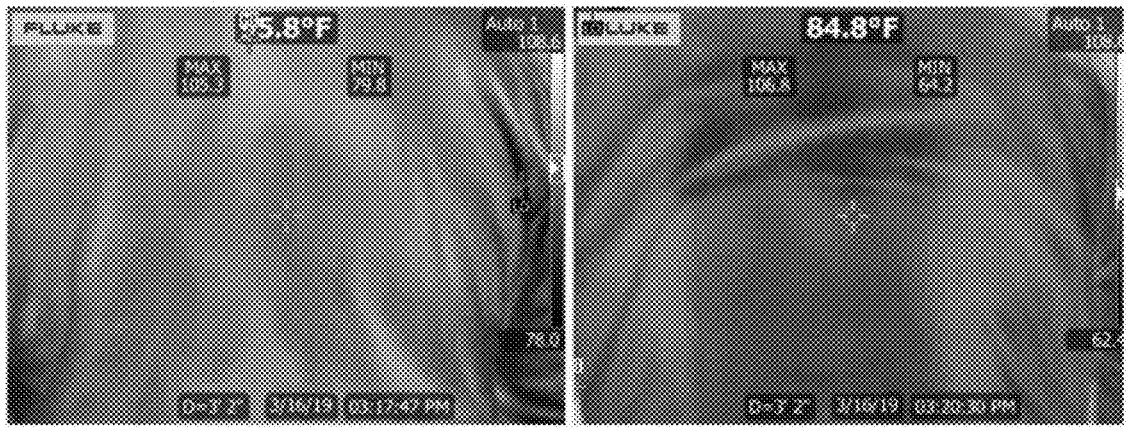
FIG. 16 presents thermal images of a subject, obtained before and alter being subjected to a chair of the present teachings.

In this test, thermal images were obtained of Subject S's back (FIG. 16, left panel.) The camera recorded a temperature near the center of the subject's back (indicated by square) of 95.8° F. Subject S then sat in the chair of Example 2 with the fans running for 2 minutes. A second set of thermal images were then recorded (FIG. 16 right panel). A temperature near the center of the subject's back (indicated by square) was recorded as 84.8° F., a decrease of 11.0° F., showing that the chair had a significant cooling effect.

Example 17

This example illustrates a comparative test of a chair in accordance with the teachings of U.S. Pat. No. 8,801,091.

Figure 17:
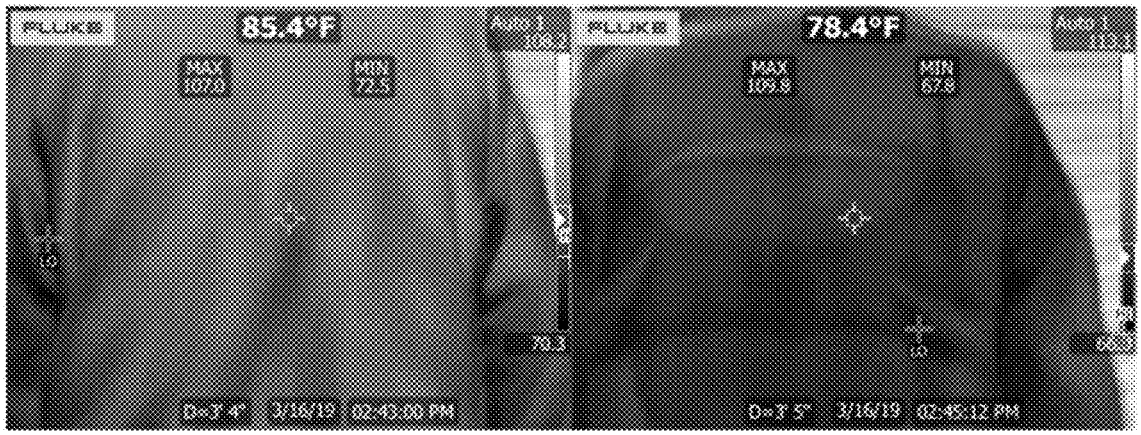
FIG. 17 presents thermal images of a subject, obtained before and after being subjected to a chair of prior art chair described in U.S. Pat. No. 8,801,091.

In these investigations, thermal images were recorded of the back of a clothed adult female (Subject A from Example 12) sitting in a chair described in U.S. Pat. No. 8,801,091 (commercially available as Traveling Breeze Leisure Products. LLC model AIR-C18) using a Fluke Ti400 PRO Thermal Imaging Infrared Camera. Prior to sitting in the chair (FIG. 17, left panel), the temperature near the center of the subject's back (indicated by square) of 85.4° F. was recorded. Subject A then sat in the chair with the fans running for 2 minutes, and new thermal images were then obtained (FIG. 17, right panel.) The temperature near the center of the subject's back (indicated by square) was recorded as 78.4° F.—a decrease of 7° F., demonstrating less cooling of the subject compared to a chair of the present teachings.

Example 18

This example illustrates a comparative test of a chair in accordance with the teachings of U.S. Pat. No. 8,801,091.

Figure 18:
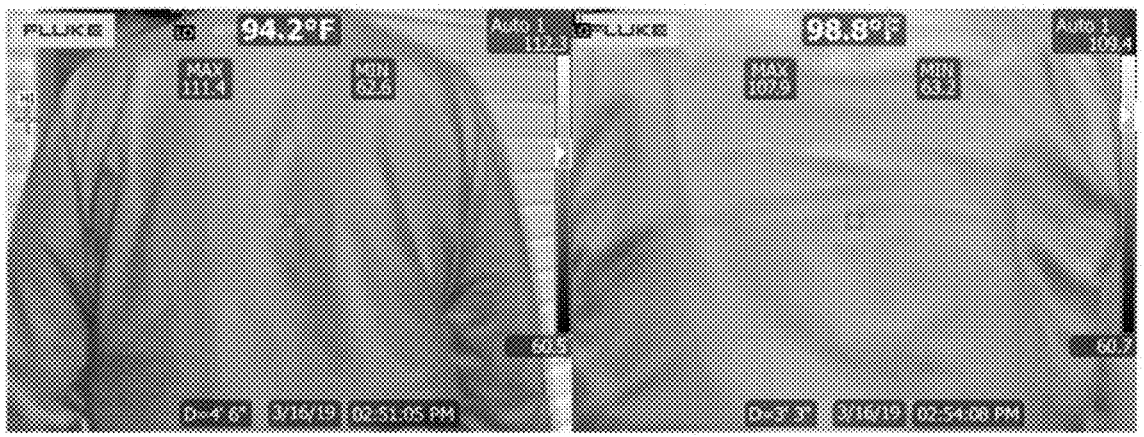
FIG. 18 presents thermal images of a subject, obtained before and after being subjected to a chair of prior art chair described in U.S. Pat. No. 8,801,091.

In these investigations, thermal images were obtained of the back of an adult male (Subject S of Example 15) using the Fluke Ti400 PRO Thermal Imaging Infrared Camera of Example 12.) Prior to sitting in the chair (FIG. 18 left panel), the camera recorded near the center of the subject's back (indicated by square) a temperature of 94.2° F. Subject S then sat in the chair manufactured in accordance with the teachings of U.S. Pat. No. 8,801,091 for 2 minutes with the fans running, and new thermal images were obtained (FIG. 18, right panel.) The camera recorded a temperature near the center of the subject's back (indicated by square) of 98.8° F.—an increase of 4.6° F., showing that the chair of U.S. Pat. No. 8,801,091 did not have a cooling effect under these conditions.

All cited references are incorporated by reference, each in its entirety. Applicant reserves the right to challenge any conclusions presented by the authors of any reference.

What is claimed is:

1. A chair comprising:

A chair back comprising a porous material;

an electric power source; and an elongated fan plenum comprising a long axis disposed substantially vertically upon the chair hack, wherein the elongated fan plenum comprises a side comprising a portion of the chair back comprising the porous material, three sides and two ends, each comprising a non-porous material, and two or more fan assemblies, each fan assembly comprising a fan, wherein each fan directs airflow through the portion of the chair back comprising the porous material wherein the elongated fan plenum has a cross-sectional area of no more than 0.08 $ft^2$, whereby airflow is directed to a user's shoulders, neck and head.

2. A chair in accordance with claim 1, wherein the porous material is selected from the group consisting of wicker, a nylon mesh, a polyester mesh, a vinyl-coated polyester mesh (PVC mesh), a metal mesh, and a combination thereof.

3. A chair in accordance with claim 1, wherein the porous material is a PVC mesh.

4. A chair in accordance with claim 1, wherein the non-porous material is selected from the group consisting of canvas, woven cotton, metal, plastic, and a combination thereof.

5. A chair in accordance with claim 1, wherein the non-porous material is canvas.

6. A chair in accordance with claim 1, wherein the electric power source is a direct current source selected from the group consisting of at least one battery and at least one solar cell.

7. A chair in accordance with claim 6, wherein the at least one battery is a lithium ion battery.

8. A chair in accordance with claim 6, wherein the at least one battery is an alkaline battery.

9. A chair in accordance with claim 1, wherein the electric power source is an alternating current source.

10. A chair in accordance with claim 1, wherein each fan has a volumetric flow rate of from 30 to 200 cubic feet per minute.

11. A chair in accordance with claim 1, wherein each fan has a volumetric flow rate of from 70 to 120 cubic feet per minute.

12. A chair in accordance with claim 1, wherein each fan has a volumetric flow rate of 75 to 100 cubic feet per minute.

13. A chair in accordance with claim 1, wherein each fan assembly further comprises a fan guard.

14. A chair comprising:

A chair back comprising PVC mesh;

a lithium ion battery; and an elongated fan plenum comprising a long axis disposed substantially vertically upon the chair back, wherein the elongated fan plenum comprises three sides and two ends, each comprising canvas, one side comprising a portion of the chair back comprising PVC mesh, and two or more fan assemblies, wherein each fan assembly comprises a fan and a fan guard, wherein each fan is configured to direct air flow towards the inside of the plenum, through the chair back, and to a user's shoulders, neck and head, wherein the elongated fan plenum has a cross-sectional area of no more than 0.08 $ft^2$, and wherein each fan has a volumetric flow rate of from 30 to 200 cubic feet per minute.

* * * * *